US005244779A

United States Patent [19]

Asami

[11] Patent Number: 5,244,779

[45] **Date of Patent: * Sep. 14, 1993**

[54] SILVER HALIDE COLOR PHOTOGRAPHIC MATERIAL

[75] Inventor: Masahiro Asami, Kanagawa, Japan

[73] Assignee: Fuji Photo Film Co., Ltd., Kanagawa, Japan

[ * ] Notice: The portion of the term of this patent subsequent to Aug. 6, 2008 has been disclaimed.

[21] Appl. No.: 821,833

[22] Filed: Jan. 13, 1992

Related U.S. Application Data

[63] Continuation of Ser. No. 430,538, Nov. 1, 1989, abandoned.

[30] Foreign Application Priority Data

Nov. 1, 1988 [JP] Japan ..... 63-276678

[51] Int. Cl.[5] ..... G03C 1/20

[52] U.S. Cl. ..... 430/503; 430/505; 430/584; 430/600; 430/607; 430/611

[58] Field of Search ..... 430/584, 503, 607, 611, 430/505, 567, 600

[56] References Cited

U.S. PATENT DOCUMENTS

| | | | |
|---|---|---|---|
| 4,618,570 | 10/1986 | Kadowaki et al. | 430/505 |
| 4,670,377 | 6/1987 | Mayoshi et al. | 430/584 |
| 4,734,358 | 3/1988 | Takada et al. | 430/550 |
| 4,849,324 | 7/1989 | Aida et al. | 430/445 |
| 4,863,846 | 7/1989 | Tanada et al. | 430/611 |
| 5,037,733 | 8/1991 | Goda | 430/584 |

FOREIGN PATENT DOCUMENTS

| | | |
|---|---|---|
| 244184 | 11/1987 | European Pat. Off. . |
| 0246624 | 11/1987 | European Pat. Off. . |
| 313021 | 4/1989 | European Pat. Off. . |
| 313022 | 4/1989 | European Pat. Off. . |
| 63-239449 | 10/1988 | Japan . |

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A silver halide color photographic material comprising on a reflective support at least three light-sensitive emulsion layers having different color sensitivities. At least one of the light-sensitive emulsion layers comprises a silver halide emulsion spectrally sensitized with at least one compound represented by the formula (I) in a red sensitive layer. At least one of the light-sensitive emulsion layers or light-insensitive layers comprises on the support at least one compound represented by the formula (II), (III) or (IV). The total amount of silver halide emulsion on the support is 0.65 g/m$^2$ or less as calculated in terms of coated amount of silver. The formulas are shown and defined in the specification.

13 Claims, No Drawings

SILVER HALIDE COLOR PHOTOGRAPHIC MATERIAL

This is a continuation of application No. 07/430,538 filed Nov. 1, 1989, now abandoned.

FIELD OF THE INVENTION

The present invention relates to a silver halide color photographic material. More particularly, the present invention relates to a silver halide color photographic material for prints which is excellent in stability during the preparation and storage thereof and in the edge whiteness and is less subject to fluctuations in the properties due to the temperature fluctuations upon exposure.

BACKGROUND OF THE INVENTION

In recent years, a higher efficiency and a higher productivity have been demanded for the processing of color photographic light-sensitive materials. This tendency is remarkable particularly for the production of color prints. In order to meet the demand for early delivery and win the price race, so-called color laboratories have been integrated into large-scale laboratories with a higher production efficiency or decentralized to small-scale laboratories that can meet the demand for early delivery. The two types of laboratories are opposite in form. However, the two types of laboratories are the same in that they have a strong demand for a higher printing yield. Since it has recently become difficult to train skilled operators, the stability of the properties of color print light-sensitive materials (hereinafter referred to as "color photographic material") to be used is an important factor that affects the printing yield. In particular, when the photographic properties fluctuate between lots of production of color photographic papers or during the storage of color photographic papers in the laboratories, the printing conditions have to be reset. Thus, high efficiency cannot be attained in the production.

On the other hand, the inventors have found that the temperature fluctuation upon exposure is another great factor that causes a fluctuation in the properties of color photographic papers. When the sensitivity or other properties fluctuate due to the temperature fluctuation upon exposure, it causes trouble. For example, when the temperature upon exposure rises due to heat from a lamp or the like during printing, the print density or color balance changes if the printing conditions are left set at the initial values, making it impossible to obtain excellent prints. Therefore, a high production efficiency cannot be obtained with light-sensitive materials having a great temperature dependence upon exposure.

Besides, the stability of the photographic properties, the shortening of print processing time has been desired to meet the demand for early delivery.

In order to speed up development processing, silver bromide, silver bromochloride and silver chloride emulsions substantially free of silver iodide have been used as silver halide emulsions to be incorporated in color photographic papers. It has been known that the higher the silver chloride content is of a silver halide emulsion, the higher is the development rate and the more advantageous it becomes in rapid processing. However, it has also been known that the higher the silver chloride content is, the easier the silver halide emulsion is subjected to fog and the harder it is to obtain a high sensitivity. It has been reported that various compounds called photographic stabilizers can be effectively used to eliminate these disadvantages. In particular, JP-A-62-269957 (the term "JP-A" as used herein means an "unexamined published Japanese patent application") corresponding to European Patent 0,246,624 describes that the mercapto compounds represented by the general formula (II), (III) or (IV) disclosed later in the present specification can be advantageously used to improve the effect of inhibiting fog of a silver halide emulsion having a high silver halide content.

On the other hand, it also has been known that as the silver chloride content increases, the adsorptivity of a spectral sensitizing dye decreases. This is another factor that accelerates the fluctuation in properties during the preparation or storage of color photographic papers. In particular, a pentamethine-cyanine dye commonly used for the purpose of spectrally sensitizing color photographic papers in the red light region is disadvantageous in that the adsorptivity of a coating solution prepared in the production fluctuates with time, resulting in a change of photographic sensitivity or in fluctuation in the sensitivity during extended storage. It has been made clear that the mercapto compounds of the general formula (II), (III) or (IV) accelerate the sensitivity change (particularly desensitization) due to ageing of the coating solution.

Processes have already been known for reducing the sensitivity fluctuation due to ageing of a coating solution comprising a red-sensitive spectral sensitizing dye. For example, examples of spectral sensitizing dyes which are insasceptible to a drop in sensitivity with time are disclosed in JP-A-59-166955. However it has been made clear that even these spectral sensitizing dyes leave much to be desired. In particular, when a mercapto compound such as that of the general formula (II), (III) or (IV) of the present invention is used, these spectral sensitizing dyes cannot sufficiently exhibit their effects. In addition, it has also been made clear that these spectral sensitizing dyes leave much to be desired in the reduction of the sensitivity fluctuation during the storage of the products or the sensitivity change with the temperature change upon exposure. It has further been made clear that these disadvantages become more remarkable as the silver chloride content of the silver halide emulsion increases.

Furthermore, U.S. Pat. No. 4,513,081 discloses another spectral sensitizing dye which can reduce desensitization caused by the ageing of a coating solution. However, this dye, too, leaves much to be desired in the reduction in the sensitivity change during the storage of the product or due to the temperature change upon exposure.

The inventors made a study to overcome these problems. As a result, the inventors found a group of compounds represented by the general formula (I), described later, as spectral sensitizing dyes which are excellent in their stability of the coating solution with time and their stability of the photographic properties during storage of the product and which are less subject to temperature dependence upon exposure. However, as a result of a practical test on a light-sensitive material comprising these sensitizing dyes, it has been made clear that these spectral sensitizing dyes have a serious problem. In particular, the edge portion produced by cutting of the light-sensitive material colors undesirably upon development. Such an undesirable coloring drastically impairs the quality of color prints particularly with a white edge. Such a product cannot be offered to the market.

It has therefore been keenly desired to provide a silver halide photographic material which is suited to improve the productivity of color prints, capable of being processed rapidly, and excellent in stability of photographic properties and edge whiteness.

SUMMARY OF THE INVENTION

It is therefore an object of the present invention to provide a silver halide color photographic material which is capable of being rapidly processed, excellent in stability during preparation and during storage and in edge whiteness and less subject to the fluctuation in the properties due to the temperature upon exposure.

The above and other objects of the present invention will become more apparent from the following detailed description and examples.

These objects of the present invention are accomplished with a silver halide color photographic material comprising on a reflective support at least three light-sensitive emulsion layers having different color sensitivities, wherein at least one of said light-sensitive emulsion layers comprises a silver halide emulsion spectrally sensitized with at least one compound represented by the general formula (I), that at least one of said light-sensitive emulsion layers or light-insensitive layers contains at least one compound represented by the general formulae (II), (III) and (IV) and that the total amount of silver halide emulsion on said support is in the range of 0.65 g/m$^2$ or less as calculated in terms of coated amount of silver;

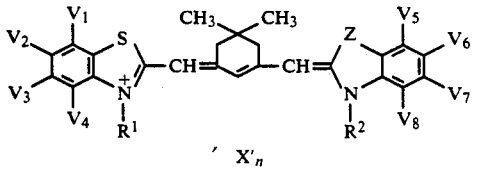

(I)

In the general formula (I), Z represents an oxygen atom or sulfur atom.

$R_1$ and $R_2$ each represent a substituted or unsubstituted alkyl group.

$V_1$, $V_2$, $V_3$, $V_4$, $V_5$, $V_6$, $V_7$ and $V_8$ each represents a hydrogen atom, halogen atom, alkyl group, acyl group, acyloxy group, alkoxycarbonyl group, carbamoyl group, sulfamoyl group, carboxyl group, cyano group, hydroxyl group, amino group, acylamino group, alkoxy group, alkylthio group, alkylsulfonyl group, sulfonic acid group or aryl group, provided that two of $V_1$ to $V_8$ which are bonded to adjacent carbon atoms do not together form a condensed ring and assuming that the Hammett's value $\sigma p$ of each of $V_1$ to $V_8$ is $\sigma pi$ (i=1 to 8) and $Y=\sigma p1+\sigma p2+\sigma p3+\sigma p4+\sigma p5+\sigma p6+\sigma p7+\sigma p8$, then $Y \leqq -0.08$ if Z is an oxygen atom or $Y \leqq -0.15$ if Z is a sulfur atom.

X' represents a charge balance paired ion. The suffix n represents a value required to neutralize the electric charge.

Examples of the alkyl group, alkyl residue (moiety), carbamoyl group, sulfamoyl group, amino group, aryl group and aryl residue described above and later include those which are further substituted.

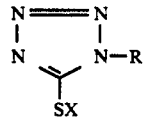

(II)

wherein R represents an alkyl group, alkenyl group or aryl group; and X represents a hydrogen atom, alkali metal atom such as sodium or potassium, ammonium group such as tetramethylammonium group or trimethylbenzylammonium group or a precursor for which dissociates under an alkaline condition to provide a —SH form, which includes —S.alkaline metal salt, and —S.ammonium salt, and the precursor preferably represents acetyl group, cyanoethyl group or methanesulfonylethyl.

The carbon numbers of the alkyl group and the alkenyl group are not limited, but preferably 8 or less including carbon numbers of substituents therefor.

The carbon numbers of the aryl group are not also limited, but preferably 20 or less including carbon numbers of substituents on phenyl group. More preferable aryl group represented by R is a phenyl group.

Examples of the alkyl group and alkenyl group represented by R include substituted, unsubstituted and alicyclic alkyl and alkenyl groups. Examples of substituents for such a substituted alkyl group include a halogen atom, a nitro group, a cyano group, a hydroxyl group, an alkoxy group, an aryl group, an acylamino group, an alkoxycarbonylamino group, an ureido group, an amino group, a heterocyclic group, an acyl group, a sulfamoyl group, a sulfonamido group, a thioureido group, a carbamoyl group, an alkylthio group, an arylthio group, a heterocyclic thio group, a carboxylic acid group, a sulfonic acid group, and salts thereof.

Examples of these ureide, thioureido, sulfamoyl, carbamoyl and amino groups include unsubstituted, N-alkyl-substituted and N-aryl-substituted groups.

Examples of the above described aryl group include a phenyl group and a substituted phenyl group. Examples of substituents for the substituted phenyl group include an alkyl group and substituents described with reference to the substituted alkyl group.

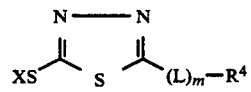

(III)

wherein L represents a divalent connecting group; $R_4$ represents a hydrogen atom, an alkyl or an alkenyl group as defined for the general formula (II) or aryl group as defined for the general formula (II); X is as defined for the general formula (II); and m represents 0 or 1.

Specific examples of the divalent connecting group represented by L include those shown below and combinations thereof:

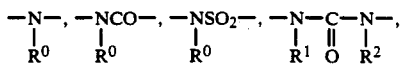

-continued

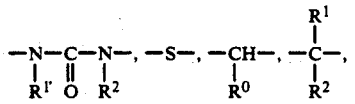

wherein $R^0$, $R^1$ and $R^2$ each represents a hydrogen atom, alkyl group as defined for the general formula (II) or aralkyl group, such as benzyl group, phenethyl group, etc.

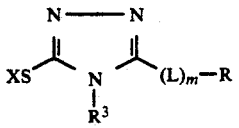

(IV)

wherein R and X are as defined for the general formula (II); L and m are as defined for the general formula (III); and $R^3$ has the same meaning as R. R and $R^3$ may be the same as different from each other.

DETAILED DESCRIPTION OF THE INVENTION

The general formula (I) will be further described hereinafter.

In the general formula (I), Z represents an oxygen atom or sulfur atom.

Preferred examples of the alkyl group represented by $R_1$ and $R_2$ include an unsubstituted alkyl group containing 18 or less carbon atoms (e.g., methyl, ethyl, propyl, butyl, pentyl, hexyl, heptyl, octyl, decyl, dodecyl, octadecyl), and a substituted alkyl group. Examples of substituents for the substituted alkyl group include a carboxyl group, a sulfo group, a cyano group, a halogen atom (e.g., fluorine, chlorine, bromine), a hydroxyl group, an alkoxycarbonyl group containing 8 or less carbon atoms (e.g., methoxycarbonyl group, ethoxycarbonyl group, phenoxycarbonyl group, benzyloxycarbonyl group), an alkoxy group containing 8 or less carbon atoms (e.g., methoxy, ethoxy, benzyloxyphenethyl), a monocyclic aryloxy group containing 15 or less carbon atoms (e.g., phenoxy, p-tolyloxy), an acyloxy group containing 8 or less carbon atoms (e.g., acetyloxy, propionyloxy), acyl group containing 8 or less carbon atoms (e.g., acetyl, propionyl, benzoyl), carbamoyl group (e.g., carbamoyl, N,N-dimethylcarbamoyl, morpholinocarbonyl, piperidinocarbonyl), sulfamoyl group (e.g., sulfamoyl, N,N-dimethylsulfamoyl, morpholinosulfonyl, piperidinosulfonyl), and alkyl group containing 18 or less carbon atoms substituted by an aryl group containing 15 or less carbon atoms (e.g., phenyl, 4-chlorophenyl, 4-methylphenyl, α-naphthyl) or the like.

Further preferred examples of the alkyl group represented by $R_1$ and $R_2$ include an unsubstituted alkyl group (e.g., methyl, ethyl, propyl, butyl, pentyl, hexyl, heptyl, octyl) and a sulfoalkyl group (e.g., 2-sulfoethyl, 3-sulfopropyl, 4-sulfobutyl).

Particularly preferred groups are those wherein at least one of $R_1$ and $R_2$ is an unsubstituted alkyl group having from 5 to 8 carbon atoms.

Preferred examples of groups represented by $V_1$, $V_2$, $V_3$, $V_4$, $V_5$, $V_6$, $V_7$ and $V_8$ include a hydrogen atom, a halogen atom (e.g., fluorine, chlorine, bromine), an unsubstituted alkyl group containing 10 or less carbon atoms (e.g., methyl, ethyl), a substituted alkyl group containing 18 or less carbon atoms (e.g., benzyl, α-naphthylmethyl, 2-phenylethyl, trifluoromethyl), an acyl group containing 8 or less carbon atoms (e.g., acetyl, benzoyl), an acyloxy group containing 8 or less carbon atoms (e.g., acetyloxy), an alkoxycarbonyl group containing 8 or less carbon atoms (e.g., methoxycarbonyl, ethoxycarbonyl, benzyloxycarbonyl), a carbamoyl group (e.g., carbamoyl, N,N-dimethylcarbamoyl, morpholinocarbonyl, piperidinocarbonyl), a sulfamoyl group (e.g., sulfamoyl, N,N-dimethylsulfamoyl, morpholinosulfonyl, piperidinosulfonyl), a carboxyl group, a cyano group, a hydroxyl group, an amino group, an acylamino group containing 8 or less carbon atoms (e.g., acetylamino), an alkoxy group containing 10 or less carbon atoms (e.g., methoxy, ethoxy, benzyloxy), an alkylthio group containing 10 or less carbon atoms (e.g., ethylthio), an alkylsulfonyl group containing 5 or less carbon atoms (e.g., methylsulfonyl), a sulfonic acid group, and an aryl group containing 15 or less carbon atoms (e.g., phenyl, tolyl), excluding that all of $V_1$ to $V_8$ are a hydrogen atom simultaneously.

Particularly preferred among these groups are a hydrogen atom, an unsubstituted alkyl group (e.g., methyl), and an alkoxy group (e.g., methoxy).

Two of $V_1$ to $V_8$ which are bonded to adjacent carbon atoms do not together form a condensed ring. Assuming that the Hammett's value σp of each of $V_1$ to $V_8$ is σpi (i=1 to 8) and $Y=\sigma p1+\sigma p2+\sigma p3+r\sigma p4+\sigma p5+\sigma p6+\sigma p7+\sigma p8$, then $Y \leqq -0.08$ if Z is an oxygen atom or $Y \leqq -0.15$ if Z is a sulfur atom. Y preferably satisfies the relationship $Y \leqq -0.15$ if Z is an oxygen atom or $Y \leqq -0.30$ if Z is a sulfur atom. In particular, Y preferably satisfies the relationship $-0.90 \leqq Y \leqq -0.17$ if Z is an oxygen atom or $-1.05 \leqq Y \leqq -0.34$ if Z is a sulfur atom.

The Hammett's value σp represents a value set forth in Kozo Kassei Sokan Konwakai, "Domain of Chemistry", No. 122 (extra edition)("The relationship between structure and activity of medicine"), p 96 to 103, Nankodo, and Corwin Hansch and Albert Leo, "Substituent Constants for Correlation Analysis in Chemistry and Biology", p 69 to 161, John Wiley and Sons. The process for the measurement of σp is described in e.g., "Chemical Reviews", Vol. 17, p 125 to 136, 1935.

In such a measurement process, the value of σp is 0 for a hydrogen atom, −0.17 for a methyl group and −0 27 for a methoxy group.

X'n is required to neutralize the ion charge of the dye. X'n is contained in the formula to indicate the presence or absence of a cation or an anion. Therefore, n takes a suitable value of 0 or more.

Typical examples of cations include inorganic and organic ammonium ions and alkali metal ions. Specific examples of inorganic or organic anions include a halogen ion (e.g., fluoride ion, chloride ion, bromide ion, iodide ion), a substituted arylsulfonic acid ion (e.g., p-toluenesulfonic acid ion, p-chlorobenzenesulfonic acid ion), an aryldisulfonic acid ion (e.g., 1,3-benzenedisulfonic acid ion, 1,5-naphthalenedisulfonic acid ion, 2,6-naphthalenedisulfonic acid ion), an alkylsulfuric acid ion (e.g., methylsulfuric acid ion), a sulfuric acid ion, a thiocyanic acid ion, a perchloric acid ion, a tetrafluoroboric acid ion, a picric acid ion, an acetic acid ion, and a trifluoromethanesulfonic acid ion. Preferred among these ions is an iodide ion.

Specific examples of the present dyes represented by the general formula (I) will be set forth below, but the present invention should not be construed as being limited thereto.

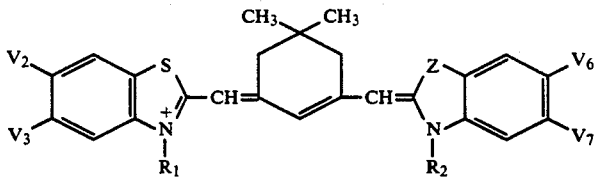

| Compound No. | $R_1$ | $R_2$ | $V_2$ | $V_3$ | $V_6$ | $V_7$ | X' | n |
|---|---|---|---|---|---|---|---|---|
| 1 | $(CH_2)_3CH_3$ | $C_2H_5$ | $CH_3$ | H | $CH_3$ | H | $I^-$ | 1 |
| 2 | $(CH_2)_4CH_3$ | $C_2H_5$ | $CH_3$ | H | $CH_3$ | H | $I^-$ | 1 |
| 3 | $(CH_2)_5CH_3$ | $C_2H_5$ | $CH_3$ | H | $CH_3$ | H | $I^-$ | 1 |
| 4 | $(CH_2)_6CH_3$ | $C_2H_5$ | $CH_3$ | H | $CH_3$ | H | $I^-$ | 1 |
| 5 | $(CH_2)_7CH_3$ | $C_2H_5$ | $CH_3$ | H | $CH_3$ | H | $I^-$ | 1 |
| 6 | $(CH_2)_4CH_3$ | $C_2H_5$ | $CH_3$ | H | $CH_3$ | H | $I^-$ | 1 |
| 7 | $(CH_2)_3CH_3$ | 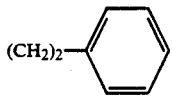 | $CH_3$ | $CH_3$ | $CH_3$ | H | $I^-$ | 1 |
| 8 | 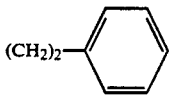 | $C_2H_5$ | $CH_3$ | $CH_3$ | H | H | $I^-$ | 1 |
| 9 | $(CH_2)_4CH_3$ | $C_2H_5$ | H | H | $CH_3$ | $CH_3$ | $I^-$ | 1 |
| 10 | $(CH_2)_4CH_3$ | $(CH_2)_4CH_3$ | $CH_3$ | H | $CH_3$ | H | $I^-$ | 1 |
| 11 | $(CH_2)_4CH_3$ | $C_2H_5$ | $OCH_3$ | H | $OCH_3$ | H | $Br^-$ | 1 |
| 12 | $(CH_2)_4CH_3$ | $C_2H_5$ | $OCH_3$ | $OCH_3$ | H | H | $Cl^-$ | 1 |
| 13 | $(CH_2)_4CH_3$ | $(CH_2)_3SO_3^-$ | $OCH_3$ | H | $OCH_3$ | H | — | — |
| 14 | $(CH_2)_3CH_3$ | $(CH_2)_4SO_3^-$ | $OCH_3$ | H | $OCH_3$ | H | — | — |
| 15 | $(CH_2)_4CH_3$ | $CH_2CO_2H$ | $CH_3$ | H | $CH_3$ | H | 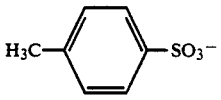 | 1 |
| 16 | $(CH_2)_4CH_3$ | $(CH_2)_3SO_3^-$ | $CH_3$ | H | $CH_3$ | H | — | — |
| 17 | $(CH_2)_4CH_3$ | $(CH_2)_4SO_3^-$ | $CH_3$ | H | $CH_3$ | H | — | — |
| 18 | $(CH_2)_5CH_3$ | $(CH_2)_2SO_3^-$ | $CH_3$ | $CH_3$ | H | H | 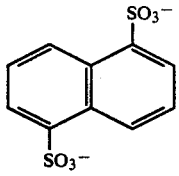 | ½ |
| 19 | $(CH_2)_3CH_3$ | $(CH_2)_2OCH_3$ | $CH_3$ | H | $CH_3$ | H | $I^-$ | 1 |
| 20 | $(CH_2)_4CH_3$ | $(CH_2)_2CN$ | H | $CH_3$ | H | $CH_3$ | $I^-$ | 1 |
| 21 | $(CH_2)_4CH_3$ | 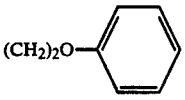 | H | $CH_3$ | H | $CH_3$ | $Br^-$ | 1 |

(22)

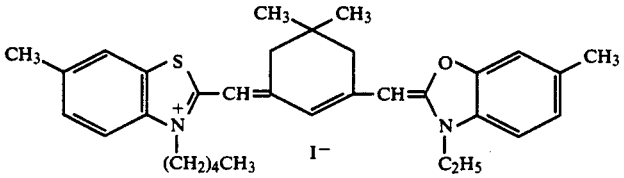

-continued

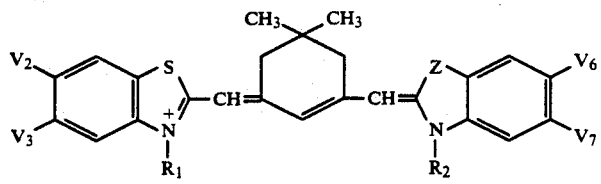

| Compound No. | $R_1$ | $R_2$ | $V_2$ | $V_3$ | $V_6$ | $V_7$ | X' | n |
|---|---|---|---|---|---|---|---|---|
| (23) | 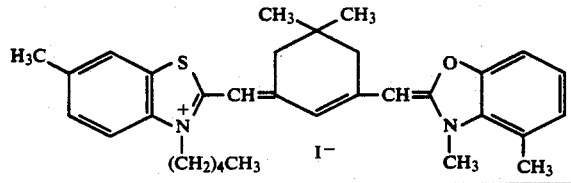 | | | | | | | |

The synthesis of the compound of the general formula (I) to be used in the present invention can be accomplished by any suitable method as described in F. M. Hamer, "Heterocyclic Compounds—Cyanine Dyes and Related Compounds", Chapter IX, p. 270 to 287, John Wiley & Sons, New York, London, 1946, and D. M. Sturmer, "Heterocyclic Compounds—Special Topics in Heterocyclic Chemistry", Chapter 8, Section 4, p 482 to 515, John Wiley & Sons, New York, London, 1977.

The incorporation of the present compound of the general formula (I) in the silver halide emulsion can be accomplished by any method known in the art. The present compound of the general formula (I) can be normally incorporated in the silver halide emulsion in the form of a solution in a water-soluble solvent such as methanol, ethanol, pyridine, methylcellosolve or acetone or a mixture thereof. The present compound of the general formula (I) can also be incorporated in the silver halide emulsion in the form of a solution in a mixture of such an organic solvent and water.

The present compound of the general formula (I) can be incorporated in the silver halide at any time during the preparation thereof, preferably during or after the chemical ripening of the emulsion or before or after the incorporation of a stabilizer and a fog inhibitor.

The amount of the present compound of the general formula (I) to be incorporated in the silver halide emulsion is not specifically limited but is normally in the range of about $1\times10^{-6}$ to about $1\times10^{-3}$, preferably about $1\times10^{-5}$ to about $5\times10^{-4}$ mol per mol of silver halide.

In the present invention, a supersensitizing agent can be used.

Such a supersensitizing agent is further described in "Photographic Science and Engineering", Vol. 13, p. 13 to 17 and Vol. 18, p 418 to 430, and James, "The Theory of The Photographic Process", 4th ed., p. 259, Macmilan, 1977. It has been known that a high sensitivity can be obtained by selecting a suitable sensitizing dye and a suitable supersensitizing dye.

In the present invention, any supersensitizing dye can be used. In particular, compounds represented by the general formula (V) are preferably used.

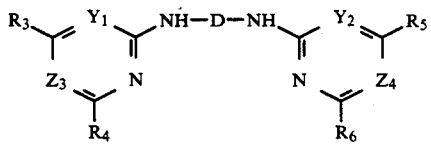

(V)

wherein D represents a divalent aromatic residue; and $R_3$, $R_4$, $R_5$ and $R_6$ each represents a hydrogen atom, a hydroxyl group, an alkoxy group, an aryloxy group, a halogen atom, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl $Y_1$ and $Z_3$ each represents —N= or —CH=. At least one of $Y_1$ and $Z_3$ is —N=.

$Y_2$ and $Z_4$ have the same meaning as $Y_1$ and $Z_3$, respectively.

The general formula (V) will be further described hereinafter.

D represents a divalent aromatic residue such as a single aromatic nucleus residue, a residue obtained by condensation of at least two aromatic nuclei, a residue obtained by connection of at least two aromatic nuclei to each other directly or via an atom or atomic group or residue containing a biphenyl, naphthylene, stilbene or bibenzyl skeleton. In particular, residues represented the following general formulae $D_1$ and $D_2$ are preferably used.

$D_1$;

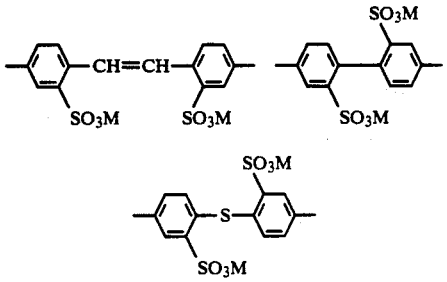

-continued

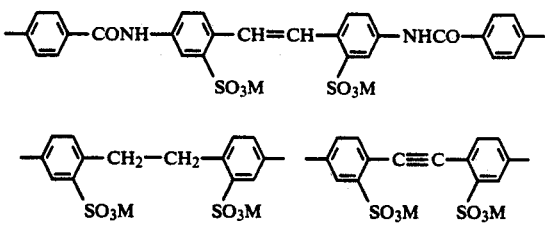

wherein M represents a hydrogen atom or a cation which gives water solubility such as an alkaline metal ion (e.g., Na, K) or ammonium ion.

$D_2$;

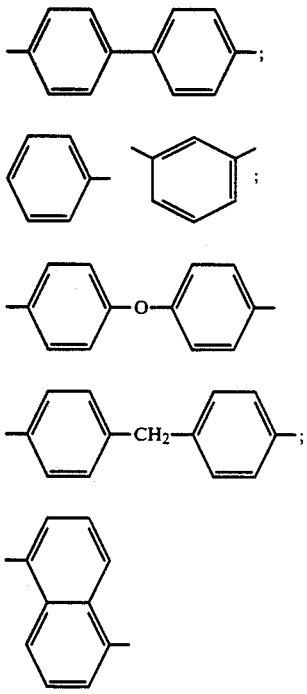

In the general formula $D_2$, at least one of $R_3$, $R_4$, $R_5$ and $R_6$ has a substituent containing $SO_3M$ in which M is as defined above.

$R_3$, $R_4$, $R_5$ and $R_6$ each represents a hydrogen atom, a hydroxyl group, an alkoxy group (e.g., methoxy, ethoxy), an aryloxy group (e.g., phenoxy, naphthoxy, p-methylphenoxy, p-sulfophenoxy), a halogen atom (e.g., chlorine, bromine), a heterocyclic group (e.g., morpholinyl, piperidyl), a mercapto group, an alkylthio group (e.g., methylthio, ethylthio), an arylthio group (e.g., phenylthio, tolylthio), a heterocyclylthio group (e.g., benzothiazoylthio, benzoimidazoylthio, phenyltetrazoylthio), an amino group, an alkylamino group (e.g., methylamino, ethylamino, propylamino, dimethylamino, diethylamino, dodecylamino, β-hydroxyethylamino, di-β-hydroxyethylamino, β-sulfoethylamino), a cyclohexylamino group, an arylamino group (e.g., anilino, o-sulfoanilino, m-sulfoanilino, p-sulfoanilino, o-chloroanilino, m-chloroanilino, p-chloroanilino, o-anisidino, m-anisidino, p-anisidino, o-toluidino, m-toluidino, p-toluidino, o-carboxyanilino, m-carboxyanilino, p-carboxyanilino, hydroxyanilino, sulfonaphthylamino, o-aminoanilino, m-aminoanilino, p-aminoanilino, o-acetamino-anilino), a heterocyclylamino group (e.g., 2-benzothiazolylamino, 2-pyridylamino), an aralkylamino group (e.g., benzylamino), or an aryl group (e.g., phenyl).

Particularly preferred among compounds represented by the general formula (V) are those wherein at least one of $R_3$ to $R_6$ is an aryloxy group, heterocyclylthio group or heterocyclylamino group.

Specific examples of compounds represented by the general formula (V) will be set forth below, but the present invention should not be construed as being limited thereto.

(V-1) Disodium 4,4'-bis[2,6-di(benzothiazolyl-2-thio)-pyrimidine-4-ylamino]stilbene-2,2'-di-sulfonate (V-2) Disodium 4,4'-bis[2,6-di(benzothiazolyl-2-amino) pyrimidine-4-ylamino]stilbene-2,2-disulfonate (V-3) Disodium 4,4'-bis[2,6-di(1-phenyltetrazolyl-5-thio)pyrimidine-4-ylamino]stilbene-2,2'-disulfonate (V-4) Disodium 4,4'-bis[2,6-di(benzoimidazolyl-2-thio)-pyrimidine-4-ylamino]stilbene-2,2'-disulfonate (V-5) Disodium 4,4'-bis[-chloro-6-(2-naphthyloxy)-pyrimidine-4-ylamino]biphenyl-2,2'-disulfonate (V-6) Disodium 4,4'-bis[2,6-di(naphthyl-2-oxy)pyrimidine-4-ylamino]stilbene-2,2'-disulfonate (V-7) Disodium 4,4'-bis[2,6-di(naphthyl-2-oxy)pyrimidine-4-ylamino]bibenzyl-2,2'-disulfonate (V-8) Disodium 4,4'-bis[2,6-diphenylthiopyrimidine-4-ylamino]stilbene-2,2'-disulfonate (V-9) Disodium 4,4'-bis[2,6-diphenylthiopyrimidine-4-ylamino]stilbene-2,2'-disulfonate (V-10) Disodium 4,4'-bis[2,6-dichloropyrimidine-4-ylamino]stilbene-2,2'-disulfonate (V-11) Disodium 4,4'-bis[2,6-dianilinopyrimidine-4-ylamino]stilbene-2,2'-disulfonate (V-12) Disodium 4,4'-bis[4,6-di(naphthyl-2-oxy)triazine-2-ylamino]stilbene-2,2'-disulfonate (V-13) Disodium 4,4'-bis[4,6-dianilinotriazine-2-ylamino]stilbene-2,2'-disulfonate (V-14) Disodium 4,4'-bis(2,6-dimercaptopyrimidine-4-ylamino)biphenyl-2,2'-disulfonate (V-15) Disodium 4,4'-bis[4,6-di(naphthyl-2-oxy)pyrimidine-2-ylamino]stilbene-2,2'-disulfonate (V-16) Disodium 4,4'-bis[4,6-di(benzothiazolyl-2-thio)-pyrimidine-2-ylamino]stilbene-2,2'-disulfonate (V-17) Disodium 4,4'-bis[4,6-di(1-phenyltetrazolyl-2-amino)pyrimidine-2-ylamino]stilbene-2,2'-disulfonate (V-18) Disodium 4,4'-bis[4,6-di(naphthyl-2-oxy)pyrimidine-2-ylamino]bibenzyl-2,2'-disulfonate The compound of the general formula (I) and the compound of the general formula (V) may be simultaneously or separately incorporated in the silver halide emulsion regardless of whichever is added first. Alternatively, the two compounds may be incorporated in the silver halide emulsion in the form of a solution mixture.

The amount of the compound (V) to be incorporated is in the range of about $1\times10^{-6}$ to about $1\times10^{-1}$ mol, preferably about $5\times10^{-5}$ to about $1\times10^{-2}$ mol per mol of silver halide. The molar ratio of the amount of the compound (I) to be incorporated to that of the compound (V) is preferably selected in the range of about 1/50 to about 10/1.

Specific examples of compounds represented by the general formulae (II), (III) and (IV) will be set forth below, but the present invention should not be construed as being limited thereto.

(II-1)
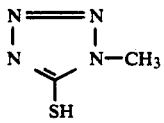
(II-2)
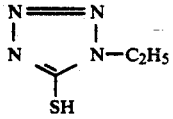
(II-3)
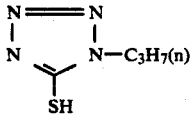
(II-4)
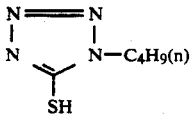
(II-5)
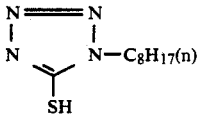
(II-6)
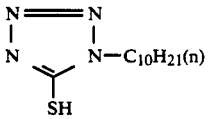
(II-7)
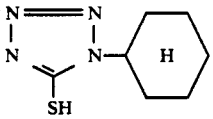
(II-8)
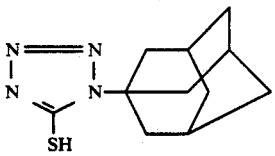
(II-9)
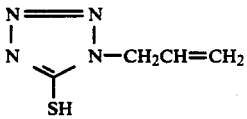
(II-10)
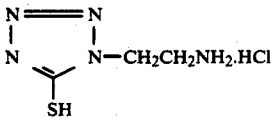
(II-11)
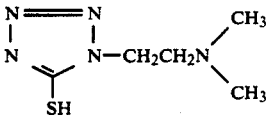
-continued
(II-12)
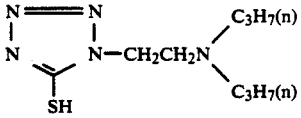
(II-13)
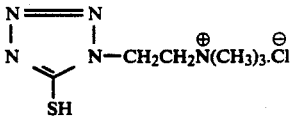
(II-14)
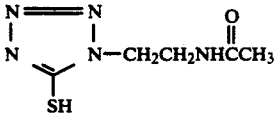
(II-15)
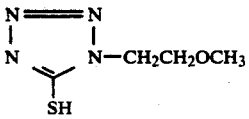
(II-16)
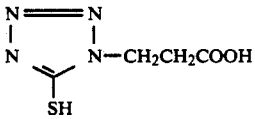
(II-17)
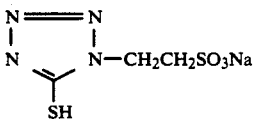
(II-18)
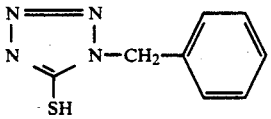
(II-19)
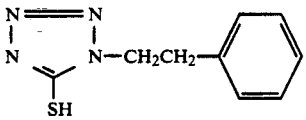
(II-20)
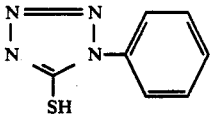
(II-21)
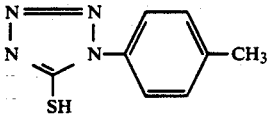
(II-22)
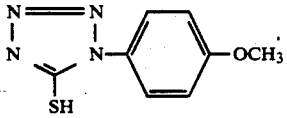
(II-23)
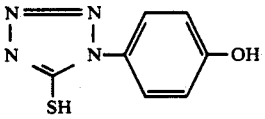

-continued
(II-24)
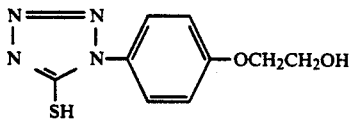
(II-25)
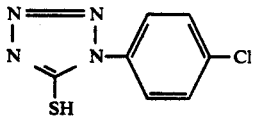
(II-26)
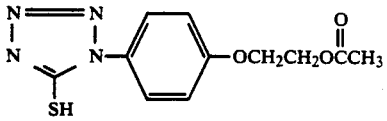
(II-27)
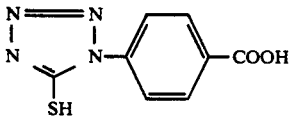
(II-28)
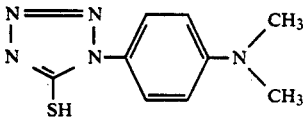
(II-29)
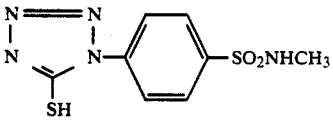
(II-30)
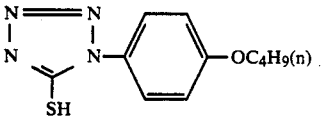
(II-31)
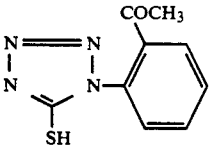
(II-32)
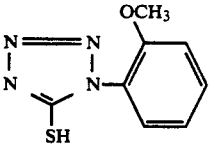
(II-33)
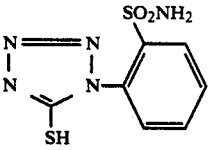
(II-34)
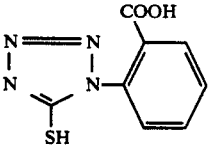
-continued
(II-35)
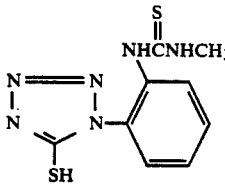
(II-36)
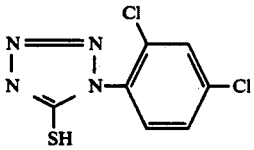
(II-37)
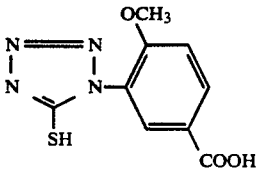
(II-38)
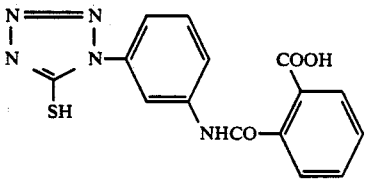
(II-39)
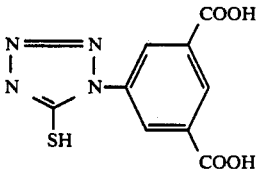
(II-40)
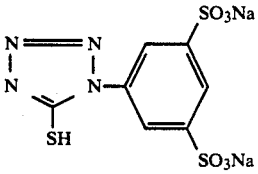
(II-41)
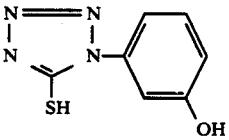
(II-42)
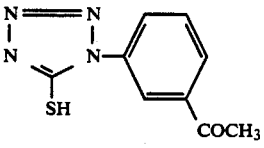
(II-43)
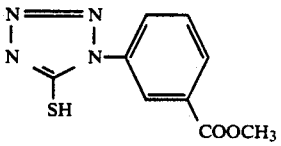

-continued
(II-44)
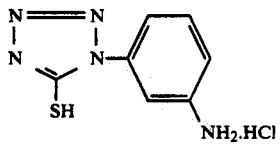
(II-45)
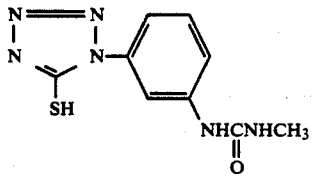
(II-46)
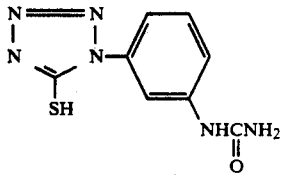
(II-47)
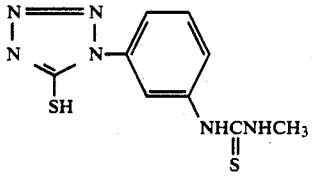
(II-48)
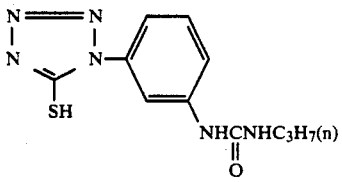
(II-49)
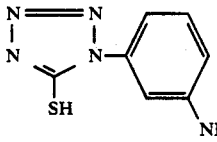
(II-50)
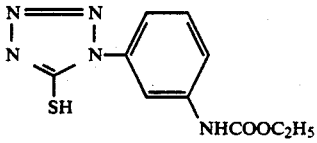
(II-51)
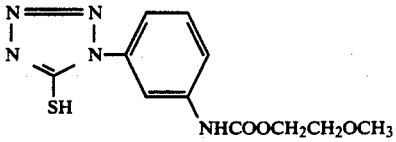
(II-52)
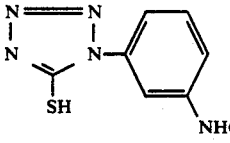
-continued
(II-53)
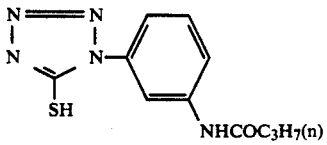
(II-54)
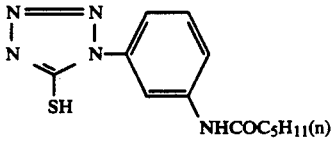
(II-55)
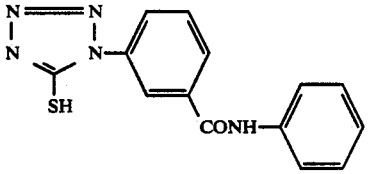
(II-56)
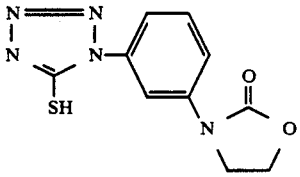
(II-57)
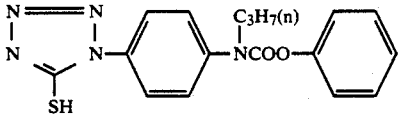
(II-58)
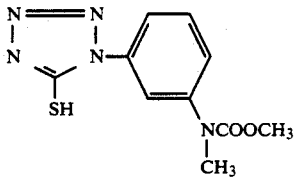
(II-59)
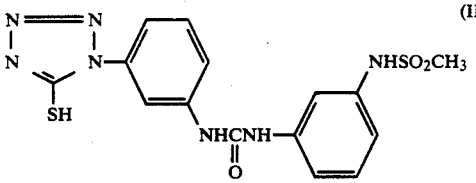
(II-60)
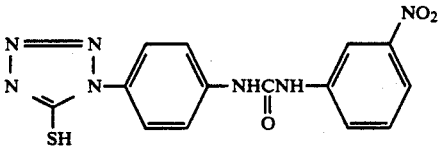
(II-61)
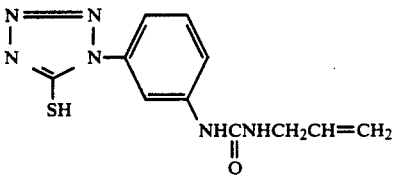

-continued
(II-62)
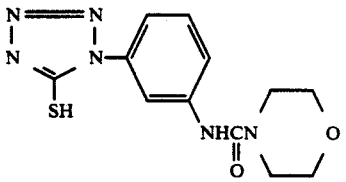
(II-63)
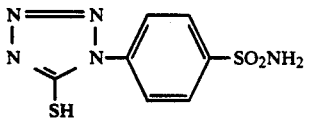
(II-64)
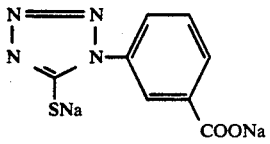
(II-65)
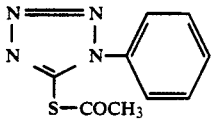
(II-66)
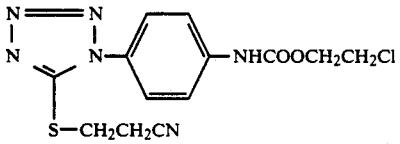
(II-67)
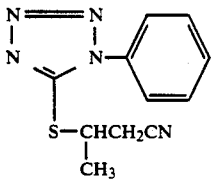
(II-68)
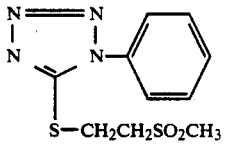
(II-69)
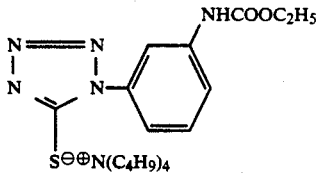
(II-70)
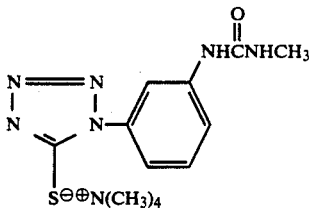
-continued
(II-71)
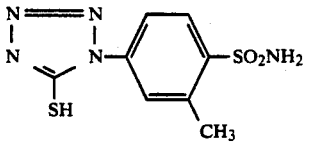
(II-72)
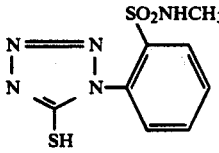
(III-1)
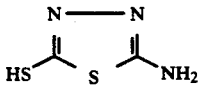
(III-2)
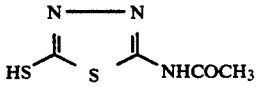
(III-3)
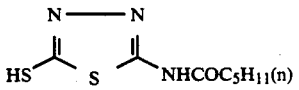
(III-4)
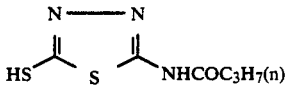
(III-5)
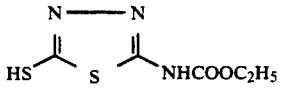
(III-6)
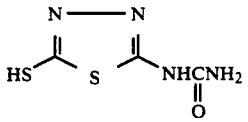
(III-7)
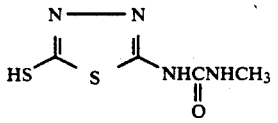
(III-8)
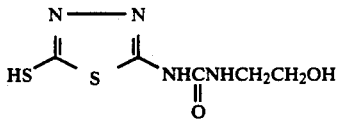
(III-9)
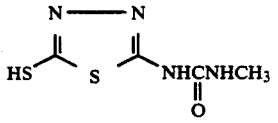
(III-10)
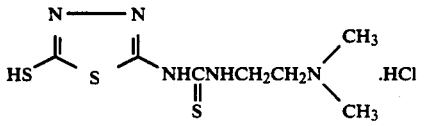
(III-11)
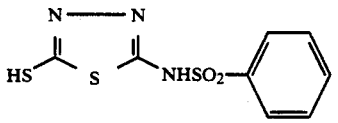

-continued
(III-12)
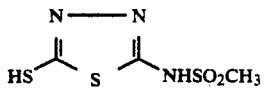
(III-13)
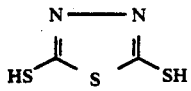
(III-14)
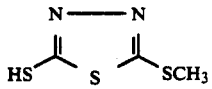
(III-15)
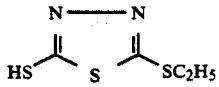
(III-16)
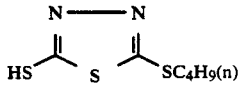
(III-17)
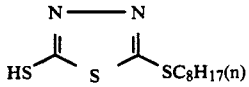
(III-18)
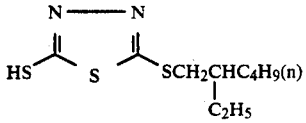
(III-19)
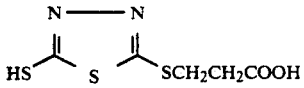
(III-20)
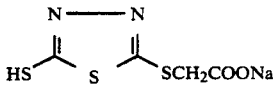
(III-21)
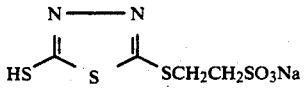
(III-22)
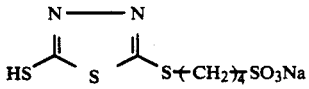
(III-23)
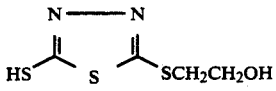
(III-24)
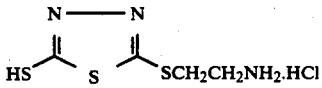
(III-25)
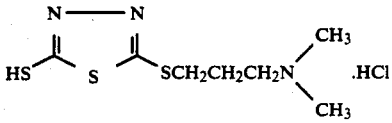
(III-26)
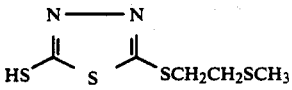
-continued
(III-27)
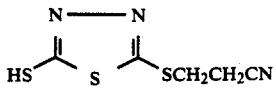
(III-28)
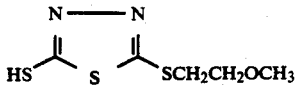
(III-29)
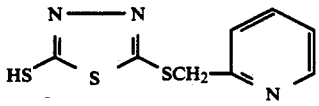
(III-30)
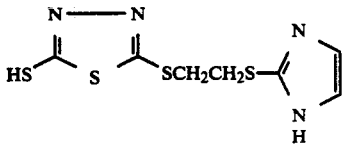
(III-31)
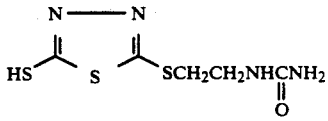
(III-32)
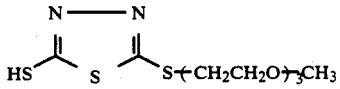
(III-33)
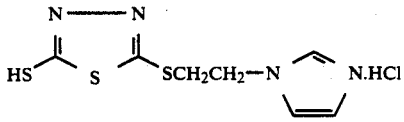
(III-34)
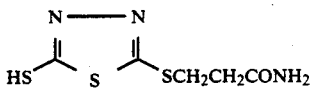
(III-35)
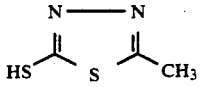
(III-36)
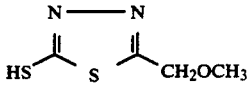
(III-37)
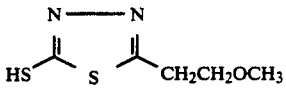
(III-38)
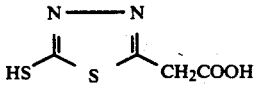
(III-39)
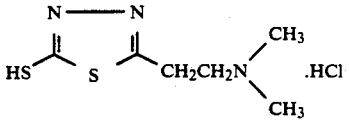

-continued
(III-40)
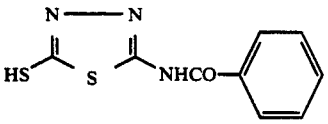
(III-41)
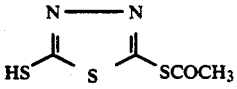
(III-42)
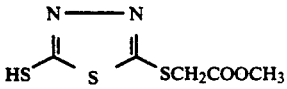
(III-43)
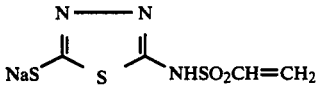
(III-44)
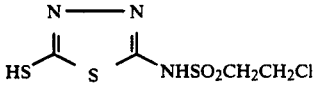
(III-45)
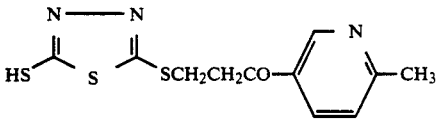
(III-46)
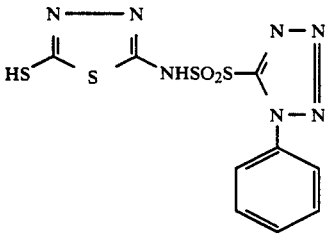
(III-47)
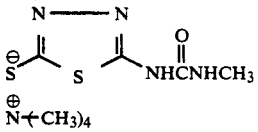
(III-48)
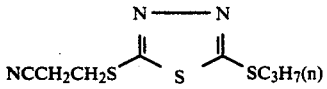
(IV-1)
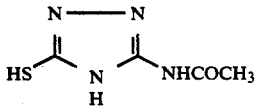
(IV-2)
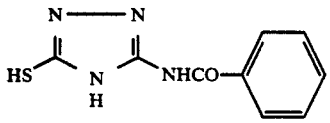
(IV-3)
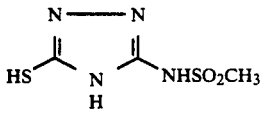
-continued
(IV-4)
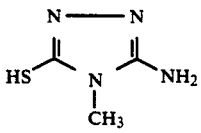
(IV-5)
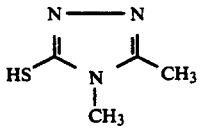
(IV-6)
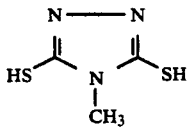
(IV-7)
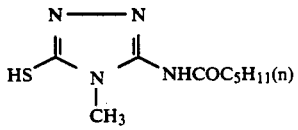
(IV-8)
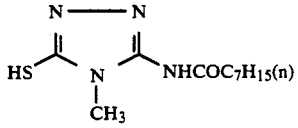
(IV-9)
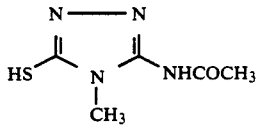
(IV-10)
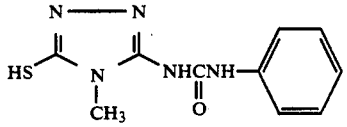
(IV-11)
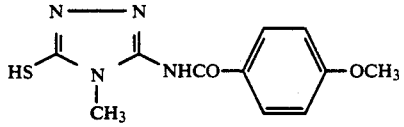
(IV-12)
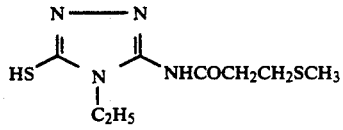
(IV-13)
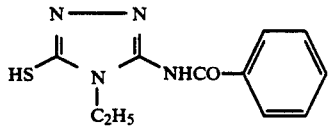
(IV-14)
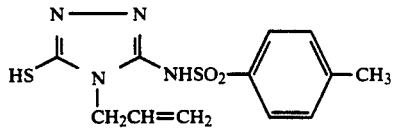

-continued
(IV-15)
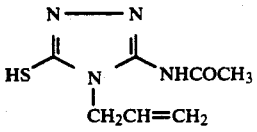
(IV-16)
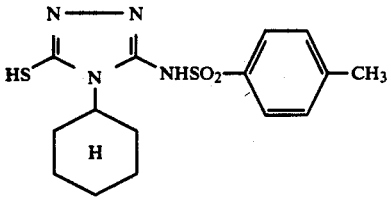
(IV-17)
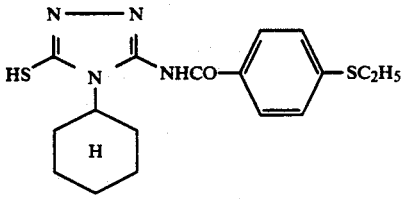
(IV-18)
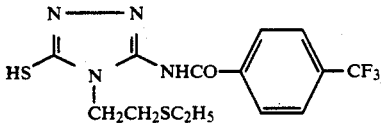
(IV-19)
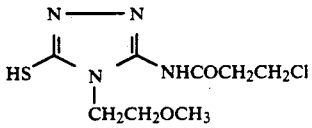
(IV-20)
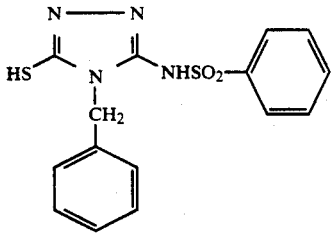
(IV-21)
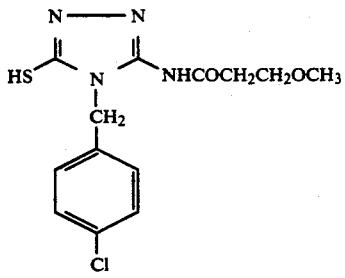
(IV-22)
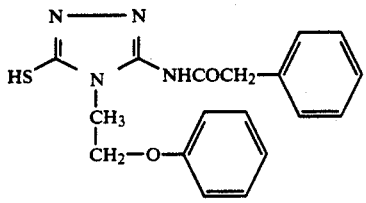
-continued
(IV-23)
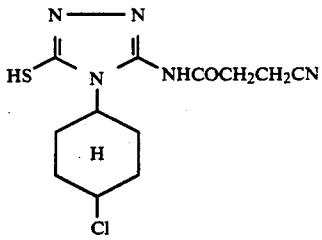
(IV-24)
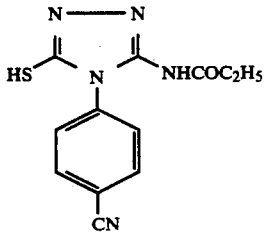
(IV-25)
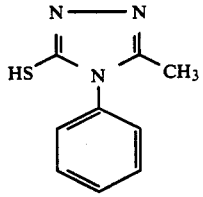
(IV-26)
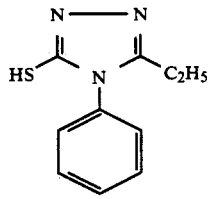
(IV-27)
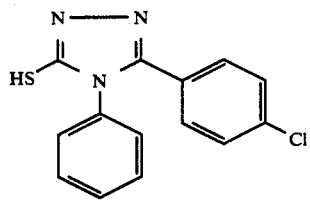
(IV-28)
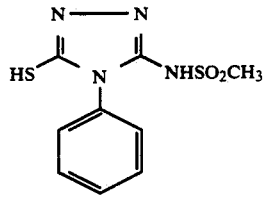
(IV-29)
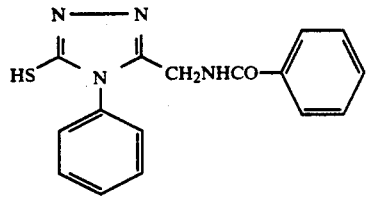

-continued (IV-30)

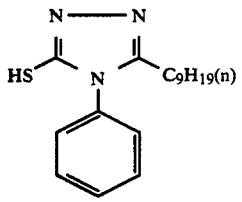

(IV-31)

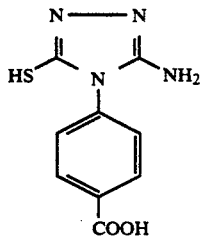

(IV-32)

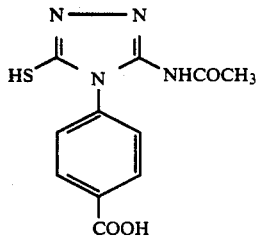

(IV-33)

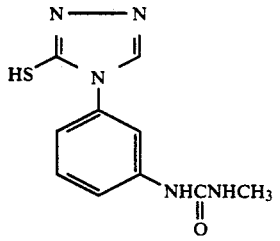

(IV-34)

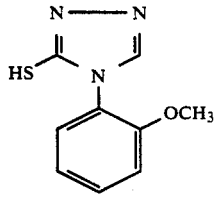

(IV-35)

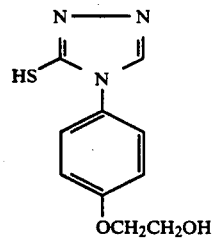

(IV-36)

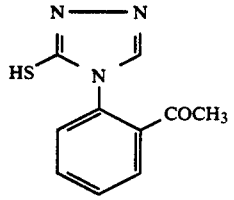

-continued (IV-37)

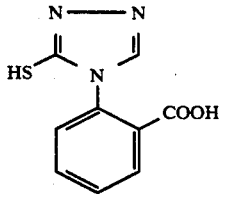

(IV-38)

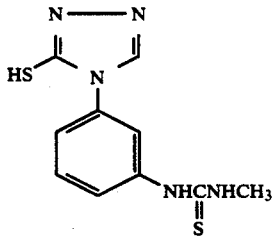

(IV-39)

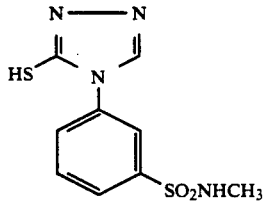

(IV-40)

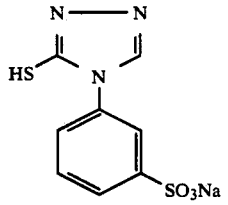

The synthesis of the compounds of the general formulae (II), (III) and (IV) to be used in the present invention can be accomplished by any suitable methods as described in *Berichte der Deutschen Chemischen Gesellschaft,* 29, 2483 (1896), JP-A-55-59463, *J.Heterocyclic Chem.,* 2, 105 (1965), *J.Org. Chem.,* 32, 2245 (1967), *Chem. Commun,* 1222 (1971), *Tetrahedron Lett.,* 2939 (1972), JP-A-57-150842, JP-A-87322, etc.

The compounds represented by the general formula (II), (III) or (IV) to be used in the present invention may be incorporated in at least one of light-sensitive emulsion layers or light-insensitive emulsion layers constituting the silver halide color photographic material. The amount of such a compound to be incorporated is preferably in the range of about $1.0\times10^{-5}$ to about $5.0\times10^{-2}$ mol, particularly about $1.0\times1^{-4}$ to about $1.0\times10^{-2}$ mol per mole of silver halide.

When the compounds of the formula (II), (III) or (IV) are incorporated into the light-sensitive layer, the term "per mole of silver halide" means "per mol of total silver halide in the photographic material".

The incorporation of the compounds of the general formulae (II), (III) and (IV) in the silver halide emulsion layer or the light-insensitive layer can be accomplished by any methods in the art. The compounds can be normally incorporated in the silver halide emulsion by dissolving the compounds to water or water-soluble solvent such as alcohols, ethers, glycols, ketones, esters, amides, and then adding the solution thus obtained to an aqueous solution containing hydrophilic colloid such as gelatin.

Any hydrophilic colloidal layer, such as an intermediate layer, a protective layer, an ultraviolet absorbent layer, an antihalation layer, a filter layer may be used as a light-insensitive layer.

If the amount of the present compound to be incorporated is less than the above described range, the effect of inhibiting fog decreases. On the contrary, if the value exceeds this range, it is likely to cause a drop in the sensitivity or a drop in the density due to inhibition of development.

In the present invention, the total amount of silver halide emulsion coated on a support needs to be in the range of 0.65 $g/m^2$ or less as calculated in terms of coated amount of silver. If a light-insensitive emulsion is used besides a light-sensitive silver halide emulsion such as a blue-sensitive, green-sensitive or red-sensitive silver halide emulsion, it is also considered in determining the total amount of silver halide emulsion.

If the total amount of silver halide emulsion exceeds the above described range, the edge of the light-sensitive material produced by cutting causes an undesirable coloring upon development, deteriorating the edge whiteness. The lower limit of the total amount of silver halide emulsion is not specifically limited but can be selected so that the desired maximum color density can be obtained.

The color photographic light-sensitive material of the present invention can be formed by coating at least one blue-sensitive silver halide emulsion layer, one green-sensitive silver halide emulsion layer and one red-sensitive silver halide emulsion layer on a support. Commonly available color photographic papers are formed by coating these color-sensitive emulsion layers on a support in the order described above. Different orders can be used. In these light-sensitive emulsion layers, a silver halide emulsion having a sensitivity to the respective wavelength region and a so-called color coupler which forms a dye complementary to the light to which the respective emulsion is sensitive, i.e., yellow for blue, magenta for green and cyan for red are incorporated to enable a subtractive color reproduction. However, the light-sensitive layers and the color hue of couplers may not have such a correspondence.

As a suitable silver halide emulsion there can be preferably used a silver bromochloride or silver chloride emulsion substantially free of silver iodide. The term "emulsion substantially free of silver iodide" as used herein means an emulsion having a silver iodide content of 1 mol % or less, preferably 0.2 mol % or less. The halogen composition of the emulsion may be the same or different from grain to grain. If the halogen composition is the same from grain to grain, an emulsion which is homogeneous in properties from grain to grain can easily be obtained. In respect to the halogen composition distribution in the silver halide emulsion grain, a so-called uniform type grain having the same halogen composition from portion to portion, a so-called lamination type grain having different halogen compositions from core to shell or shells, or a grain having nonlayer portions with a different halogen composition from the other portion in the inside or surface thereof (portions with different compositions connected on the edge, corner or surface of the grains) can be properly selected. In order to obtain a high sensitivity, either one of the latter two types of grains can be more advantageously used than the uniform type grain in the light of pressure resistance. If the silver halide grain has such a structure, the border between portions having different halogen compositions may be clear, unclear (mixed crystal formed by difference in composition) or continuously changed in structure.

In respect to the halogen composition of these silver bromochloride emulsions, any silver bromide/silver cholride ratio can be used. This ratio can be in any wide range depending on the purpose or application of the color photographic material. An emulsion having a silver chloride proportion of 2% or more can be preferably used.

A light-sensitive material suited to rapid processing can preferably comprise a so-called high silver chloride content emulsion having a high silver chloride content. Such a high silver chloride content emulsion preferably has a silver chloride content of 90 mol % or more, particularly 95 mol % or more.

Such a high silver chloride content emulsion preferably has a localized silver bromide phase in the above described layer or nonlayer pattern in the inside or on the surface of the silver halide grain. The silver bromide content of the above described localized phase is preferably in the range of at least 10 mol %, particularly more than 20 mol %. Such a localized phase can be present in the inside of the grain or on the edge, corner or surface of the grain. In one preferred example, a localized phase is formed by an epitaxial growth on the edge portions of the grain.

On the contrary, in order to minimize the drop in sensitivity due to the application of pressure onto the light-sensitive material, a high silver chloride content emulsion having a silver chloride content of 90 mol % is used or more preferably the silver halide emulsion comprises uniform type grains having a small halogen composition distribution.

In order to reduce the replenishment rate of the developing solution, it is effective to further raise the silver chloride content of the silver halide emulsion. In this case, a substantially pure silver chloride emulsion having a silver chloride content of 98 to 100 mol % can be preferably used.

The mean grain size of silver halide grains contained in the silver halide emulsion to be used in the present invention (as determined by taking a number average of grain sizes calculated in terms of the diameter of a circle equivalent to the projected area of grain) is preferably in the range of 0.1 to 2 $\mu$m.

As to the grain size distribution, the emulsion is preferably a so-called monodispersant with a fluctuation coefficient (as determined by dividing the standard deviation of grain sizes by the mean grain size) of 20% or less, particularly 15% or less. In order to obtain a wide latitude, a blend of such monodispersant emulsions may be preferably incorporated in the same layer or such monodispersant emulsions may be preferably coated on a plurality of layers.

The silver halide grains in the photographic emulsions may be so-called regular grains having a regular crystal form, such as a cubic form, an octahedral form and a tetradecahedral form, or those having an irregular crystal form such as a spherical form and a tabular form, or those having a combination of these crystal forms. Mixtures of grains having various crystal forms may also be used. In the present invention, the grains may preferably comprise regular grains in a proportion of 50% or more, preferably 70% or more, particularly 90% or more.

Furthermore, an emulsion comprising tabular grains with an average aspect ratio (diameter of a circle equivalent to the projected area of a grain/thickness) of 5 or more, preferably 8 or more in a proportion of more than 50% calculated in terms of the projected area can be preferably used.

The silver bromochloride emulsion to be used in the present invention can be prepared according to the processes described in P. Glafkides, *Chemie et Physique Photographique,* Paul Montel (1967), G. F. Duffin, *Photographic Emulsion Chemistry,* Focal Press (1966), and V. L. Zelikman et al., *Making and Coating Photographic Emulsion,* Focal Press (1964). In some detail, the emulsion can be obtained by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, in which a pAg value of the liquid phase in which silver halide grains are formed is maintained constant, may also be used. According to the controlled double jet process, a silver halide emulsion having a regular crystal form and an almost uniform grain size can be obtained.

Various polyvalent metallic ion impurities can be incorporated in the silver halide emulsion to be used in the present invention during the formation or physical ripening of emulsion grains. Examples of such impurity compounds include salts of cadmium, zinc, lead, copper and thallium, and salts or complex salts of the group VIII elements such as iron, ruthenium, rhodium, palladium, osmium, iridium, and platinum. Particularly useful among these compounds are the group VIII elements. The amount of such a compound to be incorporated can be widely selected and is preferably in the range of about $10^{-9}$ to about $10^{-2}$ mol per mol of silver halide.

The silver halide emulsion to be used in the present invention is normally subjected to chemical sensitization and spectral sensitization.

As the chemical sensitization process there can be used a sulfur sensitization process using an unstable sulfur compound, a noble metal sensitization process such as a gold sensitization process, and a reduction sensitization process, alone or in combination. Examples of compounds which can be preferably used in the chemical sensitization process are described in JP-A-62-215272 (right lower column on p 18 to right upper column on p 22).

In the present invention, it is essential that the red-sensitive emulsion layer contain a silver halide emulsion spectrally sensitized with at least a compound represented by the general formula (I). The red-sensitive emulsion layer may comprise emulsions spectrally sensitized with sensitizing dyes other than the compound represented by the general formula (I). Alternatively, a compound represented by the general formula (I) and a compound other than the compound represented by the general formula (I) can be used in combination for spectral sensitization. However, if the proportion of the compound of the general formula (I) to be used is lowered, the effect of the present invention is reduced accordingly.

In the present invention, the emulsions to be used in layers other than the red-sensitive emulsion layer are subjected to spectral sensitization for the purpose of providing sensitivity in the respective desired wavelengths. In this case, too, a dye which absorbs light of a wavelength corresponding to the desired spectral sensitivity distribution is preferably used as a spectral sensitizing dye. As such spectral sensitizing dyes there can be used those described in F. H. Harmer, "Heterocyclic Compounds-Cyanine Dyes and Related Compounds" (John Wiley & Sons [New York, London], 1964). Specific examples of such compounds are described in the above cited JP-A-62-215272 (right upper column on p 22 to p 38).

Besides the compounds represented by the general formulae (II), (III) and (IV), various compounds or precursors thereof can be incorporated in the present light-sensitive material for the purpose of stabilizing the photographic properties. Specific examples of such compounds are described in the above cited JP-A-62-215272 (p 39 to 72).

The silver halide emulsion to be used in the present invention may be of the surface latent image type in which latent images are mainly formed on the surface of grains or the internal latent image type in which latent images are mainly formed inside grains.

Couplers to be used in the present invention will be described hereinafter. Various color couplers can be incorporated in the present light-sensitive material. The term "color coupler" as used herein means a compound which can undergo a coupling reaction with an oxidation product of an aromatic primary amine developing agent to form a dye. Specific examples of useful color couplers include naphtholic or phenolic compounds, pyrazolone or pyrazoloazole compounds and open-chain or heterocyclic ketomethylene compounds. Specific examples of these cyan, magenta and yellow couplers which can be used in the present invention are described in the patents cited in Research Disclosure No. 17643 (December 1978), VII-D and Research Disclosure No. 18717 (November 1979).

The color coupler to be used in the present invention may preferably contain a ballast group or is polymerized to exhibit nondiffusivity. Two-equivalent couplers substituted by an eliminatable group are more effective to reduce the coated amount of silver than four-equivalent couplers which contain a hydrogen atom in the coupling active position. Couplers which develop a dye having a proper diffusivity, colorless couplers, DIR couplers which undergo a coupling reaction to release a development inhibitor, or couplers which undergo a coupling reaction to release a development accelerator may be used in the present invention.

Typical examples of yellow couplers which may be used in the present invention include oil protect type acylacetamide couplers. Specific examples of such oil protect type acrylacetamide couplers are described in U.S. Pat. Nos. 2,407,210, 2,875,057, and 3,265,506. In the present invention, two-equivalent yellow couplers may preferably be used. Typical examples of such two equivalent yellow couplers include oxygen atom-releasing type yellow couplers as described in U.S. Pat. Nos. 3,408,194, 3,447,928, 3,933,501, and 4,022,620, and nitrogen atom-releasing type yellow couplers as described in JP-B-58-10739, U.S. Pat. Nos. 4,401,752, and 4,326,024, Research Disclosure No. 18053 (April 1979), British Patent No. 1,425,020, and West German Patent Application Disclosure Nos. 2,219,917, 2,261,361, 2,329,587, 2,433,812, JP-A-62-240965. α-Pivaloylacetanilide couplers are excellent in fastness of developed dye, particularly to light. On the other hand, α-benzoylacetanilide couplers can provide a high color density.

As a suitable magenta coupler for the present invention there may be used an oil protect type indazolone or cyanoacetyl, preferably a 5-pyrazolone coupler or pyrazoloazole coupler such as pyrazolotriazoles. As such a 5-pyrazolone coupler there may be preferably used a coupler which is substituted by an arylamino group or acylamino group in the 3-position in view of the hue of the developed dye or color density. Typical examples of such a coupler are described in U.S. Pat. Nos. 2,311,082, 2,343,703, 2,600,788, 2,908,573, 3,062,653, 3,152,896. Particularly preferred examples of elimination groups for such a two-equivalent 5-pyrazolone coupler include nitrogen atom-eliminatable groups as described in U.S. Pat. No. 4,310,619, and arylthio groups as described in U.S. Pat. No. 4,351,897 and WO(PCT)88/04795. 5-Pyrazolone coupler containing ballast groups as described in European Patent No. 73,636 can provide a high color density.

As suitable pyrazoloazole couplers there may be used pyrazolobenzimidazoles as described in U.S. Pat. No. 3,369,879, preferably pyrazolo[5,1-c][1,2,4]triazoles as described in U.S. Pat. No. 3,725,067, pyrazolotetrazoles as described in *Research Disclosure* No. 24220 (June 1984) and JP-A-60-33552, or pyrazolopyrazoles as described in *Research Disclosure* No. 24230 (June 1984) and JP-A-60-43659. Imidazo[1,2-b]pyrazoles as described in U.S. Pat. No. 4,500,630 corresponding to EP 119,741 may be preferably used because of their small subsidiary absorption of yellow light by developed dye and excellent fastness of developed dye to light. Pyrazolo[1,5-b][1,2,4]triazole as described in U.S. Pat. No. 4,540,654 corresponding EP 119,860 may particularly preferably be used in the present invention.

As a suitable cyan coupler for the present invention there may be used an oil protect type naphthol or phenol coupler. Typical examples of such a coupler include naphthol couplers as described in U.S. Pat. No. 2,474,293. Preferred examples of such a coupler include oxygen atom-releasing type two-equivalent naphthol couplers as described in U.S. Pat. Nos. 4,052,212, 4,146,396, 4,228,233, and 4,296,200. Specific examples of such a phenol coupler are described in U.S. Pat. Nos. 2,369,929, 2,801,171, 2,772,162, and 2,895,826. Cyan couplers which are fast to heat and moisture may be preferably used in the present invention. Typical examples of such cyan couplers include phenol cyan couplers containing an ethyl group or higher group in the meta-position of the phenol nucleus as described in U.S. Pat. No. 3,772,002, 2,5-diacylamino-substituted phenol couplers as described in U.S. Pat. Nos. 2,772,162, 3,758,308, 4,126,396, 4,334,011, and 4,327,173, West German Patent Disclosure (OPI) No. 3,329,729, and U.S. Pat. No. 4,500,635, and phenol couplers containing a phenylureide group in the 2-position and an acylamino group in the 5-position as described in U.S. Pat. Nos. 3,446,622, 4,333,999, 4,451,559, and 4,427,767.

Cyan couplers, magenta couplers and yellow couplers which can be used in the present invention are represented by the general formulae (VI), (VII), (VIII), (IX) and (X):

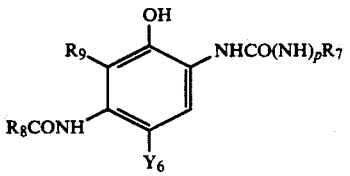

(VI)

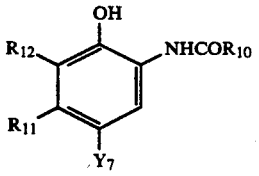

(VII)

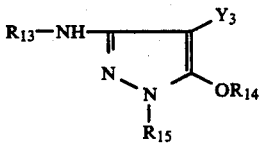

(VIII)

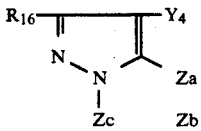

(IX)

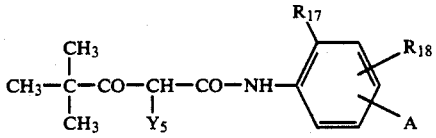

(X)

In the general formulae (VI) and (VII), $R_7$, $R_8$ and $R_{10}$ each represents a substituted or unsubstituted $C_{1-32}$ aliphatic, aryl or heterocyclic group. $R_9$, $R_{11}$ and $R_{12}$ each represents a hydrogen atom, a halogen atom, an aliphatic group, an aromatic group or an acylamino group. $R_9$ may represent a nonmetallic atom group which forms a nitrogen-containing 5- or 6-membered ring together with $R_8$. $Y_6$ and $Y_7$ each represents a hydrogen atom or a group capable of being eliminated upon a coupling reaction with an oxidation product of a developing agent. When $Y_6$ and $Y_7$ each represents a coupling-eliminatable group (hereinafter referred to as "eliminatable group"), said eliminatable group is a group which allows a coupling active carbon to be bonded to an aliphatic group, an aromatic group, a heterocyclic group, an aliphatic sulfonyl group, an aromatic sulfonyl group, a heterocyclic sulfonyl group, or an aliphatic carbonyl group, an aromatic carbonyl group or a heterocyclic carbonyl group via an oxygen, nitrogen, sulfur or carbon atom. The aliphatic, aromatic or heterocyclic groups contained in these eliminatable groups may be substituted by substituents allowable for $R_7$. When there are two or more such substituents, these substituents may be the same or different. These substituents may be further substituted by substituents allowable for $R_7$.

In the cyan coupler represented by the general formulae (VI) and (VII), examples of the $C_{1-32}$ aliphatic group represented by $R_7$, $R_8$ and $R_{10}$ include a methyl group, a butyl group, a tridecyl group, a cyclohexyl group, and an allyl group. Examples of the aryl group represented by $R_7$, $R_8$ and $R_{10}$ include a phenyl group and a naphthyl group. Examples of the heterocyclic group represented by $R_7$, $R_8$ and $R_{10}$ include a 2-pyridyl group, a 2-imidazolyl group, a 2-furyl group, and a 6-quinolyl group. These $C_1$–$C_{32}$ aliphatic, aryl and heterocyclic groups are substituted by groups selected from an alkyl group, an aryl group, a heterocyclic group, an alkoxy group (e.g., methoxy, 2-methoxyethoxy), an aryloxy group (e.g., 2,4-di-tert-amylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amide group (e.g., acetylamino, methanesulfonamide, dipropylsulfamoylamino), a carbamoyl group (e.g., dimethylcarbamoyl, ethylcarbamoyl), a sulfamoyl group (e.g., butylsulfamoyl), a imide group (e.g., succinimide, hydantoinyl), an ureido group (e.g., phenylureido, dimethylureido), an aliphatic or an aromatic sulfonyl group (e.g., methanesulfonyl, phenylsulfonyl), an aliphatic or an aromatic thio group (e.g., ethylthio, phenylthio), a hydroxy group, a cyano group, a carboxy group, a nitro group, a sulfo group, and a halogen atom.

In the general formula (VI), if $R_9$ and $R_{11}$ are substitutable substituents, they may be substituted by substitutable substituents described with reference to $R_7$.

In the general formula (VI), p represents an integer of 1 or 0. In the general formula (VII), $R_{11}$ is preferably an aliphatic group. Examples of such an aliphatic group include a methyl group, an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidemethyl group, and a methoxymethyl group.

In the general formulae (VI) and (VII), $Y_6$ and $Y_7$ each represents a hydrogen atom or a coupling-eliminatable group (hereinafter including coupling-eliminatable atom). Examples of such a coupling-eliminatable group and atom include a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy), an aryloxy group (e.g., 4-chlorophenoxy, 4-methoxyphenoxy, 4-carboxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloro acetylamino, heptafluorobutyrylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic or an aromatic thio group (e.g., ethylthio, phenylthio, tetrazolylthio), an imido group (e.g., succinimido, hydantoinyl), and an aromatic azo group (e.g., phenylazo). These eliminatable groups may contain a photographically useful group.

Preferred examples of cyan couplers represented by the general formula (VI) or (VII) will be described hereinafter.

In the general formula (VI), preferred examples of the group represented by $R_7$ include an aryl group and a heterocyclic group. Further preferred examples of such groups include an aryl group substituted by a halogen atom, an alkyl group, an alkoxy group, an aryloxy group, an acylamino group, an acyl group, a carbamoyl group, a sulfonamide group, a sulfamoyl group, a sulfonyl group, a sulfamide group, an oxycarbonyl group or a cyano group.

In the general formula (VI), if $R_9$ and $R_8$ do not together form a ring, $R_8$ preferably is a substituted or unsubstituted alkyl or aryl group, particularly a substituted aryloxy-substituted alkyl group, and $R_9$ preferably is a hydrogen atom.

In the general formula (VII), $R_{10}$ is preferably a substituted or unsubstituted alkyl or aryl group, particularly a substituted aryloxy-substituted alkyl group.

In the general formula (VII), preferred examples of the group represented by $R_{11}$ include a $C_{2-15}$ alkyl group and a methyl group containing substituents with one or more carbon atoms. Preferred examples of such substituents include an arylthio group, an alkylthio group, an acylamino group, an aryloxy group, and an alkyloxy group.

In the general formula (VII), a further preferred examples of the group represented by $R_{11}$ is a $C_{2-15}$ alkyl group, particularly a $C_{2-4}$ alkyl group.

In the general formula (VII), preferred examples of $R_{12}$ are a hydrogen atom and a halogen atom, particularly chlorine and fluorine. In the general formulae (VI) and (VII), $Y_6$ and $Y_7$ each is preferably a hydrogen atom, a halogen atom, an alkoxy group, an aryloxy group, an acyloxy group or a sulfonamide group.

In the general formula (VII), $Y_7$ is preferably a halogen atom, particularly a chlorine atom or a fluorine atom. In the general formula (VI), if p is 0, $Y_6$ is further preferably a halogen atom, particularly a chlorine atom or a fluorine atom.

In the general formula (VIII), $R_{13}$ and $R_{15}$ each represents an aryl group. $R_{14}$ represents a hydrogen atom, an aliphatic group or an aromatic acyl group, or an aliphatic or aromatic sulfonyl group. $Y_3$ represents a hydrogen atom or an eliminatable group. The substituents allowable in the aryl group represented by $R_{13}$ and $R_{15}$ (preferably a phenyl group) are the same as that allowable for the substituent $R_7$. If there are two or more substituents, they are the same or different. $R_{14}$ is preferably a hydrogen atom or an aliphatic acyl or Sulfonyl group, particularly a hydrogen atom. The eliminatable group represented by $Y_3$ is preferably of the type eliminatable by any of sulfur, oxygen and nitrogen atoms, particularly of the sulfur atom-eliminatable type.

In the general formula (IX), $R_{16}$ represents a hydrogen atom or a substituent, and $Y_4$ represents a hydrogen atom or an eliminatable group. Za, Zb and Zc each represents methine, substituted methine, =N— or —NH—. One of the Za-Zb bond and the Zb-Zc bond is a double bond and the other is a single bond. If the Zb-Zc bond is a carbon-carbon double bond, it may be a part of an aromatic ring. If $R_{16}$ or $Y_4$ forms a dimer or higher polymer and Za, Zb or Zc is a substituted methine, the substituted methine may form a dimer or higher polymer.

Among the couplers represented by the general formula (IX), preferred couplers are represented by the following general formulae (IXa), (IXb), (IXc), (IXd) and (IXe):

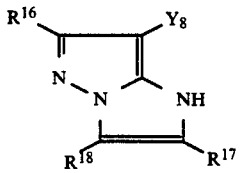

(IXa)

-continued (IXb)

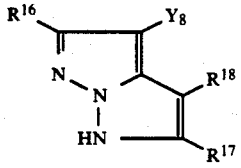

(IXc)

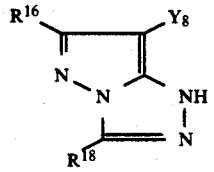

(IXd)

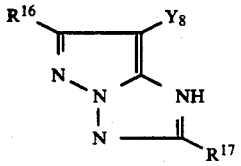

(IXe)

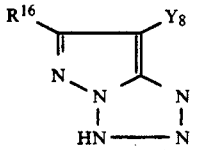

In the general formulae (IXa) to (IXe), $R^{16}$, $R^{17}$ and $R^{18}$ each represents an aliphatic group, aromatic group or heterocyclic group. These groups may be substituted by the substituents allowable with respect for $R_7$. $R^{16}$, $R^{17}$ and $R^{18}$ may also each represent $R^{19}O$—, $R^{19}\underset{\underset{O}{\|}}{C}$—, $R^{19}\underset{\underset{O}{\|}}{CO}$—, $R^{19}S$—, $R^{19}SO_2$—, $R^{19}SO_2NH$—, $R^{19}\underset{\underset{O}{\|}}{CNH}$—, $R^{19}NH$—, $R^{19}\underset{\underset{O}{\|}}{OCNH}$—, a hydrogen atom, a cyano group or an imide group (in which $R^{19}$ represents an alkyl group, an aryl group or a heterocyclic group). $R^{16}$, $R^{17}$ and $R^{18}$ may also each represent a carbamoyl group, a sulfamoyl group or an ureido group. The nitrogen atom in these groups may be substituted by the substituents allowable for $R_7$. Any Of $R^{16}$, $R^{17}$, $R^{18}$ and $Y_8$ may be a divalent group to form a dimer or may be a divalent group which connects a high molecular chain to a coupler chromophoric group.

$R^{16}$, $R^{17}$ and $R^{18}$ each is preferably a hydrogen atom, an aliphatic group, an aromatic group, a heterocyclic group, $R^{19}O$—, $R^{19}CONH$—, $R^{19}SO_2NH$—, $R^{19}NH$—, $R^{19}S$— or $R^{19}OCONH$—. $Y_8$ is preferably a halogen atom, an acylamino group, an imido group, an aliphatic or an aromatic sulfonamido group, a 5- or 6-membered nitrogen-containing heterocyclic group which is bonded to the coupling active position via a nitrogen atom, an aryloxy group, an alkoxy group, an arylthio group or an alkylthio group.

In the general formula (X), $R_{17}$ represents a halogen atom or an alkoxy group, and $R_{18}$ represents a hydrogen atom, a halogen atom or an alkoxy group. A represents —$NHCOR^{19}$, —$NHSO_2$—$R^{19}$, —$SO_2NHR_{19}$, —$COOR_{19}$ or $$-SO_2\underset{\underset{R^{20}}{|}}{N}-R_{13}$$

in which $R_{19}$ and $R_{20}$ each represents an alkyl group. $Y_5$ represents an eliminatable group. The substituents to be contained for $R_{18}$, $R_{19}$ and $R_{20}$ are the same as those allowable with respect to $R_7$. Preferred examples of substituents represented by $Y_5$ include those represented by the general formulae (Xa) to (Xg):

$$-OR_{21} \qquad \text{(Xa)}$$

wherein $R_{21}$ represents an aryl group or a heterocyclic group.

(Xb)

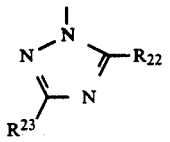

(Xc)

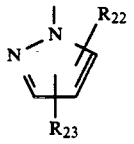

wherein $R_{22}$ and $R_{23}$ each represents a hydrogen atom, a halogen atom, a carboxylic ester group, an amino group, an alkyl group, an alkylthio group, an alkoxy group, an alkylsulfonyl group, an alkylsulfinyl group, a carboxylic acid group, a sulfonic acid group, a substituted or unsubstituted phenyl group or a heterocyclic group. $R_{21}$ and $R_{22}$ may be the same or different.

(Xd)

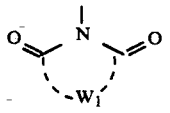

wherein $W_1$ represents a nonometallic atom group required for the formation of a 4-, 5- or 6-membered ring.

Preferred among groups represented by the general formula (Xd) are those represented by the following general formulae (Xe) to (Xg):

(Xe)

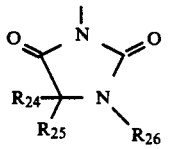

(Xf)

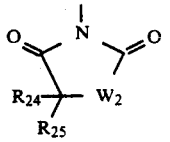

-continued (Xg)

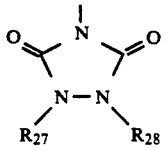

wherein $R_{24}$ and $R_{25}$ each represents a hydrogen atom, an alkyl group, an aryl group, an alkoxy group, an aryloxy group or a hydroxy group; $R_{26}$ and $R_{27}$ each represents a hydrogen atom, an alkyl group, an aryl group, an aralkyl group or an acyl group; and $W_2$ represents an oxygen atom or a sulfur atom.

Specific examples of these couplers are described in JP-A-63-11939. Further preferred examples of these couplers include the following compounds:

(C-1)

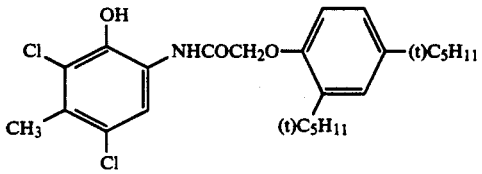

(C-2)

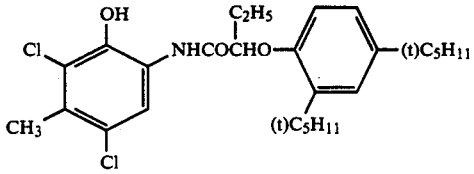

(C-3)

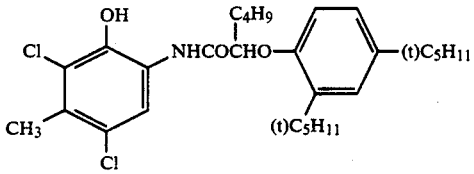

(C-4)

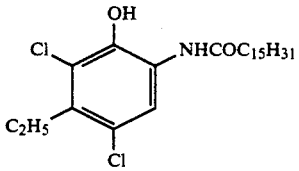

(C-5)

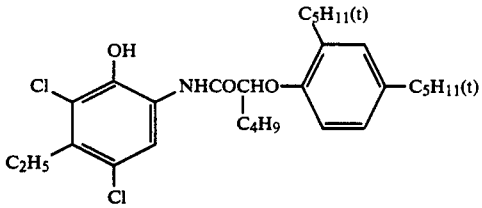

(C-6)

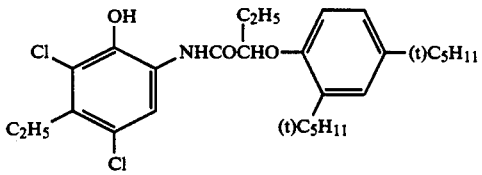

(C-7)

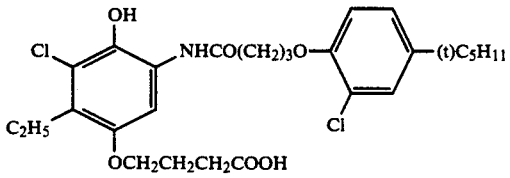

-continued
(C-8)
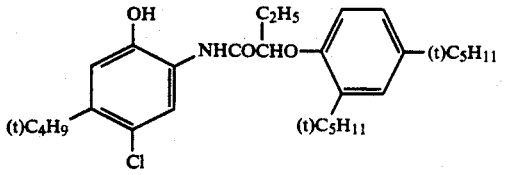
(C-9)
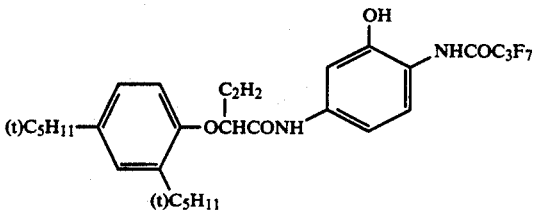
(C-10)
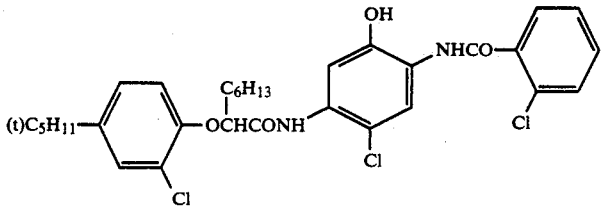
(C-11)
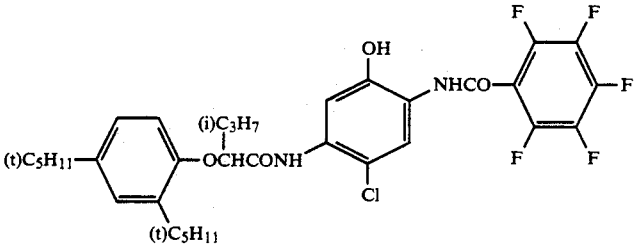
(C-12)
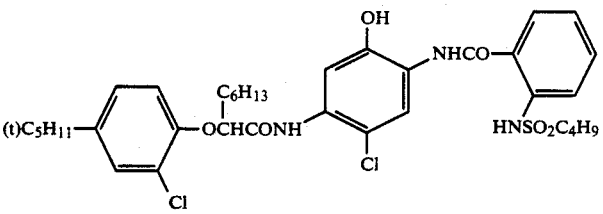
(C-13)
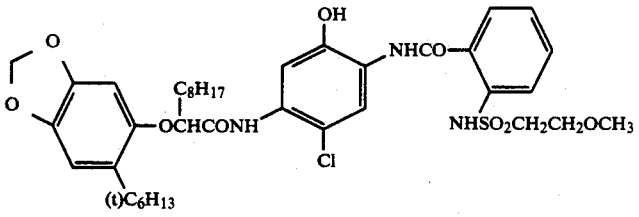
(C-14)
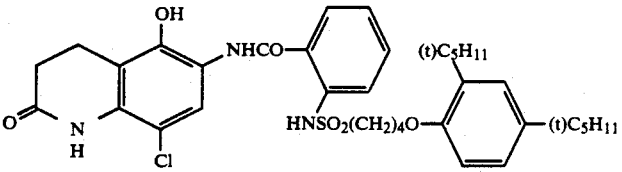

-continued
(C-15)
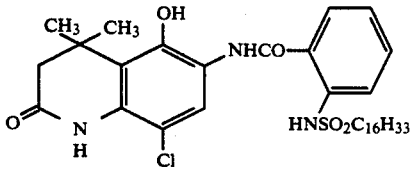
(C-16)
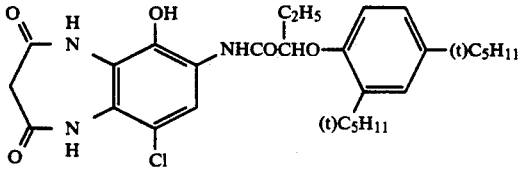
(C-17)
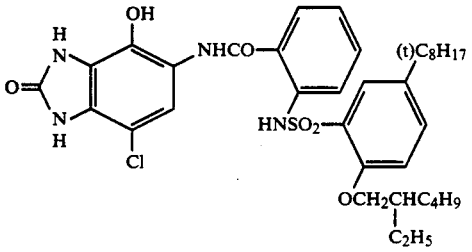
(C-18)
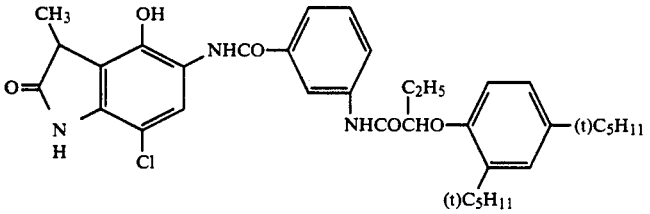
(C-19)
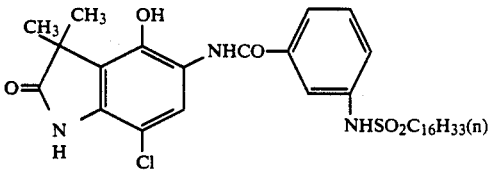
(C-20)
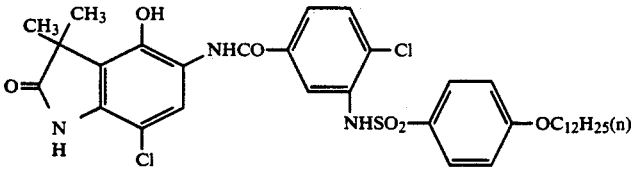
(C-21)
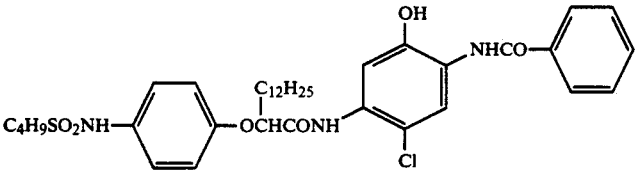

-continued
(C-22)
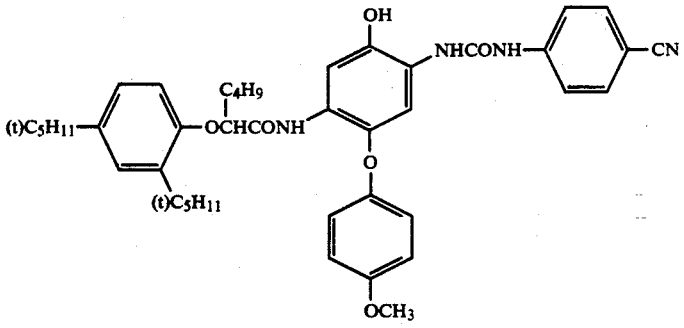
(M-1)
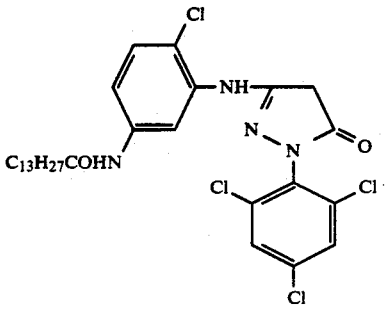
(M-2)
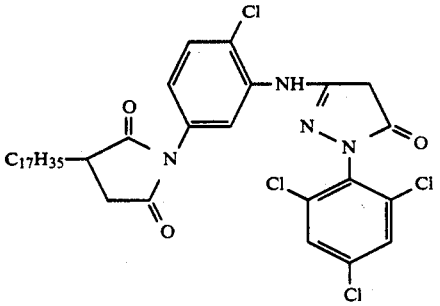
(M-3)
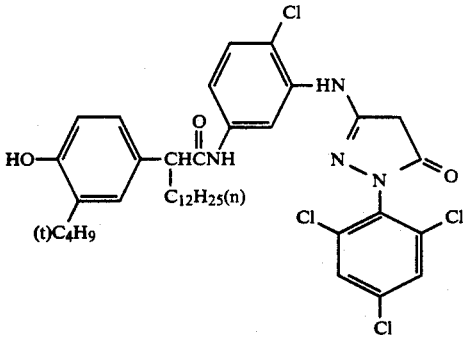
(M-4)
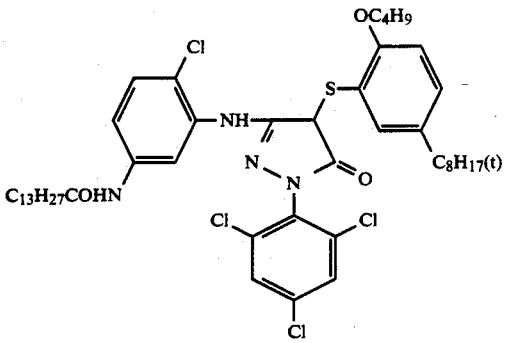

-continued
(M-5)
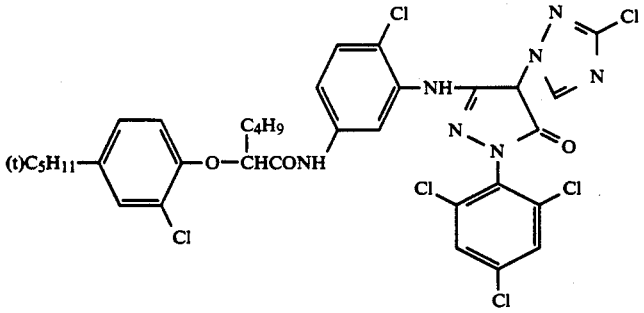
(M-6)
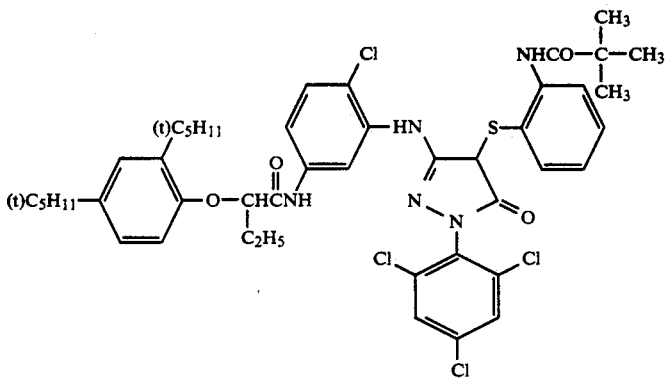
(M-7)
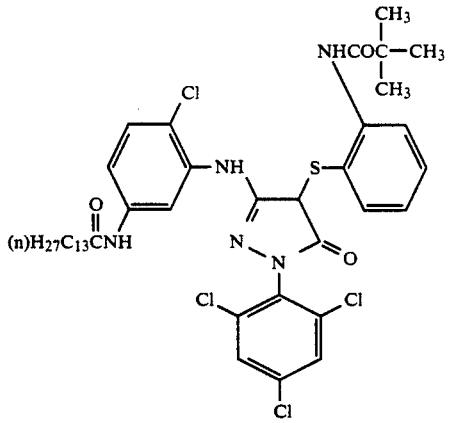
(M-8)
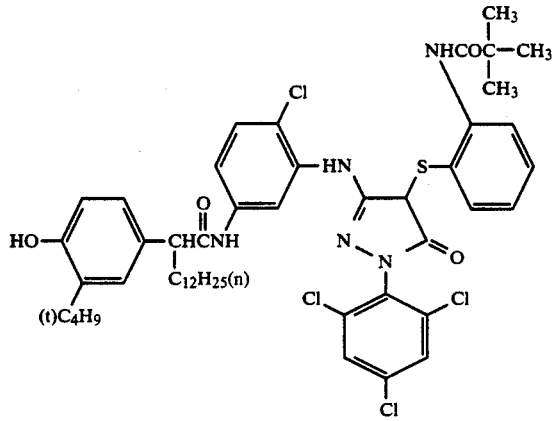

-continued
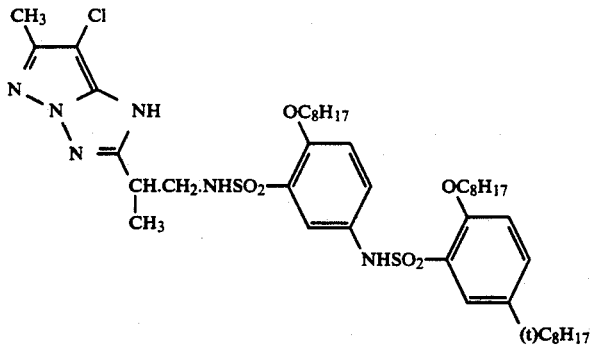
(M-9)
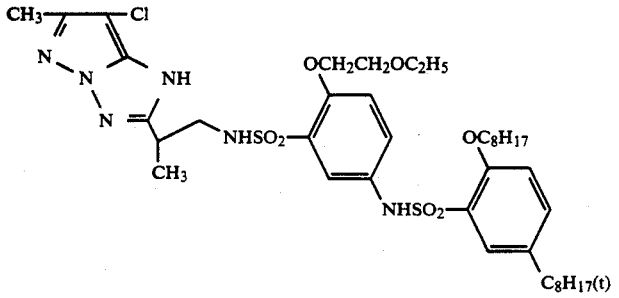
(M-10)
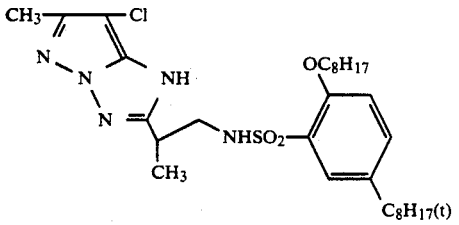
(M-11)
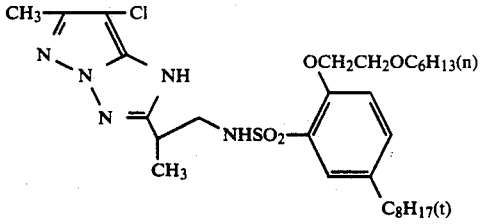
(M-12)
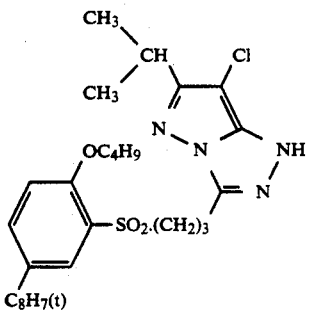
(M-13)

-continued
(M-14)
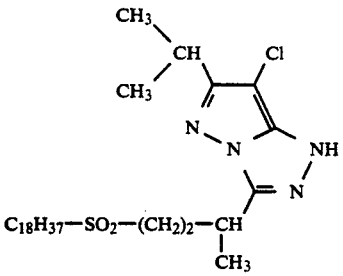
(M-15)
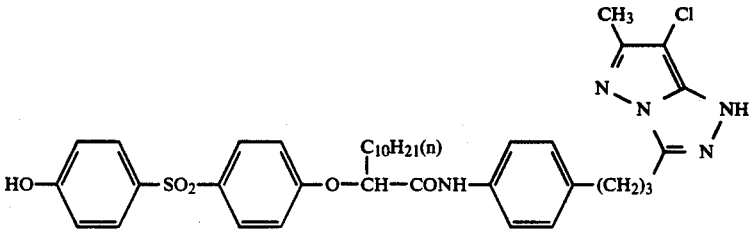
(M-16)
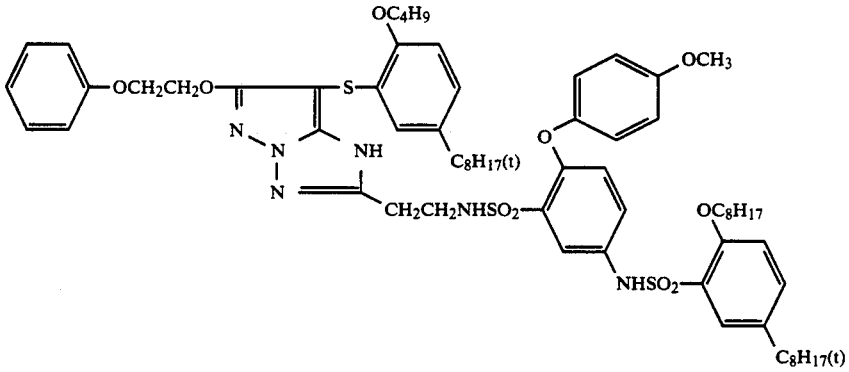
(M-17)
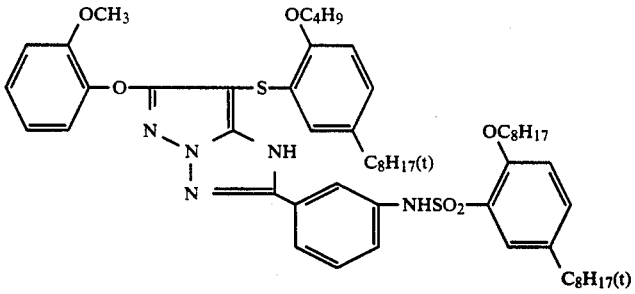
(M-18)
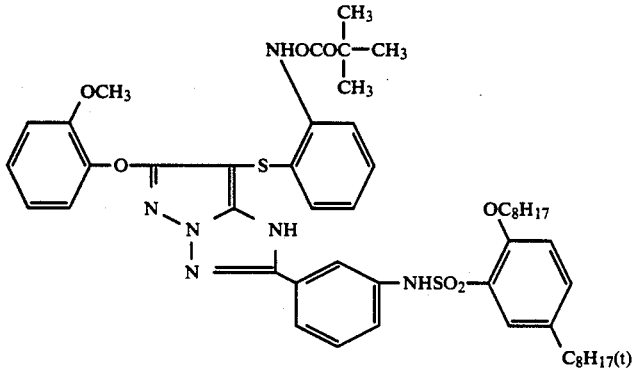

-continued
(Y-1)
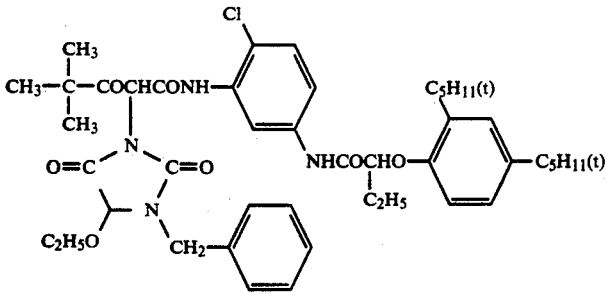
(Y-2)
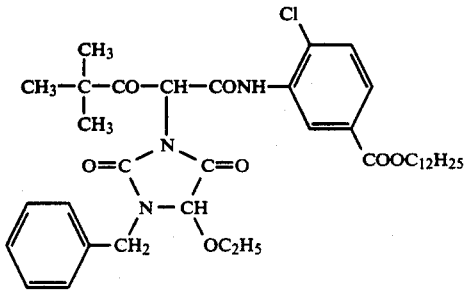
(Y-3)
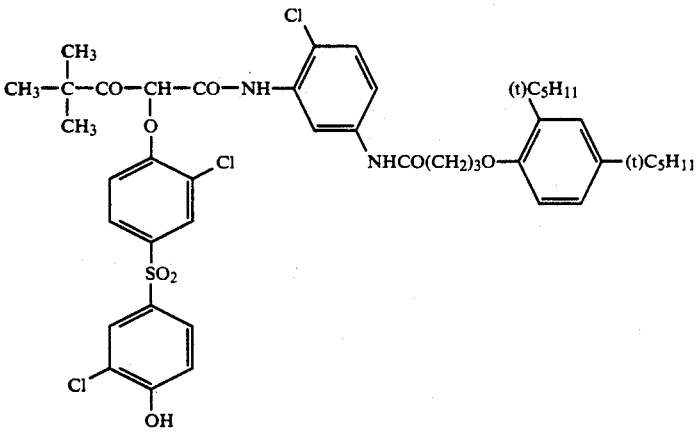
(Y-4)
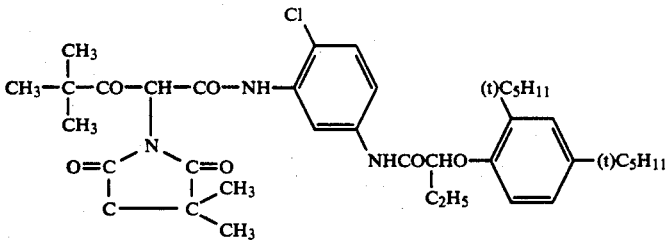
(Y-5)
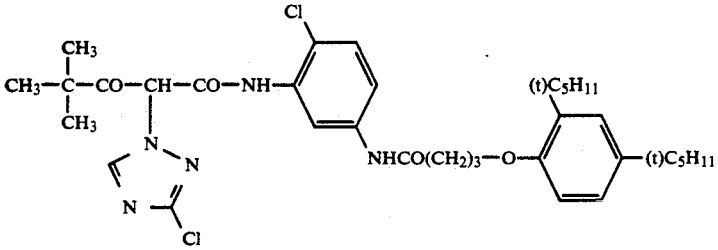

-continued (Y-6)

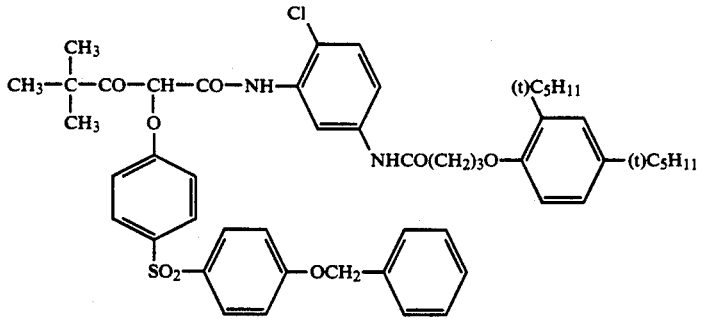

(Y-7)

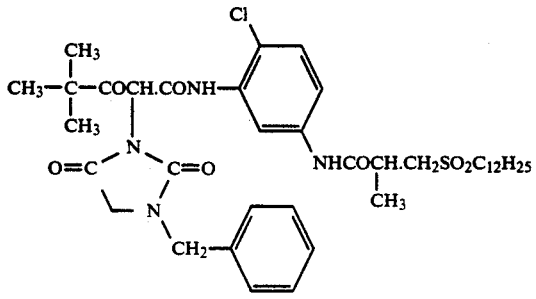

(Y-8)

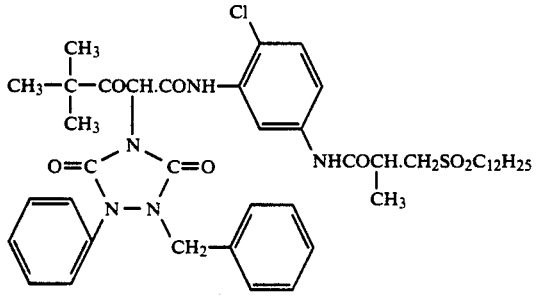

The couplers represented by the general formulae (VI), (VII), (VIII), (IX) or (X) are normally incorporated in silver halide emulsion layers constituting the light-sensitive layer in an amount of 0.1 to 1.0 mol, preferably 0.1 to 0.5 mol per mol of silver halide.

In the present invention, the incorporation of the above described couplers in the -light-sensitive layer can be accomplished by any suitable known method. The known oil-in-water dispersion process can be used as an oil protect process. In this process, the couplers are normally emulsion-dispersed in an aqueous solution of gelatin containing a surface active agent in the form of a solution in a solvent. Alternatively, water or an aqueous solution of gelatin may be added to a coupler solution containing a surface active agent to cause a phase inversion so that an oil-in-water dispersion is formed. An alkali-soluble coupler can be dispersed by a so-called Fischer's dispersion process. Low boiling organic solvents are removed from the coupler dispersion by any suitable method such as distillation, a noodle rinsing process or ultrafiltration before the coupler dispersion is mixed with a photographic emulsion.

As a dispersant for such a coupler there can be used a high boiling organic solvent and/or water-insoluble high molecular weight compound with a dielectric constant (25° C.) of 2 to 20 and a refractive index (25° C.) of 1.3 to 1.7.

Examples of high boiling organic solvents which can be preferably used include those represented by the following general formulae (A) to (E):

(A)

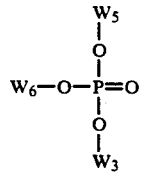

$W_5—COO—W_4$ (B)

(C)

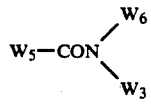

(D)

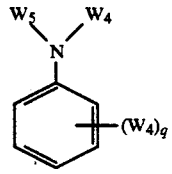

$W_5—O—W_6$ (E)

wherein $W_5$, $W_6$ and $W_3$ each represents a substituted or unsubstituted alkyl, cycloalkyl, alkenyl, aryl or heterocyclic group; $W_4$ represents $W_5$, $OW_5$ or $S\text{-}W_5$; and q represents an integer 1 to 5, with the proviso that when q is 2 or more, the plurality of $W_4$'s may be the same or different and that $W_5$ and $W_6$ may together form a condensed ring in the general formula (E).

Besides the high boiling organic solvents represented by the general formulae (A) to (E), compounds immiscible with water having a melting point of 100° C. or lower and a boiling point of 140° C. or above which are good coupler solvents can be used as such high boiling organic solvents. The melting point of such a high boiling organic solvent is preferably in the range of 80° C. or lower. The boiling point of such a high boiling organic solvent is preferably in the range of 160° C. or above, particularly 170° C. or above.

Examples of such a high boiling organic solvent include high boiling organic solvents with a boiling point of 160° C. such as a phthalic alkyl ester (e.g., dibutyl phthalate, dioctyl phthalate), a phosphoric ester (e.g., diphenyl phosphate, triphenyl phosphate, tricresyl phosphate, dioctylbutyl phosphate), a citric ester (e.g., tributyl acetylcitrate), a benzoic ester (e.g., octyl benzoate), an alkyl amide (e.g., diethyl laurylamide), an aliphatic ester (e.g., dibutoxyethyl succinate, dioctyl azerate), and a phenol (4-di-t-amylphenol). Examples of the above described water-insoluble high molecular weight compound include compounds as described in JP-B-60-18978 (18th column to 21st column)(The term "JP-B" as used herein means an "examined Japanese patent publication"), acrylamides, and vinyl polymers comprising methacrylamides as monomer components (including homopolymers and copolymers).

Specific examples of such a water-insoluble high molecular weight compound include polymethyl methacrylate, polyethyl methacrylate, polybutyl methacrylate, polycyclohexyl methacrylate, and poly-t-butylacrylamide. In addition to these high boiling organic solvents and/or water-insoluble high molecular weight compounds, low boiling organic solvents with a boiling point of 30° to 150° C. such as a lower alkyl acetate (e.g., ethyl acetate, butyl acetate), propionic ethyl alcohol, secondary butyl alcohol, methylisobutyl ketone, β-ethoxyethyl acetate, and methylcellosolve acetate can be optionally used alone or in combination.

In the present invention, an ultraviolet absorbent can be incorporated in any layer. Preferably, such an ultraviolet absorbent can be incorporated in the layer containing a compound of the general formula (VI) or (VII) or its adjacent layers. Examples of an ultraviolet absorbent which can be used in the present invention include compounds as described in *Research Disclosure* No. 17643, Chapter VIII-C. Preferred examples of such an ultraviolet absorbent include benzotriazole derivatives represented by the following general formula (XI):

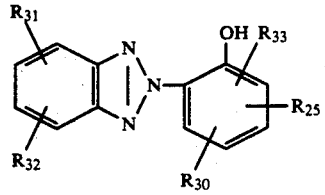

(XI)

wherein $R_{29}$, $R_{30}$, $R_{31}$, $R_{32}$ and $R_{33}$ may be the same or different and each represents a hydrogen atom, a halogen atom, a nitro group, a hydroxyl group, an alkyl group, an alkenyl group, an aryl group, an alkoxy group, an acyloxy group, an aryloxy group, an alkylthio group, an arylthio group, a mono or dialkylamino group, an acylamino group, or 5- or 6-membered heterocyclic group containing oxygen or nitrogen atoms. $R_{31}$ and $R_{32}$ may together make ring closure to form a 5- or 6-membered aromatic ring containing carbon atoms. Among these groups, those which may contain substituents can be substituted by the substituents allowable for $R^7$.

Compounds represented by the general formula (XI) can be used alone or in combination.

Examples of the synthesis of the compound (XI) and other examples of the compound (XI) are described in JP-B-44-29620, JP-A-50-151149, JP-A-54-95233, JP-A-61-190537, U.S. Pat. No. 3,766,205, EP0057160, and *Research Disclosure* No. 22519 (1983). Alternatively, high molecular weight ultraviolet absorbents as described in JP-A-58-111942, and Japanese Patent Application No. 57-61937, 57-63602, 57-129780, and 57-133371 can be used. Low molecular weight ultraviolet absorbents and high molecular weight ultraviolet absorbents can be used in combination.

Like couplers, the above described ultraviolet absorbents can be dispersed in a hydrophilic colloid in the form of a solution in a high boiling organic solvent or a low boiling organic solvent or a mixture thereof. The amount of the high boiling organic solvent and ultraviolet absorbent to be incorporated is not specifically limited. The amount of the high boiling organic solvent to be incorporated is normally in the range of 0 to 300% based on the weight of the ultraviolet absorbent. These compounds which stay liquid at normal temperature can be preferably used alone or in combination.

In addition to a combination of the present couplers, an ultraviolet absorbent of the general formula (XI) can be used to improve the preservability of developed dyes, particularly cyan images, especially the fastness thereof to light. The ultraviolet absorbent and the cyan coupler can be coemulsified.

The coated amount of such an ultraviolet absorbent may be such that the resulting cyan dye images can be provided with light stability. However, if the ultraviolet absorbent is used excessively, it may cause yellowing of the unexposed portions (white background) of the color photographic light-sensitive material. Accordingly, the coated amount of the ultraviolet absorbent is normally set in the range of $1\times10^{-4}$ to $2\times10^{-3}$ mol/m$^2$ particularly $5\times10^{-4}$ to $1.5\times10^{-3}$ mol/m$^2$.

In the light-sensitive structure of commonly used color paper, such an ultraviolet absorbent can be incorporated in either, preferably both of opposite adjacent layers of the cyan coupler-containing red-sensitive emulsion layer. If the ultraviolet absorbent is incorporated in the intermediate layer between a green-sensitive layer and a red-sensitive layer, it may be coemulsified with a color mixing inhibitor. If the ultraviolet absorbent is incorporated in a protective layer, another protective layer may be coated as an outermost layer. This protective layer may contain a matt agent with an any suitable grain diameter.

In order to improve the preservability of developed dye images, particularly yellow and magenta images, various organic and metallic complex discoloration inhibitors can be used. Examples of organic discoloration inhibitors include hydroquinones, gallic acid derivatives, p-alkoxyphenols, and p-oxyphenols. Examples of dye stabilizers, stain inhibitors and oxidation inhibitors are described in the patents cited in *Research Disclosure* No. 17643, Chapter VII-I and J. Examples of metallic complex discoloration inhibitors are described in *Research Disclosure* No. 15162.

In order to improve the fastness of yellow images to heat and light, phenols, hydroquinones, hydroxychromans, hydroxycoumarans, hindered amines, alkyl or silyl ethers thereof, or many compounds belonging to hydrolyzable precursor derivatives can be used. Compounds represented by the general formulae (XVIII) and (XIX) are effective to improve the fastness of a yellow image obtained from a coupler of the general formula (VIII) to heat and light at the same time.

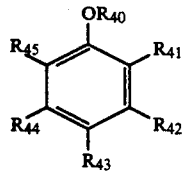
(XVIII)

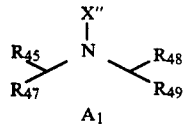
(XIX)

In the general formula (XVIII) or (XIX), $R_{40}$ represents a hydrogen atom, an aliphatic group, an aromatic group, a heterocyclic group or a substituted silyl group,

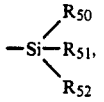

in which $R_{50}$, $R_{51}$ and $R_{52}$ may be the same or different and each represents an aliphatic group, an aromatic group, an aliphatic oxy group or an aromatic oxy group. These groups may contain substituents allowable for $R_7$. $R_{41}$, $R_{42}$, $R_{43}$, $R_{44}$ and $R_{45}$ may be the same or different and each represents a hydrogen atom, an alkyl group, an aryl group, an alkoxy group, a hydroxyl group, a mono or dialkylamino group, an imino group or an acylamino group. $R_{46}$, $R_{47}$, $R_{48}$ and $R_{49}$ may be the same or different and each represents a hydrogen atom or an alkyl group. X" represent a hydrogen atom, an aliphatic group, an acyl group, an aliphatic or an aromatic sulfonyl group, aliphatic or aromatic sulfinyl group, an oxyradical group or a hydroxyl group. $A_1$ represents a nonmetallic atom group required for the formation of a 5-, 6- or 7-membered ring.

Examples of the synthesis of compounds represented by the general formulae (XVIII) and (XIX) and other examples of these compounds are described in British Patent Nos. 1,326,889, 1,354,313, and 1,410,846, U.S. Pat. Nos. 3,336,135, and 4,268,593, JP-B-51-1420, and JP-B-52-6623, and JP-A-58-114036, and JP-A-59-5246.

Compounds represented by the general formulae (XVIII) and (XIX) can be used in combination. These compounds can be used in combination with discoloration inhibitors which have heretofore been known.

The amount of the compound of the general formula (XVIII) or (XIX) to be used depends on the type of yellow coupler to be used in combination therewith. The compound of the general formula (XVIII) or (XIX) can be used in an amount of 0.5 to 200% by weight, preferably 2 to 150% by weight based on the weight of the yellow coupler to accomplish the desired objects of the invention. Preferably, the compound of the general formula (XVIII) or (XIX) may be coemulsified with a yellow coupler of the general formula (X).

The above described various dye stabilizers, stain inhibitors or oxidation inhibitors are also effective for the improvement in the preservability of magenta dye developed from a coupler represented by the general formula (VIII) or (IX). The group of compounds represented by the general formulae (XX), (XXI), (XXII), (XXIII), (XXIV) and (XXV) advantageously greatly improve the fastness of the light-sensitive material, particularly to light.

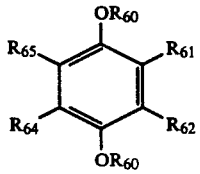
(XX)

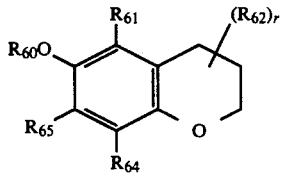
(XXI)

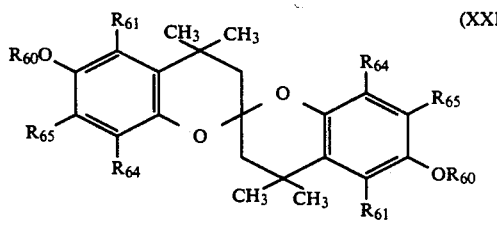
(XXII)

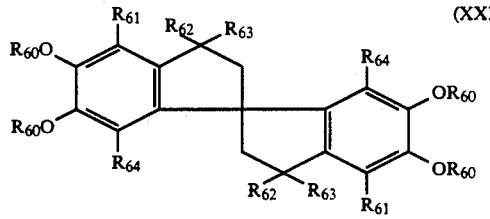
(XXIII)

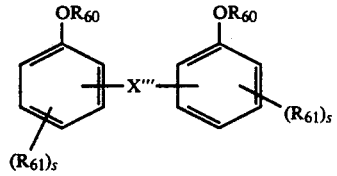
(XXIV)

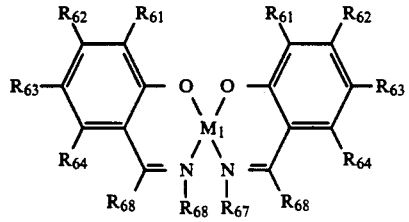
(XXV)

In the general formulae (XX) to (XXV), $R_{60}$ has the same meaning as $R_{40}$ in the general formula (XVIII). $R_{61}$, $R_{62}$, $R_{64}$ and $R_{65}$ may be the same or different and each represents a hydrogen atom, an aliphatic group, an aromatic group, an acylamino group, a mono or dialkylamino group, an aliphatic or an aromatic thio group, an acylamino group, an aliphatic or aromatic oxycarbonyl group, or —$OR_{40}$. $R_{40}$ and $R_{61}$ may be bonded to each other to form a 5- or 6-membered ring.

Alternatively, $R_{61}$ and $R_{62}$ may be bonded to each other to form a 5- or 6-membered ring. X''' represents a divalent connecting group. $R_{66}$ and $R_{67}$ may be the same or different and each represents a hydrogen atom, an aliphatic group, an aromatic group or a hydroxyl group. $R_{68}$ represents a hydrogen atom, an aliphatic group or an aromatic group. $R_{66}$ and $R_{67}$ may together form a 5- or 6-membered ring. $M_1$ represents Cu, Co, Ni, Pd or Pt. If the substituents $R_{61}$ to $R_{68}$ are aliphatic or aromatic groups, they may be substituted by substituents allowable for $R_7$. The suffix r represents an integer 0 to 3. The suffix s represents 0 to 4. The suffixes r and s each indicates the substituted number of $R_{62}$ or $R_{61}$. If this number is 2 or more, the plurality of $R_{62}$'s or $R_{61}$'s may be the same or different.

In the general formula (XXIV), typical examples of preferred groups represented by X''' include $$-\underset{\underset{R_{70}}{|}}{CH}-CH_2-,\ -CH_2-\underset{\underset{R_{70}}{|}}{CH}-CH_2-,\ -\underset{\underset{R_{70}}{|}}{CH}-CH_2CH_2-,$$

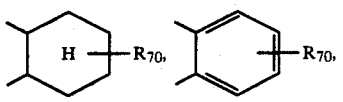

in which $R_{70}$ represents a hydrogen atom or an alkyl group.

In the general formula (XX V), $R_{61}$ is preferably a hydrogen-bondable group. A compound wherein at least one of the groups represented by $R_{62}$, $R_{63}$ and $R_{64}$ is a hydrogen atom, a hydroxyl group, an alkyl group or an alkoxy group may be preferably used. The substituents $R_{61}$ to $R_{68}$ each preferably contains a total of 4 or more carbon atoms.

Examples of the synthesis of these compounds and other examples of these compounds are described in U.S. Pat. No. 3,336,135, 3,432,300, 3,573,050, 3,574,627, 3,700,455, 3,764,337, 3,935,016, 3,982,944, 4,254,216 and 4,279,990, British Patent 1,347,556, 2,062,888, 2,066,975, and 2,077,455, JP-A-60-97353, JP-A-52-152225, JP-A-53-17729, JP-A-53-20327, JP-A-54-145530, JP-A-55-6321, JP-A-55-21004, JP-A-58-24141, and JP-A-59-10539, and JP-B-48-31625, and JP-B-54-12337.

Among discoloration inhibitors which can be advantageously used in the present invention, the compounds represented by the general formulae (XX) to (XXIV) each is used in an amount of 10 to 200 mol %, preferably 30 to 100 mol % based on the weight of magenta coupler to be used in the present invention. On the other hand, the compound represented by the general formula (XXV) is used in an amount of 1 to 100 mol %, preferably 5 to 40 mol % based on the weight of magenta coupler to be used in the present invention. These compounds may be preferably coemulsified with a magenta coupler.

For the inhibition of discoloration, a process is disclosed in JP-A-49-11330 and JP-A-50-57223 which comprises enclosing a dye image by an oxygen blocking layer comprising a substance with a low oxygen permeability. JP-A-85747 discloses a process which comprises providing a layer with an oxygen permeability of 20 $ml/m^2.hr.atom$ or less on the support side of the dye-forming layer of the color photographic material. These processes can be applied to the present invention.

In the present invention, compounds as described later are preferably used in combination with the above described couplers, particularly with pyrazoloazole couplers.

In particular, Compound (Q) which undergoes chemical bonding to an aromatic amine developing agent remaining after color development to produce a chemically inert and substantially colorless compound and/or Compound (R) which undergoes chemical bonding to an oxidation product of an aromatic amine color developing agent to produce a chemically inert and substantially colorless compound may be preferably used to inhibit the generation of stains due to the production of developed dyes caused by the reaction of a color developing agent remaining in the film during storage after processing or its oxidation product with a coupler or other side effects.

As a suitable compound (Q) there can be used a compound which reacts with p-anisidine at a secondary reaction rate constant k2 (in trioctyl phosphate at 80° C.) of 1.0 l/mol.sec to $1\times10^{-5}$ l/mol.sec. The measurement of the secondary reaction constant can be accomplished by a method as described in JP-A-63-158545.

If k2 exceeds this range, the compound becomes unstable itself, possibly causing it to undergo reaction with gelatin or water and decompose. On the other hand, if k2 is less than this range, the compound reacts with the remaining aromatic amine developing agent at a lower rate. As a result, the inhibition of side effects of the remaining aromatic amine developing agent, which is one of the objects of the present invention, cannot be accomplished.

Preferred examples of Compound (Q) can be represented by the general formula (QI) or (QII):

$$R_{80}-(A_2)_u-X'''' \qquad \text{(QI)}$$

$$R_{81}-\underset{\underset{A_3}{|}}{C}=Y_9 \qquad \text{(QII)}$$

wherein $R_{80}$ and $R_{81}$ each represents an aliphatic group, an aromatic group or a heterocyclic group; u represents 0 or 1; $A_2$ represents a group which reacts with an aromatic amine developing agent to form a chemical bond; X'''' represents a group which reacts with an aromatic amine developing agent to undergo elimination; $A_3$ represents a hydrogen atom, an aliphatic group, an aromatic group, a heterocyclic group, an acyl group or a sulfonyl group; and $Y_9$ represents a group which accelerates the addition of an aromatic amine developing agent to the compound of the general formula (QII). $R_{80}$ and X'''', or $Y_9$ and $R_{81}$ or $A_3$ may be bonded to each other to form a cyclic structure.

Typical among the reaction system by which $A_2$ is chemically bonded to the remaining aromatic amine developing agent are substitution reactions and addition reactions.

Typical examples of preferred compounds represented by the general formulae (QI) and (QII) are described in JP-A-63-158545 and JP-A-62-283338, and Japanese Patent Application No. 63-18439 and 62-158342.

Preferred examples of Compound (R) which undergo chemical bonding to an oxidation product of an aromatic amine developing agent remaining after color development to produce a chemically inert and substantially colorless compound can be represented by the general formula (RI):

$$R_{82}\text{-}Z_5 \qquad \text{(RI)}$$

wherein $R_{82}$ represents an aliphatic group, an aromatic group or a heterocyclic group; and $Z_5$ represents a nucleophilic group or a group which undergoes decomposition in a light-sensitive material to release a nucleophilic group. The compound represented by the general formula (RI) is preferably a compound wherein $Z_5$ is a group having a Pearson's nucleophilicity $^{n}CH_3I$ value (R. G. Pearson, et al., *J. Am. Chem. Soc.*, 90, 319(1968)) of 5 or more or a group derived therefrom.

Specific examples of preferred compounds represented by the general formula (RI) are described in European Patent 255722, JP-A-62-143048 and JP-A 62-229145, and Japanese Patent Application Nos. 63-18439, 63-136724, 62-214681, and 62-158342.

The combination of Compound (R) with Compound (Q) is further described in European Patent Disclosure No. 277589.

The light-sensitive material prepared according to the present invention may comprise a water-soluble dye as a filter dye in the hydrophilic colloid layer or for the purpose of inhibition of irradiation or other various purposes. Examples of such a dye include an oxonol dye, a hemioxonol dye, a styryl dye, a merocyanine dye, a cyanine dye, and an azo dye. Particularly preferred among these dyes are an oxonol dye, a hemioxonol dye and a merocyanine dye.

Examples of dyes which can be preferably used in the present invention can be represented by the general formulae (DI) to (DIV):

wherein $Z^1$ and $Z^2$ may be the same or different and each represents a nonmetallic atom group required for the

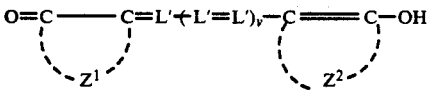

formation of a heterocyclic group; L' represents a methine group; and v represents an integer 0, 1 or 2.

The heterocyclic group formed by the nonmetallic atom group represented by $Z^1$ and $Z^2$ is preferably a 5- or 6-membered ring which may be single or condensed. Examples of such a heterocyclic group include a 5-pyrazolone ring, a barbituric acid, an isooxazolone, a thiobarbituric acid, a rhodanine, an imidazopyridine, a pyrazolopyrimidine and a pyrrolidone. These rings may be further substituted.

The heterocyclic group formed by $Z^1$ or $Z^2$ is preferably a 5-pyrazolone ring or a barbituric acid containing at least one sulfonic acid group or carboxylic acid group. Examples of oxonol dyes containing these pyrazolone or barbituric acid nuclei are described in British Patent 506,285, 1,177,429, 1,311,884, 1,338,799, 1,385,371, 1,467,214, 1,433,102, and 1,553,516, JP-A-48-85130, JP-A-49-114420, JP-A-55-161233, and JP-A-59-111640, and U.S. Pat. Nos. 3,247,127, 3,469,985, and 4,078,933.

The methine group represented by L' may contain substituents such as an alkyl group (e.g., methyl, ethyl), an aryl group (e.g., phenyl) or a halogen atom (e.g., chlorine). Two or more L'(s) may be connected to each other to form a ring (e.g., 4,4-dimethyl-1-cyclohexene).

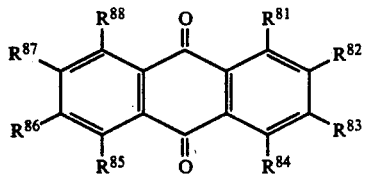

(DII)

wherein $R^{81}$, $R^{84}$, $R^{85}$ and $R^{88}$ may be the same or different and each represents a hydrogen atom, a hydroxyl group, an alkoxy group, an aryloxy group, a carbamoyl group or an amino group

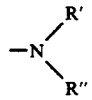

in which R' and R'' may be the same or different and each represents a hydrogen atom or alkyl or aryl group containing at least one sulfonic acid group or carboxyl group.

$R^{82}$, $R^{83}$, $R^{86}$ and $R^{87}$ may be the same or different and each represents a hydrogen atom, sulfonic acid group, carboxyl group or alkyl or aryl group containing at least one sulfonic acid group or carboxyl group.

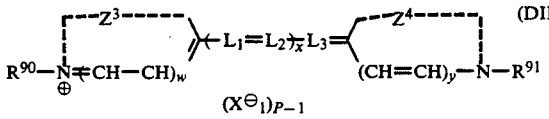

(DIII)

or

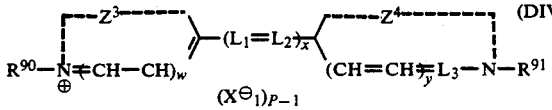

(DIV)

wherein $R^{90}$ and $R^{91}$ may be the same or different and each represents a substituted or unsubstituted alkyl group.

$L_1$, $L_2$ and $L_3$ may be the same or different and each represents a substituted or unsubstituted methine group as described above. The suffix x represents 0 to 3.

$Z^3$ and $Z^4$ may be the same or different and each represents a nonmetallic atom group required for the formation of a substituted or unsubstituted 5- or 6-membered heterocyclic group. The suffixes w and y each represents an integer 0 or 1.

$X_1^{\ominus}$ represents an anion. P represents an integer of 1 or 2. When the compound forms an intramolecular salt, P is 1.

The above described cyanine dyes are further described in U.S. Pat. Nos. 2,843,486, and 3,294,539.

As a binder or protective colloid to be incorporated in the emulsion in the present light-sensitive material there can be advantageously used gelatin. Other hydrophilic colloids can be used.

Examples of such hydrophilic colloids which can be used in the present invention include protein such as gelatin derivatives, graft polymers of gelatin with other high molecular weight compounds, albumine, and casein; saccharide derivatives such as hydroxyethyl cellulose, carboxymethyl cellulose, cellulose ester sulfate, sodium alginate, and starch derivatives; monopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other various synthetic hydrophilic high molecular weight compounds.

As gelatin there can be used either lime-treated gelatin or acid-treated gelatin. The preparation of gelatin is further described in Arther Vice, *The Macromolecular Chemistry of Gelatin,* Academic Press, 1964.

The term "reflective support" as used herein means a material which improves the reflecting properties of the light-sensitive material to sharpen dye images formed in the silver halide emulsion layer. Examples of such a reflective support include a material comprising a dispersion of a light-reflecting substance such as titanium oxide, lead oxide, calcium carbonate or calcium sulfate in a hydrophobic resin coated on a support and a hydrophobic resin comprising a light-reflecting substance dispersed therein. Specific examples of such a reflective support include baryta paper, polyethylene-coated paper, polypropylene synthetic paper, transparent supports such as a glass plate comprising a reflective substance, polyester film such as polyethylene terephthalate, cellulose triacetate or cellulose nitrate, polyamide film, polycarbonate film, polystyrene film, and vinyl chloride resin. These support materials can be properly selected depending on the purpose or application of the color photographic material.

Preferably a white pigment as reflective substance is thoroughly kneaded in the presence of a surface active agent. The white pigment to be used is preferably treated with a divalent, trivalent or tetravalent alcohol on the surface thereof.

The percentage of the area of white pigment grain per specified unit area can be most normally determined by dividing the observed area into adjacent 5 $\mu m \times 6$ $\mu m$ unit areas, and then measuring the percentage of the projected area of finely divided grain (Ri) per the unit area. The coefficient of the fluctuation of the percentage area ratio can be determined by the ratio of the standard deviation s of Ri to the average $\overline{R}$ ($s/\overline{R}$). The number of the specified unit area (n) is preferably 6 or more. Therefore, the coefficient of fluctuation can be determined by the equation:

$$\sqrt{\frac{\sum_{n=1}^{n} (Ri - R)^2}{n-1}} \Big/ \frac{\sum_{i=1}^{n} Ri}{n}$$

In the present invention, the fluctuation coefficient of the percentage area ratio of finely divided pigment grain is preferably 0.15 or less, particularly 0.12 or less. The dispersibility of finely divided grains having a fluctuation coefficient of 0.08 or less as determined in this manner can be said to be "substantially uniform".

In the light-sensitive material of the present invention, if the hydrophilic colloid layer contains a dye or ultraviolet absorbent, it may be mordanted by a cationic polymer. Examples of such a cationic polymer which can be used in the present invention include those described in British Patent 685,475, U.S. Pat. Nos. 2,675,316, 2,839,401, 2,882,156, 3,048,487, 3,184,309, and 3,445,231, West German Patent Application (OLS) 1,914,362, and JP-A-50-47624, and JP-A-50-71332.

The light-sensitive material of the present invention may comprise as a color fog inhibitor a hydroquinone derivative, aminophenol derivative, gallic acid derivative, ascorbic acid derivative, or the like. Specific examples of such compounds are described in U.S. Pat. Nos. 2,360,290, 2,336,327, 2,403,721, 2,418,613, 2,675,314, 2,701,197, 2,704,713, 2,728,659, 2,732,300, and 2,735,765, JP-A-50-92988, JP-A-50-92989, JP-A-50-93928, JP-A-50-110337, and JP-A-52-146235, and JP-B-50-23813.

The silver halide emulsion layer or other hydrophilic colloid layer may contain fine grained silver halide emulsion being substantially light-insensitive (for example, a silver chloride, silver bromide or silver chlorobromide emulsion having 0.20 $\mu m$ or less of average grain size).

The color developing solution to be used in the present invention is preferably an alkaline aqueous solution containing as a main component an aromatic primary amine color developing agent. As such a color developing agent there can be effectively used, p-phenylenediamine compounds can be more preferably used. Typical examples of such p-phenylenediamine compounds include 3-methyl-4-amino-N,N-diethylaniline, 3-methyl-4-amino-N-ethyl-N-$\beta$-hydroxyethylaniline, 3-methyl-4-amino-N-ethyl-N-($\beta$-methanesulfonamidoethyl)aniline, 3-methyl-4-amino-N-ethyl-N-$\beta$-methoxyethylaniline, and sulfates, hydrochlorides and p-toluenesulfonates thereof. Two or more of these compounds can be used in combination depending on the purpose or application of the color photographic material.

The color developing solution normally comprises a pH buffer such as a carbonate, borate or phosphate of alkaline metals, a development inhibitor such as bromide, iodide, benzimidazoles, benzothiazoles or mercapto compounds or a fog inhibitor. Typical examples of other additives which can be incorporated in the color developing solution as necessary include preservatives such as hydroxylamine, diethylhydroxylamine, amine, sulfites, hydrazines, phenylsemicarbazides, triethanolamine, catecholsulfonic acids and triethylenediamine(1,4-diazabicyclo[2,2,2]octane), organic solvents such as ethylene glycol and diethylene glycol, development accelerators such as benzyl alcohol, polyethylene glycol, quaternary ammonium salts and amines, dye-forming couplers, competing couplers, fogging agents such as sodium boron hydride, auxiliary developing agents such as 1-phenyl-3-pyrazolidone, thickening agents, chelating agents such as aminopolycarboxylic acids, aminopolyphosphonic acids, alkylphosphonic acids and phosphonocarboxylic acids (e.g., ethylenediaminetetraacetic acid, nitrilotriacetic acid, diethylenetriaminepentaacetic acid, cyclohexanediaminetetraacetic acid, hydroxyethylimidioacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof).

Reversal processing is usually carried out by black-and-white development followed by color development. Black-and-white developers to be used can contain one or more of known black-and-white developing agents, such as dihydroxybenzenes, e.g., hydroquinones, 3-pyrazolidones, e.g., 1-phenyl-3-pyrazolidone, and aminophenols, e.g., N-methyl-p-aminophenol.

The replenishment rate of the developer is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. When the replenishment rate is reduced, it is preferable to reduce the area of the liquid surface in contact with air in the processing tank to thereby prevent evaporation and air-oxidation of the liquid. The replenishment rate can also be reduced by a means for suppressing accumulation of the bromide ion in the developer.

The photographic emulsion layer after color development is usually subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose or application of the color photographic material. Bleaching agents to be used include compounds of polyvalent metals, e.g., iron(III), cobalt(III), chromium(VI), and copper(II), peracids, quinones, nitroso compounds, and the like. Typical examples of these bleaching agents are ferricyanides; bichromates; organic complex salts of iron(III) or cobalt(III), such as complex salts with aminopolycarboxylic acids, e.g., ethylenediaminetetraacetic acid, diethylenetriaminepentaacetic acid, cyclohexanediaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc.; persulfates; hydrobromic acid salts; permanganates; nitrobenzenes; and so on. Of these, aminopolycarboxylic acid-iron(III) complex salts such as (ethylenediaminetetraacetato)iron(III) complex salts and persulfates are preferred in view of the environment pollution. Further aminopolycarboxylic acid-icon (III) complex salt is useful in both of a bleaching and a blix solution.

The bleaching bath, blix bath or a prebath thereof can contain, if desired, a bleaching accelerator. Examples of useful bleaching accelerators are compounds having a mercapto group or a disulfide group as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-104232, JP-A-53-124424, JP-A-53-141623 and JP-A-53-28426, *Research Disclosure,* No. 17129 (July, 1978); thiazolidine derivatives as described in JP-A-50-140129; thiourea derivatives as described in JP-B-45-8506, JP-A-52-20832 and JP-A-53-32735, and U.S. Pat. No. 3,706,561; iodides as described in West German Patent 1,127,715 and JP-A-58-16235; polyoxyethylene compounds as described in West German Patents 966,410 and 2,748,430; polyamine compounds as described in JP-B-45-8836; the compounds described in JP-A-49-42434, JP-A-49-59644, JP-A-53-94927, JP-A-54-35727, JP-A-55-26506, and JP-A-58-163940; and bromine ions. Preferred among them are compounds having a mercapto group or a disulfide group because of their great acceleratory effects. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. These bleaching accelerators may be incorporated into the light-sensitive material.

Fixing agents to be used for fixation include thiosulfates, thiocyanates, thioethers, thioureas, and a large amount of iodides. The thiosulfates are usually employed, with ammonium thiosulfate being applicable most broadly. Sulfites, bisulfites or carbonyl bisulfite adducts are suitably used as preservatives of the blix bath.

It is usual that the thus desilvered silver halide color photographic materials of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of the washing water, the number of washing tanks (number of stages), the replenishment system (e.g., counter-flow system or direct-flow system), and other various factors. Of these factors, the relationship between the number of washing tanks and the quantity of water in a multistage counter-flow system can be obtained according to the method described in *Journal of the Society of Motion Picture and Television Engineers,* Vol. 64, pp. 248–253 (May, 1955).

According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in Japanese Patent Application No. 61-131632 can be used very effectively. Further, it is also effective to use isothiazolone compounds or thiabenzazoles as described in JP-A-578542, chlorine type bactericides, e.g., chlorinated sodium isocyanurate, benzotriazole, and bacteriocides described in Hiroshi Horiguchi, *Bokinbobaizai no Kagaku,* Eisei Gijutsu Gakkai (ed.), *Biseibutsu no Mekkin, Sakkin, Bobaigijutsu,* and Nippon Bokin Bobai Gakkai (ed.), *Bokin Bobaizai Jiten.*

The washing water has a pH of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization, any of the known techniques as described in JP-A-57-8543, JP-A-58-14834, and JP-A-60-220345 can be used.

The aforesaid washing step may be followed by stabilization in some cases. This stabilizing bath may also contain various chelating agents or bacteriocides. The overflow accompanying replenishment of the washing bath and/or stabilizing bath can be reused in other steps such as desilvering.

The silver halide color light-sensitive material of the present invention may comprise a color developing agent for the purpose of simplifying and speeding up processing. Such a color developing agent is preferably incorporated in the color light-sensitive material in the form of a precursor thereof. Examples of such a precursor include indoaniline compounds as described in U.S. Pat. No. 3,342,597, Schiff's base type compounds as described in U.S. Pat. No. 3,342,599, and *Research Disclosure* Nos. 14,850 and 15,159, aldol compounds as described in *Research Disclosure* No. 13,924, metal salt complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such a compound are described in JP-A-56-64339, JP-A-57-144547, and JP-A-58-115438.

In the present invention, the various processing solutions can be used at a temperature of from 10° C. to 50° C. The standard temperature range is from 33° C. to 38° C. However, the temperature range can be raised to accelerate processing, reducing the processing time. On the contrary, the temperature range can be lowered to improve image quality or stability of the processing solution. In order to save silver to be incorporated in the light-sensitive material, a processing utilizing cobalt or hydrogen peroxide intensification as described in West German Patent 2,226,770 and U.S. Pat. No. 3,674,499 may be employed.

Each processing bath can be optionally provided with a heater, temperature sensor, liquid level sensor, circulating pump, filter, various floating cover, various squeegees, or the like.

The present invention will be further described in the following examples, but the present invention should not be construed as being limited thereto.

Unless otherwise stated all percents, ratios, parts, etc. are by weight.

EXAMPLE 1

32 g of lime-treated gelatin was dissolved in 1,000 ml of distilled water at a temperature of 40° C. 11.6 g of sodium chloride was then added to the solution. The temperature of the solution was raised to 70° C. 3.2 ml of N,N'-dimethylimidazolidine-2-thione (1% aqueous solution) was added to the solution. A solution of 32.0 g of silver nitrate in 200 ml of distilled water and a solution of 21.7 g of potassium bromide and 0.32 g of sodium chloride in 200 ml of distilled water were added to the solution within 40 minutes while the temperature was kept at 70° C. A solution of 128.0 g of a silver nitrate in 560 ml of distilled water and 66.4 g of potassium bromide, 11.5 g of sodium chloride and 0.03 mg of potassium hexacholroiridate (IV) dissolved in 560 ml of distilled water were then added to the solution within 25 minutes while the temperature was kept at 70° C. 5 minutes after the addition of the aqueous solution of silver nitrate and the aqueous solution of alkali halide, the solution was cooled to 40° C. The solution was then subjected to desalting and washing with water.

Furthermore, lime-treated gelatin was added to the solution to adjust the pH and pAg thereof. The emulsion was then subjected to optimum chemical sensitization with triethylthio urea. The emulsion was then subjected to spectral sensitization with Spectral Sensitizing Dye (Dye-1) as described later. The emulsion thus obtained comprised cubic silver bromochloride grains having a mean grain size of 0.88 μm and a grain size fluctuation coefficient of 0.06. This emulsion was used as Emulsion (A).

Emulsions (B) to (F) were prepared in the same manner as Emulsion (A) except that the amount of the chemicals to be added, the time for which the chemicals were added, and the temperature at which the reaction was carried out were changed. However, for Emulsion (B), the spectral sensitization was effected with Spectral Sensitizing Dye (Dye-1) as in Emulsion (A). Both Emulsions (A) and (B) were used as blue-sensitive emulsions. For both Emulsions (C) and (D), the spectral sensitization was effected with Spectral Sensitizing Dyes (Dye-2-1) and (Dye-2-2). Both Emulsions (C) and (D) were used as green-sensitive emulsion. For both Emulsions (E) and (F), the spectral sensitization was effected with Spectral Sensitizing Dye (Dye-3). Both Emulsions (E) and (F) were used as red-sensitive emulsions.

The crystal form, mean halogen composition, mean grain size and grain size fluctuation coefficient of Emulsions (A) to (F) are set forth in Table 1.

TABLE 1

| Emulsion | Crystal Form | Mean Halogen Composition (Br mol %) | Mean Grain Size (μm) | Grain Size Fluctuation Coefficient |
|---|---|---|---|---|
| (A) | Cube | 79 | 0.88 | 0.06 |
| (B) | Cube | 79 | 0.65 | 0.07 |
| (C) | Cube | 90 | 0.46 | 0.09 |
| (D) | Cube | 90 | 0.35 | 0.10 |
| (E) | Cube | 74 | 0.48 | 0.09 |
| (F) | Cube | 74 | 0.34 | 0.10 |

Dye (Dye-1) for blue sensitive emulsion

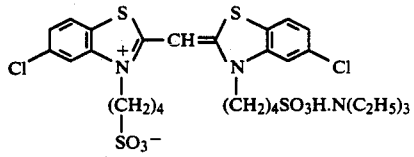

($3.8 \times 10^{-4}$ mol per mol of silver halide)

Dye (Dye-2-1) for green-sensitive emulsion

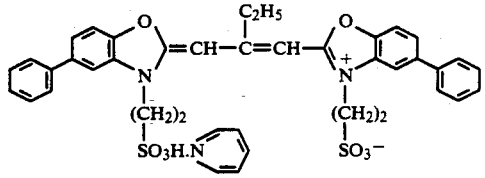

($2.1 \times 10^{-4}$ mol per mol of silver halide)

Dye (Dye-2-2) for green-sensitive emulsion

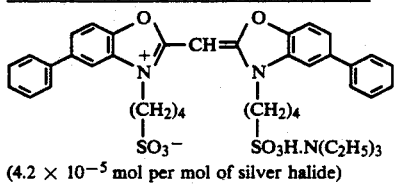

($4.2 \times 10^{-5}$ mol per mol of silver halide)

Dye (Dye-3) [Exemplary Compound 2] for red-sensitive emulsion

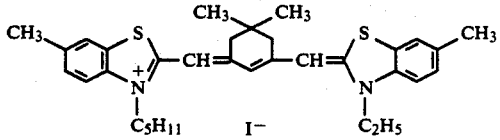

($6.1 \times 10^{-5}$ mol per mol of silver halide)

To the red-sensitive emulsion was added the following compound in an amount of $2.3\times10^{-3}$ mol per mol of silver halide.

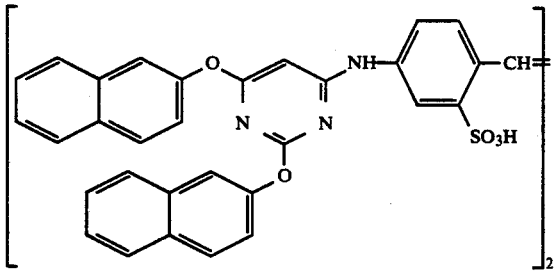

In each of these emulsions was incorporated 4-hydroxy-6-methyl-1,3,3a,7-tetraazaindene as a stabilizer.

A coating solution for the 1st layer was prepared in the following manner.

19.1 g of Yellow Coupler (Ex-Y), 0.17 g of Fog Inhibitor (Cpd-1) and 1.91 g of Dye Stabilizer (Cpd-2) were dissolved in 30.0 ml of ethyl acetate, 3.8 ml of Solvent (Solv-1) and 3.8 ml of Solvent (Solv-2). The solution thus obtained was then added to 135 ml of a 10% aqueous solution of gelatin containing 8.0 ml of 10% sodium dodecylbenzenesulfonate with vigorous stirring to make an emulsion dispersion.

The emulsion dispersion of yellow coupler was then mixed with the previously prepared Silver Halide Emulsions (A) and (B) to prepare the desired coating solution.

Coating solutions for the 2nd to 7th layers were prepared in the same manner as described above. These coating solutions were coated on a paper support laminated with polyethylene on both sides thereof in the layer structure and composition as set forth below to prepare a multilayer color photographic paper.

The composition of the various layers is set forth below.

The coated amount of each component is represented in g/m$^2$. The coated amount of silver halide emulsion is represented as calculated in terms of coated amount of silver.

Layer Structure

Support

Paper which was polyethylene laminated on both sides thereof [containing a white pigment ($TiO_2$) and a bluing dye (ultramarine) in the polyethylene layer on the side to be coated with the 1st layer]

| | |
|---|---|
| 1st Layer: Blue-sensitive Layer | |
| Silver halide emulsion (A) | 0.09 |
| Silver halide emulsion (B) | 0.21 |
| Gelatin | 1.28 |
| Yellow coupler (ExY) | 0.68 |
| Fog inhibitor (Cpd-1) | 0.006 |
| Dye stabilizer (Cpd-2) | 0.07 |
| Solvent (Solv-1) | 0.12 |
| Solvent (Solv-2) | 0.12 |
| 2nd Layer: Color Stain Inhibiting Layer | |
| Gelatin 1.34 | |
| Color stain inhibitor (Cpd-3) | 0.04 |
| Solvent (Solv-3) | 0.10 |
| Solvent (Solv-4) | 0.10 |
| 3rd Layer: Green-sensitive Layer | |
| Silver halide emulsion (C) | 0.075 |
| Silver halide emulsion (D) | 0.05 |
| Gelatin | 1.47 |
| Magenta coupler (ExM-1) | 0.32 |
| Dye stabilizer (Cpd-4) | 0.10 |
| Dye stabilizer (Cpd-5) | 0.08 |
| Dye stabilizer (Cpd-6) | 0.03 |
| Dye stabilizer (Cpd-7) | 0.004 |
| Solvent (Solv-3) | 0.25 |
| Solvent (Solv-5) | 0.40 |
| 4th Layer: Ultraviolet absorbing layer | |
| Gelatin | 1.43 |
| Ultraviolet absorbent (UV-1) | 0.47 |
| Color stain inhibitor (Cpd-3) | 0.05 |
| Solvent (Solv-6) | 0.24 |
| 5th Layer: Red-sensitive Layer | |
| Silver halide emulsion (E) | 0.06 |
| Silver halide emulsion (F) | 0.14 |
| Gelatin | 0.85 |
| Cyan coupler (ExC-1) | 0.13 |
| Cyan coupler (ExC-2) | 0.15 |
| Dye stabilizer (Cpd-2) | 0.25 |
| Fog inhibitor (Cpd-1) | 0.008 |
| Dye stabilizer (Cpd-5) | 0.004 |
| Dye stabilizer (Cpd-6) | 0.007 |
| Dye stabilizer (Cpd-8) | 0.067 |
| Solvent (Solv-1) | 0.16 |
| 6th Layer: Ultraviolet Absorbing Layer | |
| Gelatin | 0.38 |
| Ultraviolet absorbent (UV-1) | 0.13 |
| Solvent (Solv-6) | 0.06 |
| 7th Layer: Protective Layer | |
| Gelatin | 1.25 |

-continued
| | |
|---|---|
| Acryl-modified copolymer of polyvinyl alcohol (modification degree: 17%) | 0.05 |
| Liquid paraffin | 0.02 |
Yellow Coupler (ExY)
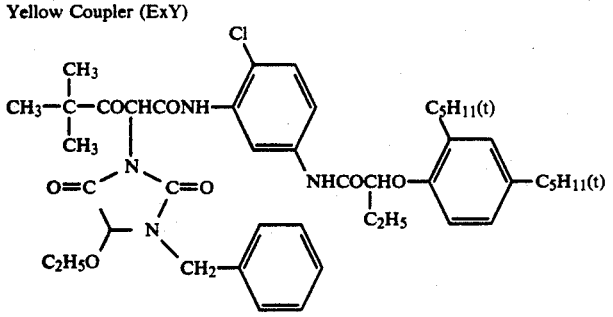
Magenta Coupler (ExM-1)
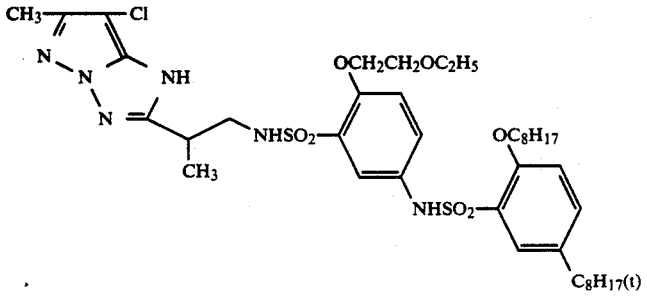
Cyan Coupler (ExC-1)
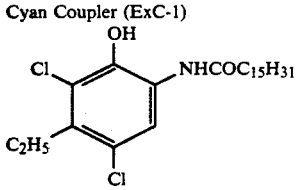
Cyan Coupler (ExC-2)
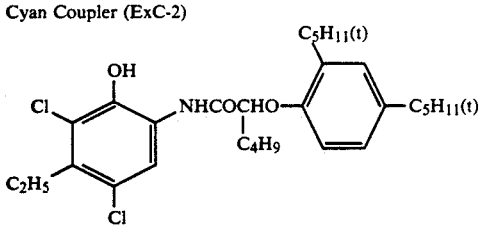
Fog Inhibitor (Cpd-1)
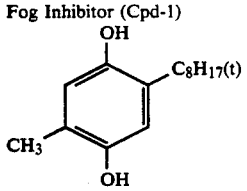
Dye Stabilizer (Cpd-2)
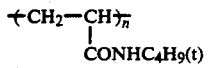
(Mean molecular weight: 60,000)
Color Stain Inhibitor (Cpd-3)
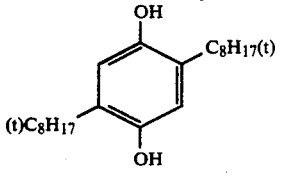

-continued
Dye Stabilizer (Cpd-4)
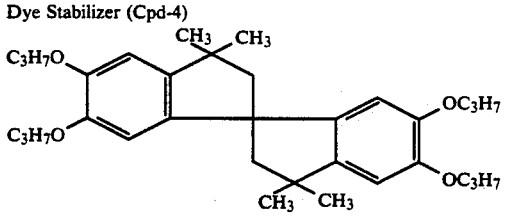
Dye Stabilizer (Cpd-5)
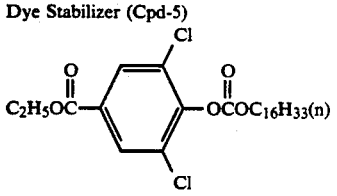
Dye Stabilizer (Cpd-6)
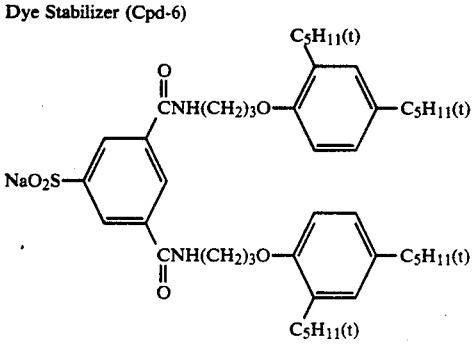
Dye Stabilizer (Cpd-7)
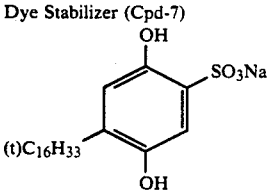
Dye Stabilizer (Cpd-8)
4:2:5 (weight ratio) mixture of:
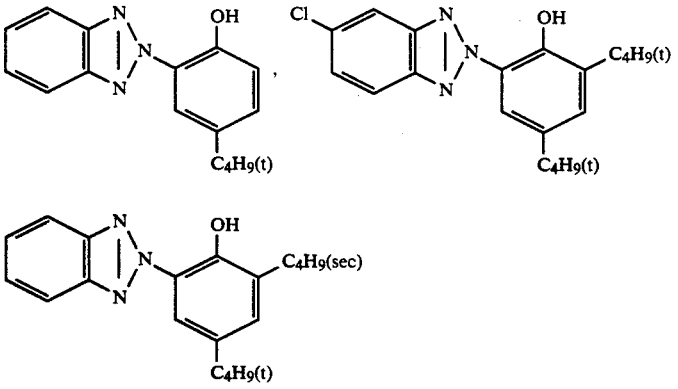
Ultraviolet Absorbent (UV-1)
12:10:3 (weight ratio) mixture of:
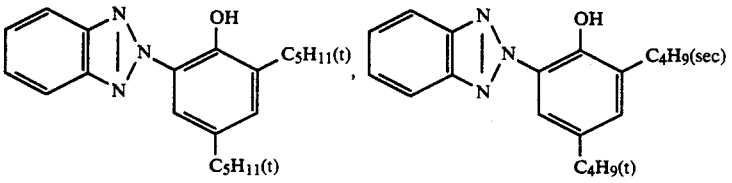

-continued

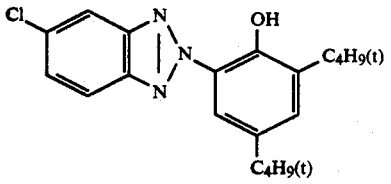

Solvent (Solv-1)

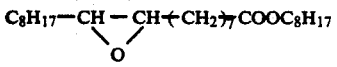

Solvent (Solv-2)

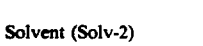

Solvent (Solv-3)

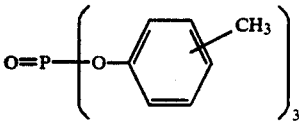

Solvent (Solv-4)

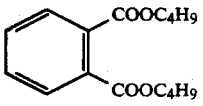

Solvent (Solv-5)

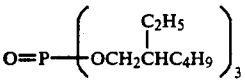

Solvent (Solv-6)

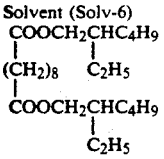

As gelatin hardeners for each layer there were used 1-oxy-3,5-dichloro-s-triazine sodium salt and 1,2-bis(-vinylsulfonyl)ethane.

As anti-irradiation dye there were used the following dyes:

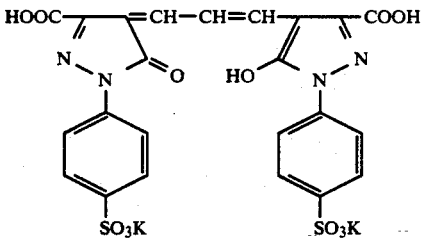

-continued

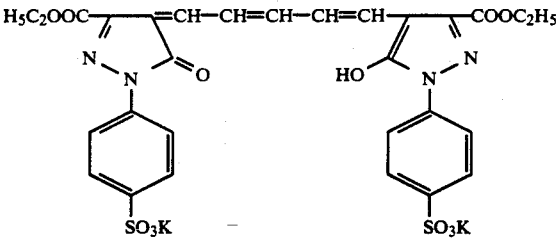

The specimen thus obtained was used as Specimen 101. Specimens 102 to 112 were prepared as color photographic paper specimens in the same manner as Specimen 101 except that the spectral sensitizing dye for the red-sensitive emulsion, the stabilizer and the composition of the 3rd layer were changed as set forth in Table 2.

TABLE 2

| Specimen | 101 | 102 | 103 | 104 | 105 | 106 |
|---|---|---|---|---|---|---|
| Spectral sensitizing dye for red-sensitive emulsion | Exemplary-2 | Exemplary-2 | Exemplary-2 | Comparative 1 | Comparative 1 | Comparative 2 |
| Added amount (mol/molAgX) | $6.1 \times 10^{-5}$ | $6.1 \times 10^{-5}$ | $6.1 \times 10^{-5}$ | $6.1 \times 10^{-5}$ | $6.1 \times 10^{-5}$ | $6.1 \times 10^{-5}$ |
| Present stabilizer | None | III-1 | II-52 | None | III-1 | None |
| Layer | — | 5th layer | 5th layer | — | 5th layer | — |
| Added amount | — | 0.120 | 0.190 | — | 0.120 | — |

TABLE 2-continued

| | | | | | | |
|---|---|---|---|---|---|---|
| 3rd Layer: (Green-sensitive layer) | | | | | | |
| Silver halide emulsion (C) | 0.075 | 0.075 | 0.075 | 0.075 | 0.075 | 0.075 |
| Silver halide emulsion (D) | 0.050 | 0.050 | 0.050 | 0.050 | 0.050 | 0.050 |
| Gelatin | 1.47 | 1.47 | 1.47 | 1.47 | 1.47 | 1.47 |
| Magenta Coupler | ExM-1 0.32 | ExM-1 0.32 | ExM-1 0.32 | ExM-1 0.32 | ExM-1 0.32 | ExM-1 0.32 |
| Dye stabilizer | Cpd-4 0.10 | Cpd-4 0.10 | Cpd-4 0.10 | Cpd-4 0.10 | Cpd-4 0.10 | Cpd-4 0.10 |
| Dye stabilizer | Cpd-6 0.03 | Cpd-6 0.03 | Cpd-6 0.03 | Cpd-6 0.03 | Cpd-6 0.03 | Cpd-6 0.03 |
| Dye stabilizer | Cpd-7 0.004 | Cpd-7 0.004 | Cpd-7 0.004 | Cpd-7 0.004 | Cpd-7 0.004 | Cpd-7 0.004 |
| Solvent | Solv-3 0.25 | Solv-3 0.25 | Solv-3 0.25 | Solv-3 0.25 | Solv-3 0.25 | Solv-3 0.25 |
| Solvent | Solv-5 0.40 | Solv-5 0.40 | Solv-5 0.40 | Solv-5 0.40 | Solv-5 0.40 | Solv-5 0.40 |
| 1st Layer: Emulsion (A) | 0.090 | 0.090 | 0.090 | 0.090 | 0.090 | 0.090 |
| Emulsion (B) | 0.210 | 0.210 | 0.210 | 0.210 | 0.210 | 0.210 |
| 5th Layer: Emulsion (E) | 0.060 | 0.060 | 0.060 | 0.060 | 0.060 | 0.060 |
| Emulsion (F) | 0.140 | 0.140 | 0.140 | 0.140 | 0.140 | 0.140 |
| Total amount of silver halide emulsions | 0.625 | 0.625 | 0.625 | 0.625 | 0.625 | 0.625 |

| Specimen | 107 | 108 | 109 | 110 | 111 | 112 |
|---|---|---|---|---|---|---|
| Spectral sensitizing dye for red-sensitive emulsion | Comparative 2 | Exemplary-2 | Exemplary-2 | Exemplary-2 | Exemplary-2 | Exemplary-2 |
| Added amount (mol/molAgX) | $6.1 \times 10^{-5}$ | $6.1 \times 10^{-5}$ | $6.1 \times 10^{-5}$ | $6.1 \times 10^{-5}$ | $6.1 \times 10^{-5}$ | $6.1 \times 10^{-5}$ |
| Present stabilizer | III-1 | III-1 | III-1 | III-1 | III-1 | III-1 |
| Layer | 5th layer | 5th layer | 5th layer | 5th layer | 5th layer | 5th layer |
| Added amount | 0.120 | 0.134 | 0.120 | 0.134 | 0.096 | 0.120 |
| 3rd Layer: (Green-sensitive layer) | | | | | | |
| Silver halide emulsion (C) | 0.075 | 0.084 | 0.090 | 0.101 | 0.144 | 0.180 |
| Silver halide emulsion (D) | 0.050 | 0.056 | 0.060 | 0.068 | 0.096 | 0.120 |
| Gelatin | 1.47 | 1.47 | 1.24 | 1.24 | 1.24 | 1.24 |
| Magenta Coupler | ExM-1 0.32 | ExM-1 0.32 | ExM-2 0.29 | ExM-2 0.29 | ExM-3 0.26 | ExM-3 0.26 |
| Dye stabilizer | Cpd-4 0.10 | Cpd-4 0.10 | Cpd-4 0.09 | Cpd-4 0.09 | Cpd-4 0.12 | Cpd-4 0.12 |
| Dye stabilizer | Cpd-5 0.08 | Cpd-5 0.08 | Cpd-9 0.06 | Cpd-9 0.06 | Cpd-10 0.09 | Cpd-10 0.09 |
| Dye stabilizer | Cpd-6 0.03 | Cpd-6 0.03 | — | — | Cpd-11 0.06 | Cpd-11 0.06 |
| Dye stabilizer | Cpd-7 0.004 | Cpd-7 0.004 | Solv-7 0.16 | Solv-7 0.16 | | |
| Solvent | Solv-3 0.25 | Solv-3 0.25 | Solv-3 0.25 | Solv-3 0.21 | Solv-3 0.21 | Solv-3 0.21 |
| Solvent | Solv-5 0.40 | Solv-5 0.40 | Solv-5 0.40 | Solv-5 0.21 | Solv-5 0.21 | Solv-5 0.21 |
| 1st Layer: Emulsion (A) | 0.090 | 0.100 | 0.090 | 0.100 | 0.072 | 0.090 |
| Emulsion (B) | 0.210 | 0.235 | 0.210 | 0.235 | 0.168 | 0.210 |
| 5th Layer: Emulsion (E) | 0.060 | 0.060 | 0.060 | 0.068 | 0.048 | 0.060 |
| Emulsion (F) | 0.140 | 0.157 | 0.140 | 0.157 | 0.112 | 0.140 |
| Total amount of silver halide emulsions | 0.625 | 0.700 | 0.650 | 0.729 | 0.640 | 0.800 |

Note:
In Specimens 104 to 107, the emulsions to be incorporated in the 5th layer were made by replacing spectral sensitizing dye used in the emulsion (E) and emulsion (F) by that as described above.

Red-sensitive Spectral Sensitizing Dye (Comparative-1)

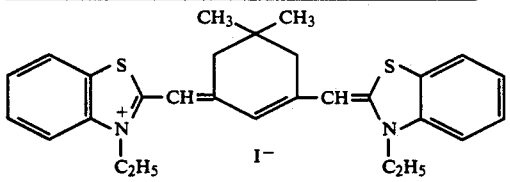

Red-sensitive Spectral Sensitizing Dye (Comparative-2)

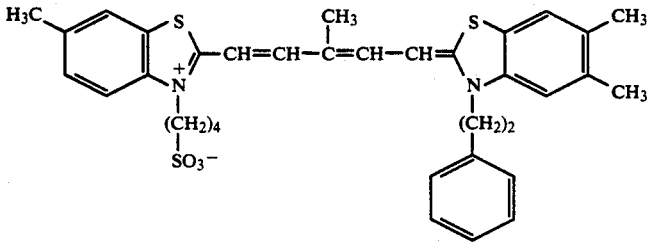

Magenta Coupler (ExM-2)

TABLE 2-continued

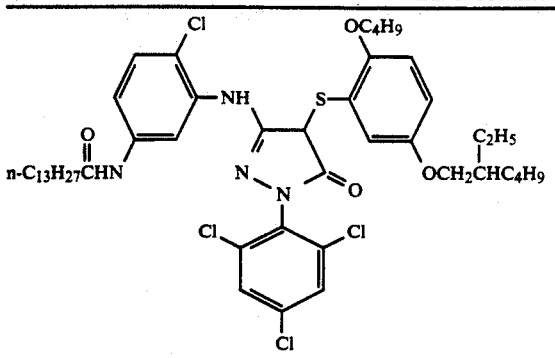

Magenta Coupler (ExM-3)

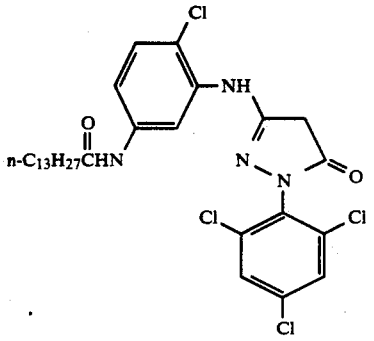

Dye Stabilizer (Cpd-9)

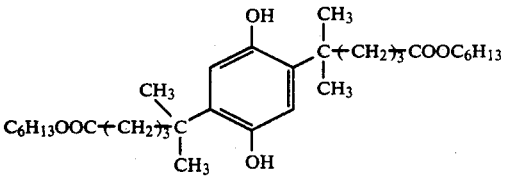

Dye Stabilzer (Cpd-10)

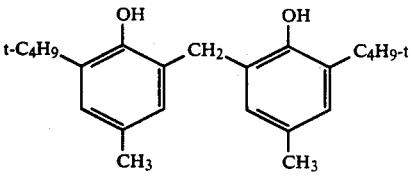

Dye Stabilizer (Cpd-11)

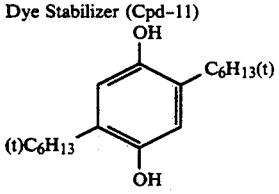

Solvent (Solv-7)

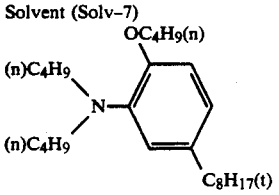

In order to check the photographic properties of these coated specimens, the following tests were conducted.

These specimens were subjected to stepwise exposure for sensitometry through a red filter and an optical wedge in a sensitometer (Fuji Photo Film Co., Ltd.'s Model FWH; color temperature of light source: 3,200° K.). The exposure was 250 CMS, and the exposure time was 1/10 seconds.

The specimens thus exposed were then subjected to color development with the processing solution described later in the processing procedure described later in an automatic developing machine. These specimens were then measured for cyan color density by means of a densitometer to obtain a so-called characteristic curve. The fog density and relative sensitivity were obtained from the results. The relative sensitivity is represented by a relative value of the reciprocal of the exposure which gives a density of 0.5 larger than the fog density.

In order to check the stability of the specimens during the preparation thereof, a specimen comprising a coating solution for the 5th layer which had been allowed to stand at 40° C. for 8 hours after being prepared was prepared and then measured for the drop in the sensitivity.

In order to check the fluctuation in the photographic properties of the specimens after an extended period of storage, these specimens were stored at a temperature of 25° C. and a relative humidity of 60% over 4 months and then subjected to the same tests as described above.

In order to check the change in the sensitivity of the specimens due to the fluctuation in temperature during the exposure, the difference in the sensitivity between the specimens exposed at a temperature of 15° C and a relative humidity of 60% and the specimens exposed at a temperature of 35° C. and a relative humidity of 60% was determined.

In order to check the whiteness of the edge formed by cutting of the specimens, 20 sheets of these specimens each were cut by DOI's Rollpaper Cutter 210, processed without being exposed, bundled, and then observed with the naked eye for evaluation. The evaluation was effected in accordance with the following criterion:

| Evaluation of Edge Whiteness | Result |
|---|---|
| E | Little or no coloring observed |
| G | Coloring observed by magnifier |
| F | Coloring observed with the naked eyes |
| P | Coloring observed remarkably |

The results are set forth in Table 3.

The processing procedure and the processing solutions used will be set forth below.

| Processing Step | Temperature | Time |
|---|---|---|
| Color development | 38° C. | 100 sec. |
| Blix | 35° C. | 60 sec. |
| Rinse 1 | 33–35° C. | 20 sec. |
| Rinse 2 | 33–35° C. | 20 sec. |
| Rinse 3 | 33–35° C. | 20 sec. |
| Drying | 70–80° C. | 50 sec. |

The composition of the various processing solutions used is set forth below.

| | |
|---|---|
| Color Developing Solution | |
| Water | 800 ml |
| Diethylenetriaminepentaacetic acid | 1.0 g |
| Nitrilotriacetic acid | 2.0 g |
| 1-Hydroxyethylidene-1,1-diphosphonic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-ethyl-N-(β-methanesulfonamidoethyl)-3-methyl-4-aminoaniline sulfate | 5.5 g |
| Hydroxylamine sulfate | 2.0 g |
| Fluorescent whitening agent (WHITEX 4B; Sumitomo Chemical) | 1.5 g |
| Water to make | 1,000 ml |
| pH (25° C.) | 10.20 |
| Blix Solution | |
| Water | 400 ml |
| Ammonium thiosulfate (70%) | 80 ml |
| Sodium sulfite | 24 g |
| Ferric ammonium ethylenediamine tetraacetate | 30 g |
| Disodium ethylenediaminetetraacetate | 5 g |
| Water | 1,000 ml |
| pH (25° C.) | 6.50 |
| Rinsing Solution | |
| Ion-exchanged water (calcium and magnesium concentration: 3 ppm or less each) | |

TABLE 3

| Specimen | 101 | 102 | 103 | 104 | 105 | 106 |
|---|---|---|---|---|---|---|
| [Specimen comprising coating solution for 5th layer just prepared] | | | | | | |
| Relative sensitivity | 100 | 100 | 100 | 100 | 100 | 100 |
| Fog density | 0.16 | 0.09 | 0.10 | 0.17 | 0.11 | 0.18 |
| [Specimen comprising coating solution for 5th layer after 8-hour storage at 40° C.] | | | | | | |
| Relative sensitivity | 98 | 97 | 96 | 79 | 62 | 91 |
| Fog density | 0.21 | 0.10 | 0.10 | 0.23 | 0.11 | 0.25 |
| [Specimen after 4-month storage at 25° C.-60% RH) | | | | | | |
| Relative sensitivity | 94 | 96 | 97 | 95 | 97 | 74 |
| Fog density | 0.19 | 0.09 | 0.10 | 0.19 | 0.11 | 0.21 |
| [Sensitivity fluctuation due to temperature change upon exposure] | | | | | | |
| Sensitivity at 35° C. to Sensitivity at 15° C. | +4 | +3 | +3 | +15 | +14 | +16 |
| Edge Whiteness | G | E | E | G | E | G |
| Remarks | Comparative | Present Invention | Present Invention | Comparative | Comparative | Comparative |

| Specimen | 107 | 108 | 109 | 110 | 111 | 112 |
|---|---|---|---|---|---|---|
| [Specimen comprising coating solution for 5th layer just prepared] | | | | | | |
| Relative sensitivity | 100 | 100 | 100 | 100 | 100 | 100 |
| Fog density | 0.11 | 0.10 | 0.09 | 0.10 | 0.09 | 0.11 |
| [Specimen comprising coating solution for 5th layer after 8-hour storage at 40° C.] | | | | | | |

TABLE 3-continued

| | | | | | | |
|---|---|---|---|---|---|---|
| Relative sensitivity | 89 | 97 | 98 | 98 | 97 | 98 |
| Fog density | 0.12 | 0.10 | 0.10 | 0.10 | 0.10 | 0.11 |
| [Specimen after 4-month storage at 25° C.-60% RH) | | | | | | |
| Relative sensitivity | 76 | 95 | 96 | 94 | 95 | 96 |
| Fog density | 0.12 | 0.11 | 0.09 | 0.10 | 0.09 | 0.11 |
| [Sensitivity fluctuation due to temperature change upon exposure] | | | | | | |
| Sensitivity at 35° C. to Sensitivity at 15° C. | +15 | +3 | +2 | +3 | +4 | +4 |
| Edge Whiteness | E | P | G | P | G | P |
| Remarks | Comparative | Comparative | Present Invention | Comparative | Present Invention | Comparative |

Note:
The relative sensitivity is a value relative to the sensitivity of a specimen comprising a fresh coating solution for the 5th layer which has been exposed and processed at room temperature immediately after preparation as 100.

The results show that specimens 106 and 107 comprising Comparative Sensitizing Dye-2 in combination with Stabilizer III-1 exhibit a small drop in the sensitivity due to ageing of the coating solution but exhibit a large drop in the sensitivity due to an extended storage thereof and a large sensitivity fluctuation due to a change in the exposure temperature. On the other hand, Specimens 104 and 105 comprising Comparative Sensitizing Dye-1 in combination with Stabilizer III-1 exhibit a small drop in the sensitivity due to an extended storage thereof but exhibit a large drop in the sensitivity due to ageing of the coating solution and a large sensitivity fluctuation due to a change in the exposure temperature. The specimens comprising the present spectral sensitizing dye of the general formula (I) in combination with the stabilizer of the general formula (II), (III) or (IV) can provide an excellent color photographic paper with a small fog, a small drop in the sensitivity due to aging of the coating solution, a small drop in the sensitivity due to an extended storage and a small sensitivity fluctuation due to a change in the exposure temperature. However, if the total coated amount of silver halide emulsion is not less than 0.65 g/m$^2$, it deteriorates the edge whiteness, making it impossible for the light-sensitive material to withstand practical use.

Specimens 102, 103, 109 and 111 with a total coated silver halide amount of 0.65 g/m$^2$ or less exhibit excellent results in all the properties. However, Specimen 111 exhibits a slightly lower maximum color density than the other specimens.

EXAMPLE 2

32 g of lime-treated gelatin was dissolved in 1,000 ml of distilled water at a temperature of 40° C. 5.8 g of sodium chloride was then added to the solution. The temperature of the solution was raised to 75° C. 3.8 ml of N,N'-dimethylimidazoline-2-thione (1% aqueous solution) was added to the solution. A solution of 6.4 g of silver nitrate in 180 ml of distilled water and 2.2 g of sodium chloride in 180 ml of distilled water were added to the solution within 10 minutes while the temperature was kept at 75° C. A solution of 153.6 g of silver nitrate in 410 ml of distilled water and 52.8 g of sodium chloride in 410 ml of distilled water were then added to the solution within 35 minutes while the temperature was kept at 75° C. The admixture was then kept at a temperature of 75° C. for 5 minutes after the addition of the aqueous solution of silver nitrate and the aqueous solution of sodium chloride. The solution was then cooled to 40° C. The solution was then subjected to desalting and washing with water. Furthermore, lime-treated gelatin was added to the solution to adjust the pH and pAg thereof. The emulsion was then subjected to ripening with Spectral Sensitizing Dyes (Dye-1) and (Dye-4) as described later, 0.7 mol of an emulsion of finely divided silver bromide having a mean grain size of 0.05 μm, 4-hydroxy-6-methyl-1,3,3a-tetraazaindene and triethylthiourea to obtain Emulsion (G). The emulsion thus obtained comprised cubic silver bromochloride grains having a mean grain size of 1.12 μm, a grain size fluctuation coefficient of 0.07 and a silver bromide content of 0.7 mol.

Emulsions (H) and (I) were prepared in the same manner as Emulsion (G) except that the amount of the chemicals to be added, the time for which the chemicals are added, and the temperature at which the reaction was carried out were changed. However, for Emulsion (H), the spectral sensitization was effected with Spectral Sensitizing Dyes (Dye-2-1) and (Dye-2-2). Emulsion (H) was used as a green-sensitive emulsion. For Emulsion (I), the spectral sensitization was effected with Spectral Sensitizing Dye (Dye-3). Emulsion (I) was a used as red-sensitive emulsion.

The crystal form, mean halogen composition, mean grain size and grain size fluctuation coefficient of Emulsions (G) to (I) are set forth in Table 4.

TABLE 4

| Emulsion | Crystal Form | Mean Halogen Composition (Br mol %) | Mean Grain Size (μm) | Grain Size Fluctuation Coefficient |
|---|---|---|---|---|
| (G) | Cube | 0.7 | 1.12 | 0.07 |
| (H) | Cube | 1.2 | 0.45 | 0.08 |
| (I) | Cube | 2.0 | 0.36 | 0.09 |

These emulsion grains were then measured for X-ray diffraction pattern. As a result, Emulsion(G) was observed to exhibit a secondary peak with a low intensity corresponding to 80 mol % of silver chloride (20 mol % of silver bromide) besides a primary peak corresponding to 100 mol % of silver chloride. Emulsion (H) was observed to exhibit a secondary peak with a low intensity corresponding to 72 mol % of silver chloride (28 mol % of silver bromide). Emulsion (I) was observed to exhibit a secondary peak with a low intensity corresponding to 61 mol % (39 mol % of silver bromide).

Dye (Dye-1) for blue-sensitive emulsion

-continued

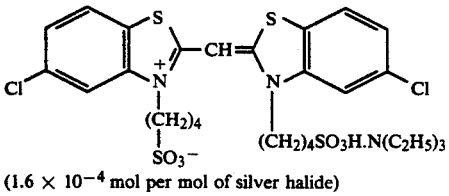

(1.6 × $10^{-4}$ mol per mol of silver halide)

Dye (Dye-4) for blue-sensitive emulsion

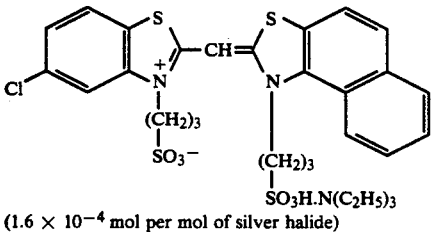

(1.6 × $10^{-4}$ mol per mol of silver halide)

Dye (Dye-2-1) for green-sensitive emulsion

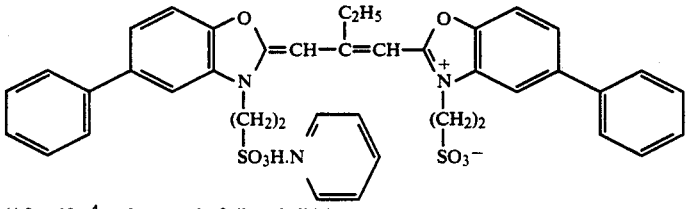

(4.0 ×$10^{-4}$ mol per mol of silver halide)

(Dye-2-2)

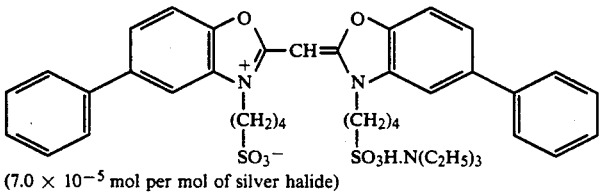

(7.0 × $10^{-5}$ mol per mol of silver halide)

Dye (Dye-3) for red-sensitive emulsion

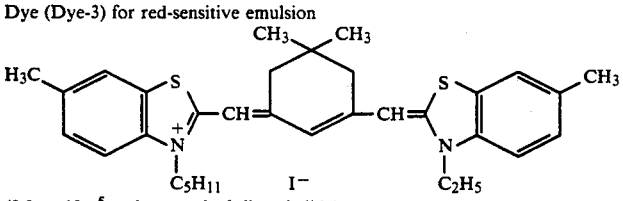

(8.0 × $10^{-5}$ mol per mol of silver halide)

To the red-sensitive emulsion was added the following compound in an amount of 2.5×$10^{-3}$ per mol of silver halide.

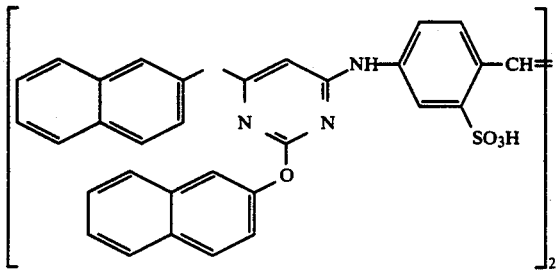

Silver Halide Emulsions (G), (H) and (I) were then mixed with color coupler emulsion dispersions prepared in the same manner as described in Example 1 to prepare the desired coating solutions. These coating solutions were coated on a support laminated with polyethylene on both sides thereof in the layer structure and composition as set forth below to prepare a multilayer color photographic paper.

The composition of the various layers will be set forth below.

The coated amount of each component is represented in g/$m^2$. The coated amount of silver halide emulsion is represented as calculated in terms of coated amount of silver.

Layer Structure

Support

Paper which was polyethylene laminated on both sides [containing a white pigment ($TiO_2$) and a bluing dye (ultramarine) in the polyethylene layer on the side to be coated with the 1st layer]

| | |
|---|---|
| 1st Layer: Blue-sensitive Layer | |
| Silver halide emulsion (G) | 0.25 |
| Gelatin | 1.07 |
| Yellow coupler (ExY) | 0.63 |
| Dye stabilizer (Cpd-2) | 0.01 |
| Solvent (Solv-4) | 0.26 |
| 2nd Layer: Color Stain Inhibiting Layer | |
| Gelatin | 1.24 |
| Color stain inhibitor (Cpd-3) | 0.11 |
| Solvent (Solv-3) | 0.28 |
| Solvent (Solv-4) | 0.28 |
| 3rd Layer: Green-sensitive Layer | |
| Silver halide emulsion (H) | 0.12 |
| Gelatin | 1.24 |
| Magenta coupler (ExM-4) | 0.20 |
| Dye stabilizer (Cpd-4) | 0.08 |
| Dye stabilizer (Cpd-5) | 0.06 |
| Dye stabilizer (Cpd-6) | 0.02 |
| Dye stabilizer (Cpd-7) | 0.003 |
| Solvent (Solv-3) | 0.20 |
| Solvent (Solv-5) | 0.32 |
| 4th Layer: Ultraviolet Absorbing Layer | |
| Gelatin | 1.42 |
| Ultraviolet absorbent (UV-1) | 0.47 |
| Color stain inhibitor (Cpd-3) | 0.05 |
| Solvent (Solv-6) | 0.24 |
| 5th Layer: Red-sensitive Layer | |
| Silver halide emulsion (I) | 0.20 |
| Gelatin | 1.05 |
| Cyan coupler (ExC-3) | 0.20 |
| Cyan coupler (ExC-4) | 0.09 |
| Cyan coupler (ExC-5) | 0.03 |
| Cyan coupler (ExC-1) | 0.03 |
| Dye stabilizer (Cpd-2) | 0.31 |
| Dye stabilizer (Cpd-12) | 0.04 |
| Dye stabilier (Cpd-8) | 0.30 |
| Solvent (Solv-8) | 0.35 |
| 6th Layer: Ultraviolet Absorbing Layer | |
| Gelatin | 0.48 |
| Ultraviolet absorbent (UV-1) | 0.16 |
| Solvent (Solv-6) | 0.08 |
| 7th Layer: Protective Layer | |
| Gelatin | 1.22 |
| Acryl-modified copolymer of polyvinyl alcohol (modification degree: 17%) | 0.05 |
| Liquid paraffin | 0.02 |

Magenta Coupler (ExM-4)

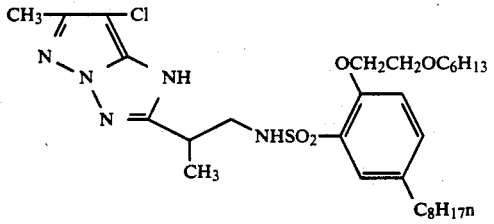

-continued

Cyan Coupler (Exc-3)

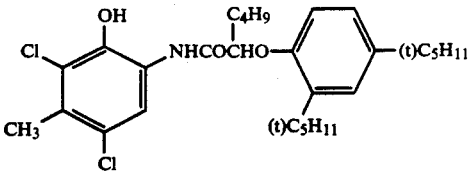

Cyan Coupler (Exc-4)

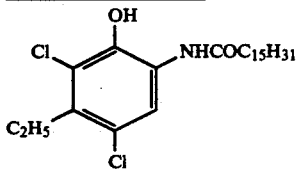

Cyan Coupler (Exc-5)

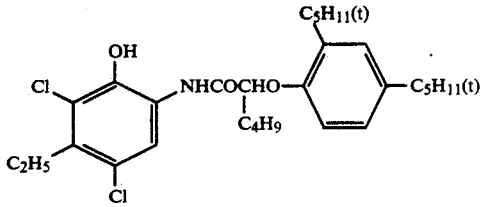

Dye Stabilizer (Cpd-12)

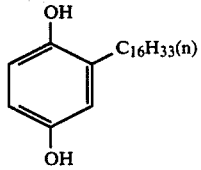

Solvent (Solv-8)

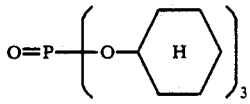

As gelatin hardeners for each layer there were used 1-oxy-3,5-dichloro-s-triazine sodium salt and 1,2-bis(-vinylsulfonyl)ethane.

As anti-irradiation dyes there were used the following dyes:

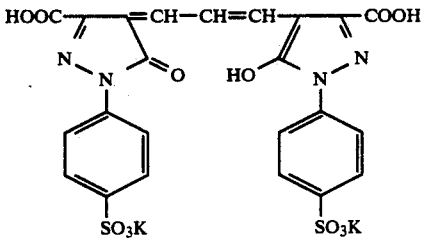

and

-continued

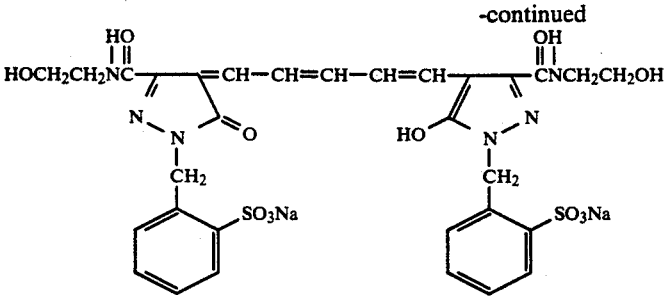

The specimen thus obtained was used as Specimen 201. Specimens 202 to 212 were prepared as color photographic paper specimens in the same manner as Specimen 201 except that the spectral sensitizing dye for the red-sensitive emulsion, the stabilizer and the composition of the 3rd layer were changed as set forth in Table 5.

TABLE 5

| Specimen | 201 | 202 | 203 | 204 | 205 | 206 |
|---|---|---|---|---|---|---|
| Spectral sensitizing dye for red-sensitive emulsion | Exemplary-2 | Exemplary-2 | Exemplary-2 | Comparative-1 | Comparative-1 | Comparative-2 |
| Added amount (mol/mol AgX) | $8.0 \times 10^{-5}$ | $8.0 \times 10^{-5}$ | $8.0 \times 10^{-5}$ | $8.0 \times 10^{-5}$ | $8.0 \times 10^{-5}$ | $8.0 \times 10^{-5}$ |
| Present stabilizer | None | II-45 | II-22 | None | II-45 | None |
| Layer | | 5th layer | 4th layer | | 5th layer | |
| Added amount (mg/m$^2$) | | 0.240 | 0.300 | | 0.240 | |
| 3rd Layer (Green-sensitive layer) | | | | | | |
| Silver halide emulsion (H) | 0.120 | 0.120 | 0.120 | 0.120 | 0.120 | 0.120 |
| Gelatin 1.24 | 1.24 | 1.24 | 1.24 | 1.24 | 1.24 | |
| Magenta coupler | ExM-4 0.20 | ExM-4 0.20 | ExM-4 0.20 | ExM-4 0.20 | ExM-4 0.20 | ExM-4 0.20 |
| Dye stabilizer | Cpd-4 0.08 | Cpd-4 0.08 | Cpd-4 0.08 | Cpd-4 0.08 | Cpd-4 0.08 | Cpd-4 0.08 |
| Dye stabilizer | Cpd-5 0.06 | Cpd-5 0.06 | Cpd-5 0.06 | Cpd-5 0.06 | Cpd-5 0.06 | Cpd-5 0.06 |
| Dye stabilizer | Cpd-6 0.02 | Cpd-6 0.02 | Cpd-6 0.02 | Cpd-6 0.02 | Cpd-6 0.02 | Cpd-6 0.02 |
| Dye stabilizer | Cpd-7 0.003 | Cpd-7 0.003 | Cpd-7 0.003 | Cpd-7 0.003 | Cpd-7 0.003 | Cpd-7 0.003 |
| 3rd Layer (Green-sensitive layer) | | | | | | |
| Solvent | Solv-3 0.02 | Solv-3 0.02 | Solv-3 0.02 | Solv-3 0.02 | Solv-3 0.02 | Solv-3 0.02 |
| Solvent | Solv-5 0.32 | Solv-5 0.32 | Solv-5 0.32 | Solv-5 0.32 | Solv-5 0.32 | Solv-5 0.32 |
| 1st Layer Emulsion (G) | 0.250 | 0.250 | 0.250 | 0.250 | 0.250 | 0.250 |
| 5th Layer Emulsion (I) | 0.200 | 0.200 | 0.200 | 0.200 | 0.200 | 0.200 |
| Total amount of silver halide emulsions | 0.570 | 0.570 | 0.570 | 0.570 | 0.570 | 0.570 |

| Specimen | 207 | 208 | 209 | 210 | 211 | 212 |
|---|---|---|---|---|---|---|
| Spectral sensitizing dye for red-sensitive emulsion | Comparative-2 | Exemplary-2 | Exemplary-2 | Exemplary-2 | Exemplary-2 | Exemplary-2 |
| Added amount (mol/mol AgX) | $8.0 \times 10^{-5}$ | $8.0 \times 10^{-5}$ | $8.0 \times 10^{-5}$ | $8.0 \times 10^{-5}$ | $8.0 \times 10^{-5}$ | $8.0 \times 10^{-5}$ |
| Present stabilizer | II-45 | II-45 | II-45 | II-45 | II-45 | II-45 |
| Layer | 5th layer | 5th layer | 5th layer | 5th layer | 5th layer | 5th layer |
| Added amount | 0.240 | 0.288 | 0.240 | 0.269 | 0.197 | 0.240 |
| 3rd Layer (Green-sensitive layer) | | | | | | |
| Silver halide emulsion (H) | 0.120 | 0.144 | 0.200 | 0.224 | 0.271 | 0.330 |
| Gelatin 1.24 | 1.24 | 1.24 | 1.24 | 1.24 | 1.24 | |
| Magenta coupler | ExM-4 0.20 | ExM-4 0.20 | ExM-5 0.26 | ExM-5 0.26 | ExM-3 0.26 | ExM-3 0.26 |
| Dye stabilizer | Cpd-4 0.08 | Cpd-4 0.08 | Cpd-4 0.09 | Cpd-4 0.09 | Cpd-4 0.12 | Cpd-4 0.12 |
| Dye stabilizer | Cpd-5 0.06 | Cpd-5 0.06 | Cpd-9 0.06 | Cpd-9 0.06 | Cpd-10 0.09 | Cpd-10 0.09 |
| Dye stabilizer | Cpd-6 0.02 | Cpd-6 0.02 | — | — | Cpd-11 0.06 | Cpd-11 0.06 |
| Dye stabilizer | Cpd-7 0.003 | Cpd-7 0.003 | Solv-7 0.16 | Solv-7 0.16 | — | — |
| 3rd Layer (Green-sensitive layer) | | | | | | |
| Solvent | Solv-3 0.02 | Solv-3 0.02 | Solv-3 0.25 | Solv-3 0.21 | Solv-3 0.21 | Solv-3 0.21 |
| Solvent | Solv-5 0.32 | Solv-5 0.32 | Solv-5 0.40 | Solv-5 0.21 | Solv-5 0.21 | Solv-5 0.21 |
| 1st Layer Emulsion (G) | 0.250 | 0.300 | 0.250 | 0.280 | 0.205 | 0.250 |
| 5th Layer Emulsion (I) | 0.200 | 0.240 | 0.200 | 0.224 | 0.164 | 0.200 |
| Total amount of silver halide | 0.570 | 0.684 | 0.650 | 0.728 | 0.640 | 0.780 |

TABLE 5-continued emulsions

Note:
In Specimens 204 to 207, the emulsions to be incorporated in the 5th layer were emulsions wherein spectral sensitizing dye was replaced by Spectral Sensitizing Dye (H) as described above.
Magenta Coupler (ExM-5)

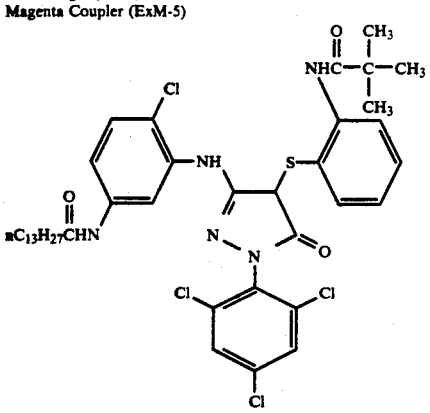

In order to check the photographic properties of these coated specimens, the following tests were conducted.

These specimens were measured for sensitometry, stability of coating solution with time, stability of light-sensitive material during the storage thereof, temperature dependence upon exposure and edge whiteness of cut portion in the same manner as in Example 1. However, the color development was effected with the processing solution described later in the processing steps described later.

The results are set forth in Table 6.

| Processing Step | Temperature (°C.) | Time |
|---|---|---|
| Color Development | 38 | 45 sec. |
| Blix | 30 to 36 | 45 sec. |
| Rinse 1 | 30 to 37 | 30 sec. |
| Rinse 2 | 33 to 37 | 30 sec. |
| Rinse 3 | 33 to 37 | 30 sec. |
| Drying | 70 to 80 | 60 sec. |

The composition of the various processing solutions used are set forth below.

| | |
|---|---|
| Color Development Solution | |
| Water | 800 ml |
| Ethylenediamine-N,N,N,N-tetra-methylenephosphonic acid | 3.0 g |
| N,N-di(carboxymethyl)hydrazine | 4.5 g |
| Sodium chloride | 3.5 g |
| Potassium bromide | 0.025 g |
| Potassium carbonate | 25.0 g |
| N-Ethyl-N-(β-methanesulfonamidoethyl)-3-methyl-4-aminoaniline sulfate | 5.0 g |
| Fluorescent whitening agent (WHITEX 4; Sumitomo Chemical) | 1.2 g |
| Water to make | 1,000 ml |
| pH (25° C.) | 10.05 |
| Blix Solution | |
| Water | 400 ml |
| Ammonium thiosulfate (55%) | 100 ml |
| Sodium sulfite | 17 g |
| Ferric ammonium ethylenediamine-tetraacetate | 55 g |
| Disodium ethylenediaminetetra-acetate | 5 g |
| Ammonium bromide | 40 g |
| Glacial acetic acid | 9 g |
| Water | 1,000 ml |
| pH (25° C.) | 5.80 |
| Rinsing Solution | |
| Ion-exchanged water (calcium and magnesium concentration: 3 ppm or less each) | |

TABLE 6

| Specimen | 201 | 202 | 203 | 204 | 205 | 206 |
|---|---|---|---|---|---|---|
| (Specimen comprising coating solution for 5th layer just prepared) | | | | | | |
| Relative sensitivity | 100 | 100 | 100 | 100 | 100 | 100 |
| Fog density | 0.19 | 0.10 | 0.10 | 0.21 | 0.11 | 0.23 |
| (Specimen comprising coating solution for 5th layer after 8-hour storage at 40° C.) | | | | | | |
| Relative sensitivity | 97 | 96 | 97 | 68 | 54 | 80 |
| Fog density | 0.28 | 0.10 | 0.11 | 0.29 | 0.12 | 0.32 |
| (Specimen after 4-month storage at 25° C.-60% RH) | | | | | | |
| Relative sensitivity | 95 | 97 | 98 | 93 | 95 | 77 |
| Fog density | 0.23 | 0.11 | 0.10 | 0.25 | 0.11 | 0.27 |
| (Sensitivity fluctuation due to temperature change upon exposure) | | | | | | |
| Sensitivity at 35° C. to Sensitivity at 15° C. | +5 | +4 | +4 | +23 | +21 | +24 |
| Edge Whiteness | G | E | E | G | E | G |
| Remarks | Comparative | Present Invention | Present Invention | Comparative | Comparative | Comparative |

TABLE 6-continued

| Specimen | 207 | 208 | 209 | 210 | 211 | 212 |
|---|---|---|---|---|---|---|
| (Specimen comprising coating solution for 5th layer just prepared) | | | | | | |
| Relative sensitivity | 100 | 100 | 100 | 100 | 100 | 100 |
| Fog density | 0.12 | 0.10 | 0.10 | 0.11 | 0.10 | 0.11 |
| (Specimen comprising coating solution for 5th layer after 8-hour storage at 40° C.) | | | | | | |
| Relative sensitivity | 81 | 96 | 96 | 96 | 95 | 97 |
| Fog density | 0.13 | 0.10 | 0.10 | 0.11 | 0.10 | 0.11 |
| (Specimen after 4-month storage at 25° C.-60% RH) | | | | | | |
| Relative sensitivity | 78 | 97 | 98 | 97 | 97 | 96 |
| Fog density | 0.12 | 0.11 | 0.10 | 0.10 | 0.11 | 0.10 |
| (Sensitivity fluctuation due to temperature change upon exposure) | | | | | | |
| Sensitivity at 35° C. to Sensitivity at 15° C. | +23 | +4 | +3 | +4 | +5 | +4 |
| Edge Whiteness | E | P | G | P | G | P |
| Remarks | Comparative | Comparative | Present Invention | Comparative | Present Invention | Comparative |

Note:
(i) The relative sensitivity is a value relative to the sensitivity of a specimen comprising a fresh coating solution for the 5th layer which has been exposed a processed at room temperature immediately after preparation as 100.
(ii) Edge whiteness on each specimen was evaluated in accordance with the same criterion as in Example 1.

The results shown that high silver chloride content color photographic papers for rapid processing, too, exhibit remarkable effects of the present invention. These specimens exhibit a rather greater effect of improving the stability of the coating solution with time and the stability of the sensitivity against temperature change upon exposure than the specimens in Example 1.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising on a reflective support having thereon at least three light-sensitive emulsion layers having different color sensitivities, wherein at least one of said light-sensitive emulsion layers comprises a silver halide emulsion spectrally sensitized with at least one compound represented by the formula (I) in a red sensitive layer, at least one of said light-sensitive emulsion layers or light-insensitive layers comprises on said support at least one compound represented by the formula (II), (III) or (IV), and the total amount of silver halide emulsion on said support is 0.65 g/m$^2$ or less as calculated in terms of coated amount of silver:

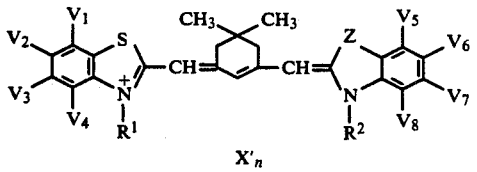

(I)

wherein Z represents an oxygen atom or sulfur atom; $R_1$ and $R_2$ each represent a substituted or unsubstituted alkyl group; $V_1$, $V_2$, $V_3$, $V_4$, $V_5$, $V_6$, $V_7$, and $V_8$ each represents a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfonic acid group or an aryl group, with the proviso that two of $V_1$ to $V_8$ which are bonded to adjacent carbon atoms do not together form a condensed ring and that assuming Hammett's value op of each of $V_1$ to $V_8$ is $\sigma pi$ (i=1 to 8) and $Y=\sigma p1+\sigma p2+\sigma p3+\sigma p4+\sigma p5+\sigma p6+\sigma p7+\sigma p8$, then $Y=-0.08$ if Z is an oxygen atom or $Y\leqq-0.15$ if Z is a sulfur atom; X' represents a charge balance paired ion; and n represents a value required to neutralize the electric charge:

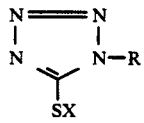

(II)

wherein R represents an alkyl group, an alkenyl group or an aryl group; and X represents a hydrogen atom, an alkali metal atom, an ammonium group or a precursor:

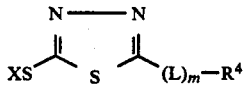

(III)

wherein L represents a divalent connecting group; $R^4$ represents a hydrogen atom, alkyl group, alkenyl group or aryl group; X is as defined for the formula (II); and m represents an integer 0 or 1:

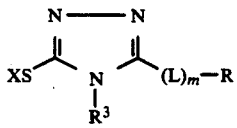

(IV)

wherein R and X are as defined for the formula (II); L and m are as defined for the formula (III); $R^3$ has the same meaning as R, with the proviso that these groups may be the same or different; and m represents an integer 0 or 1.

2. A silver halide color photographic material as claimed in claim 1, wherein the three light-sensitive emulsion layers are a blue-sensitive silver halide emulsion layer, a green-sensitive silver halide emulsion layer and a red-sensitive silver halide emulsion layer comprising a silver halide emulsion spectrally sensitized with the compound of the formula (I).

3. A silver halide color photographic material as claimed in claim 2, wherein said green-sensitive emulsion layer comprises a two-equivalent magenta coupler.

4. A silver halide color photographic material as claimed in claim 2, wherein at least one of said blue-sensitive emulsion layer, green-sensitive emulsion layer and red-sensitive emulsion layer comprises a silver bromochloride or silver chloride emulsion with a silver chloride content of 90 mol %.

5. A silver halide color photographic material as claimed in claim 1, wherein $R_1$ and $R_2$ each represents an unsubstituted alkyl or a sulfoalky group.

6. A silver halide color photographic material as claimed in claim 1, wherein at least one of $R_1$ and $R_2$ is an unsubstituted alkyl group having from 5 to 8 carbon atoms.

7. A silver halide color photographic material as claimed in claim 1, wherein $V_1$, $V_2$, $V_3$, $V_4$, $V_5$, $V_6$, $V_7$ and $V_8$ each represents a hydrogen atom, an unsubstituted alkyl group, or an alkoxy group, and all of $V_1$ to $V_8$ are not a hydrogen atom simultaneously.

8. A silver halide color photographic material as claimed in claim 1, wherein $Y \leqq -0.15$ if Z is an oxygen atom, or $Y \leqq -0.30$ if Z is a sulfur atom.

9. A silver halide color photographic material as claimed in claim 1, wherein Y satisfies the relationship $-0.90 \leqq Y \leqq -0.17$ if Z is an oxygen atom, or $-1.05 \leqq Y \leqq -0.34$ if Z is a sulfur atom.

10. A silver halide color photographic material as claimed in claim 1, wherein the light-sensitive emulsion spectrally sensitized with at least one compound represented by the formula (I) contains additionally compounds represented by the formula (V):

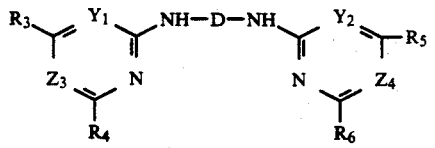

(V)

wherein D represents a divalent aromatic residue; and $R_3$, $R_4$, $R_5$ and $R_6$ each represents a hydrogen atom, a hydroxyl group, an alkoxy group, an aryloxy group, a halogen atom, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group;

$Y_1$ and $Z_3$ each represents —N= or —CH=, at least one of $Y_1$ and $Z_3$ is —N=; and $Y_2$ and $Z_4$ have the same meaning as $Y_1$ and $Z_3$.

11. A silver halide color photographic material as claimed in claim 10, wherein at least one of $R_3$, $R_4$, $R_5$ and $R_6$ is an aryloxy group, a heterocyclylthio group or a heterocyclylamino group.

12. A silver halide color photographic material as claimed in claim 1, wherein the amount of the compound represented by the formula (II), (III) or (IV) to be incorporated is in the range of about $1.0 \times 10^{-5}$ to about $5.0 \times 10^{-2}$ mol per mol of silver halide.

13. A silver halide color photographic material as claimed in claim 1, wherein the amount of the compound represented by the formula (II), (III) or (IV) to be incorporated is in the range of about $1.0 \times 10^{-4}$ to about $1.0 \times 10^{-2}$ mol per mol of silver halide.

* * * * *